United States Patent [19]

Ishikawa et al.

[11] Patent Number: 4,983,503

[45] Date of Patent: Jan. 8, 1991

[54] METHOD FOR PROCESSING LIGHT-SENSITIVE SILVER HALIDE COLOR PHOTOGRPAHIC MATERIAL

[75] Inventors: Masao Ishikawa; Shigeharu Koboshi; Satoru Kuse; Masayuki Kurematsu, all of Hino, Japan

[73] Assignee: Konica Corporation, Tokyo, Japan

[21] Appl. No.: 488,473

[22] Filed: Feb. 26, 1990

Related U.S. Application Data

[63] Continuation of Ser. No. 209,082, Jun. 17, 1988, abandoned.

[30] Foreign Application Priority Data

| | | | |
|---|---|---|---|
| Jun. 24, 1987 | [JP] | Japan | 62-158439 |
| Jun. 25, 1987 | [JP] | Japan | 62-159245 |
| Jun. 26, 1987 | [JP] | Japan | 62-160449 |

[51] Int. Cl.[5] ..... G03C 7/00; G03C 7/02; G03C 7/42

[52] U.S. Cl. ..... 430/393; 430/400; 430/460; 430/552; 430/553; 430/558

[58] Field of Search ..... 430/393, 400, 460, 552, 430/553, 558

[56] References Cited

U.S. PATENT DOCUMENTS

| | | | |
|---|---|---|---|
| 3,879,203 | 4/1975 | Schranz et al. | 430/393 |
| 4,607,002 | 8/1986 | Nakayama et al. | 430/505 |
| 4,622,287 | 11/1986 | Umemoto et al. | 430/505 |
| 4,707,434 | 11/1987 | Kobashi et al. | 430/393 |
| 4,769,312 | 9/1988 | Kishimoto et al. | 430/384 |
| 4,818,667 | 4/1989 | Hamada et al. | 430/502 |

FOREIGN PATENT DOCUMENTS

| | | |
|---|---|---|
| 62-123459 | 6/1987 | Japan . |
| 62-166339 | 7/1987 | Japan . |

*Primary Examiner*—Paul R. Michl
*Assistant Examiner*—Patrick A. Doody
*Attorney, Agent, or Firm*—Frishauf, Holtz, Goodman & Woodward

[57] ABSTRACT

There are disclosed a method for processing a light-sensitive silver halide color photographic material by subjecting a light-sensitive silver halide color photographic material after color developing to bleach-fixing processing, characterized in that the light-sensitive silver halide color photographic material contains at least one cyan coupler represented by the formula (A), (B) or (C) as specified in the specification, or contains at least one magenta coupler represented by the formula (M-1), the bleach-fixing processing step is a step which is a counter-current system uses two or more tanks of continuous bleach-fixing tanks, and the silver concentration in the bleach-fixing solution in a final tank of the bleach-fixing tanks is maintained at 80% or lower of the silver concentration in a bleach-fixing solution in a first tank, and a method for processing a light-sensitive silver halide color photographic material by subjecting a light-sensitive silver halide color photographic material after color developing to bleach-fixing processing and then to stabilizing processing substituted for water washing, characterized in that the light-sensitive silver halide color photographic material has at least one light-sensitive emulsion layer containing a silver halide emulsion containing 0.5 mole % or more of silver iodide, the bleach-fixing processing step is a step which is a counter-current system by use of an organic acid metal complex as the oxidizing agent and uses two or more tanks of continuous bleach-fixing tanks, and the silver concentration in a final tank of the bleach-fixing tanks is maintained at 80% or lower of the silver concentration in the bleach-fixing solution in a first tank.

15 Claims, No Drawings

METHOD FOR PROCESSING LIGHT-SENSITIVE SILVER HALIDE COLOR PHOTOGRPAHIC MATERIAL

This application is a continuation of application Ser. No. 07/209,082, filed June 17, 1988, now abandoned.

BACKGROUND OF THE INVENTION

This invention relates to a method for processing light-sensitive silver halide color photographic material. More particularly, it pertains to a method for processing light-sensitive silver halide color photographic material (hereinafter called "light-sensitive material") which has rapid desilverization characteristic and stabilities of cyan dye image and magenta dye image, and prevents cyan stain and drying contamination in rapid processing.

Generally speaking, for obtaining a color image by processing of a light-sensitive material subjected to imagewise exposure, the metallic silver formed after the color developing step is processed with a processing solution having bleaching ability, and subsequently the processing steps such as water washing, stabilizing substituted for water washing, stabilizing, etc. are provided.

As the processing solution having bleaching ability, bleaching solution, bleach-fixing solution have been known. When a bleaching solution is employed, subsequent to the bleaching step is ordinarily added the step of fixing the silver halide with the fixing agent, but bleaching and fixing are performed in one step with a bleach-fixing solution.

In the processing solution having bleach-fixing ability in the processing of light-sensitive material, as the oxidizing agent for bleaching image silver, inorganic oxidizing agents such as red prussiate, bichromate, etc. have been widely employed.

However, the processing solution having bleaching ability containing these inorganic oxidizing agents has been pointed out to have some vital defects. For example, although red prussiate and bichromate are comparatively excellent in the point of bleaching power of image silver, they may be decomposed with light to form cyan ions or hexavalent chromium ions harmful to human body, thus having undesirable properties in prevention of pollution. Also, since these oxidizing agents have extremely strong oxidizing power, a silver halide solubilizing agent (fixing agent) such as thiosulfate, etc. can be permitted to co-exist in the same processing solution with difficulty, and it is almost impossible to use these oxidizing agents in the bleach-fixing bath, whereby the object of making the processing rapid and simple can be accomplished with difficulty. Further, there is involved a problem that the processing solutions containing these inorganic oxidizing agents are difficult to regenerate and use without disposing these waste solutions after processing.

In contrast, as the solution meeting the demand of making processing rapid, simple, capable of regeneration and use of waste solution, etc. without less problems in pollution, processing solution with a metal complex of an organic acid such as aminopolycarboxylic acid metal complex, etc. as the oxidizing agent is becoming to be used. However, since the processing solution by use of a metal complex of organic acid has slow oxidizing power, it has the drawback that the bleaching speed (oxidizing speed) of image silver (metallic silver) formed in the developing step is slow. For example, ethylenediaminetetraacetic acid iron (III) complex which is considered to have strong bleaching power among organic acid metal complexes is partially used for bleaching solution, and bleach-fixing for a color paper by use of a silver chlorobromide emulsion in combination with a thiosulfate which is the bleach-fixing agent, but it is deficient in bleaching power in high sensitivity light-sensitive material composed mainly of silver bromide, silver iodobromide emulsion, particularly color negative film and color reversal film for photographing containing 0.5 mole % or more of silver iodide as the silver halide, whereby image silver to the extent of trace will remain even when processed for a long time to make desilverization characteristic bad. This tendency particularly remarkably reveals in the bleach-fixing solution coexisting an oxidizing agent as well as in thiosulfate and sulfite since oxidation-reduction potential becomes low.

On the other hand, as a means for accelerating speed of desilverization step, there has bee known a bleach-fixing solution containing an aminopolycarboxylic acid ferric complex salt with thiosulfate in one solution as disclosed in West German Patent No. 866,605. However, when the aminopolycarboxylic ferric complex salt which is originally weak in oxidizing power (bleaching power) is to coexist with a thiosulfate having a reducing power, its bleaching power becomes remarkably weak whereby it is extremely difficult to sufficiently desilver a color photographic material for photographying having high sensitivity and high silver content and thus it cannot be practically used.

Whereas, the demand of rapid processing is not limited to bleach-fixing processing, but the same discussion is applicable to water washing or stabilizing processing up to drying after bleach-fixing. Particularly, in the case of performing stabilizing processing substituted for water washing after the bleach-fixing containing the above organic acid metal complex, it has been found that drying contamination occurs with accompaniment of rapid processing of said stabilizing processing substituted for water washing.

Concerning the technique about the above desilverization characteristic, there has been also proposed the method in which two or three or more bleach-fixing baths are employed. For example, Japanese Provisional Patent Publication No. 11131/1984 (which corresponds to West German Patent Publication No. OLS 22 17 570) discloses a method for processing with a continuous bleach-fixing bath comprising two or more baths, wherein the regenerated solution for bleach-fixing is supplemented according to the counter-current system. According to this method, although there is the advantage that the waste solution amount of the bleach-fixing solution can be made smaller, etc., the regenerated solution has higher photographic material as compared with ordinary supplemental solution, and therefore, particularly when a color light-sensitive material with high iodine content is processed, desilverization cannot be sufficiently effected, and particularly when combined with the rapid processing of stabilizing processing substituted for water washing, there is involved the problem that drying contamination will occur.

On the other hand, Japanese Provisional Patent Publication No. 105148/1983 discloses a method in which at least two bleach-fixing baths are provided, a fixing component is primarily supplemented to the bleach-fixing bath nearer to the color developing bath, and a bleaching component is primarily supplemented to the bleach-fixing bath nearer to the water washing bath, respectively, and processing is conducted according to the counter-current system to improve desilverization characteristic. However, even in this method, desilverization characteristic is not sufficient, and particularly when combined with the rapid processing of stabilizing processing substituted for water washing, there ensues the problem that drying contamination occurs.

In Japanese Provisional Patent Publication No. 75352/1986, there is disclosed a method in which a bleaching agent is supplemented to the bath nearer to the color developing bath and a fixing agent to the bath nearer to the water washing bath, and processing is performed according to the counter-current system to improve this desilverization characteristic. However, although this method is effective to some extent for the purpose of preventing color restration badness, it is insufficient in the point of desilverization characteristic, and particularly when combined with the rapid processing of stabilizing processing substituted for water washing, there is the problem that drying contamination occurs.

Further, in Japanese Provisional Patent Publication No.

91951/1987, it is described that desilverization can be effected within a short time by using two bleach-fixing baths, making the redox potential in the first bath higher than that in the second bath and also making the redox potential in the second bath in the range of +60 mV to −60 mV. However, in this method, although desilverization characteristic is sufficiently good when the bleach-fixing bath contains fresh solution, it can be found that accompanying running thereof or a processing amount, problems of color reproducibility of cyan, occurrence of magenta stain and desilverization are caused, particularly when combined with the rapid processing of stabilizing processing substituted for water washing, there is the problem that drying contamination occurs.

SUMMARY OF THE INVENTION

Accordingly, a first object of the present invention is to provide a desilverization processing method which can accomplish desilverization rapidly and sufficiently. A second object of the present invention is to provide a desilverization processing method which can prevent leuco of a cyan dye and cyan stain. A third object of the present invention is to provide a desilverization processing method which can prevent occurrence of magenta stain. A fourth object of the present invention is to provide a processing method which can prevent occurrence of drying contamination particularly when combined with stabilizing processing substituted for water washing within a short time.

The processing method of the present invention for accomplishing the above object is a method for processing a light-sensitive silver halide color photographic material by subjecting a light-sensitive silver halide color photographic material after color developing to bleach-fixing processing, characterized in that said light-sensitive silver halide color photographic material contains at least one cyan coupler represented by the following formula (A), (B) or (C), or contains at least one magenta coupler represented by the following formula (M-1), said bleach-fixing processing step is a step which is a counter-current system uses two or more tanks of continuous bleach-fixing tanks, and the silver concentration in the bleach-fixing solution in a final tank of said bleach-fixing tanks is maintained at 80% or lower of the silver concentration in a bleach-fixing solution in a first tank, (A)

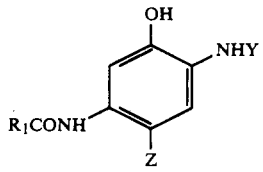

(B)

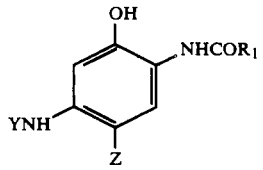

wherein $R_1$ represents an alkyl group, an alkenyl group, a cycloalkyl group, an aryl group or a heterocyclic group, Y represents a group represented by

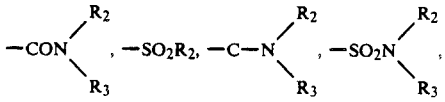

$-CONHCOR_2$ or $-CONHSO_2R_2$ where $R_2$ represents an alkyl group, an alkenyl group, a cycloalkyl group, an aryl group or a heterocyclic group, and $R_3$ represents a hydrogen atom or a group represented by $R_2$, and $R_2$ and $R_3$ may be the same or different and may form a hetero ring of 5 to 6-membered by combining with each other;

Z represents a hydrogen atom or a group eliminatable through the coupling reaction with an oxidized product of an aromatic primary amine series color developing agent.

(C)

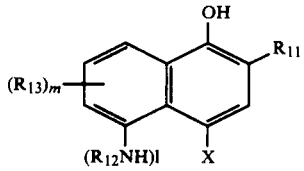

wherein $R_{11}$ represents $-CONR_{14}R_{15}$, $-NHCOR_{14}$, $-NHCOOR_{16}$, $-NHSO2R_{16}$, $-NHCONR_{14}R_{15}$ or $-NHSO2NR_{14}R_{15}$; $R_{12}$ represents a monovalent group; $R_{13}$ represents a substituent group; X represents a hydrogen atom or a group eliminatable through the reaction with an oxidized product of an aromatic primary amine color developing agent; l is 0 or 1; and m is 0 to 3; where $R_{14}$ and $R_{15}$ each represent a hydrogen atom, an aromatic group, an aliphatic group or a heterocylic group; $R_{16}$ represents an aromatic group, an aliphatic group or a heterocylic group; respectively, and when m is 2 or 3, each $R_{13}$ may be the same or different and may form a ring to combine with each other, and also $R_{14}$ and $R_{15}$, $R_{12}$ and $R_{13}$, and $R_{12}$ and X may form a ring to combine with each other, provided that l is 0, m is 0 and $R_{11}$ is $-CONHR_{17}$ where $R_{17}$ represents an aromatic group.

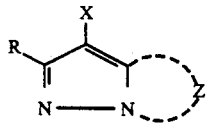

(M-1)

wherein Z represents a metal atom group necessary for forming a nitrogen-containing heterocyclic ring, and a ring formed by said Z may have a substituent or substituents; X represents a hydrogen atom or a group eliminatable through the reaction with an oxidized product of a color developing agent; and R represents a hydrogen atom or a substituent.

In another embodiment of the present invention, the processing method of the present invention for accomplishing the above object is a method for processing a light-sensitive silver halide color photographic material by subjecting a light-sensitive silver halide color photographic material after color developing to bleach-fixing processing and then to stabilizing processing substituted for water washing, characterized in that said light-sensitive silver halide color photographic material has at least one light-sensitive emulsion layer containing a silver halide emulsion containing 0.5 mole % or more of silver iodide, said bleach-fixing processing step is a step which is a counter-current system by use of an organic acid metal complex as the oxidizing agent and uses two or more tanks of continuous bleach-fixing tanks, and the silver concentration in a final tank of said bleach-fixing tanks is maintained at 80% or lower of the silver concentration in the bleach-fixing solution in a first tank.

DESCRIPTION OF THE PREFERRED EMBODIMENTS

The present invention is a method for processing a light-sensitive material having a silver halide emulsion layer containing a specific cyan coupler or a specific magenta coupler, or 0.5 mole % or more of silver iodide, having the specific features in that the bleach-fixing tank which may be used in combination with the stabilizing processing substituted for water washing within a short time is a continuous bleach-fixing tank of counter-current system having at least 2 tanks, and that the silver concentration of the bleach-fixing solution in the final tank is maintained at 80% or lower of the silver concentration in the bleach-fixing solution in the first tank. According to the investigation by the present inventors, the desilverization speed depends largely upon silver concentration in the bleach-fixing solution and the lower silver concentration is, the faster the desilverization speed becomes. For example, when processing the light-sensitive material of the present invention, if a ratio of a total amount of a supplemental solution to a volume of the bleach-fixing tank (hereinafter referred to as "R" (round)) is from 0 to 0.2R, its effect on desilverization speed is not so much since accumulation of silver is small. However, if the light-sensitive material is processed in the range exceeding 0.2R, a concentration of silver in the bleach-fixing solution is increased so as to affect the desilverization speed and further, since the color developing solution is introduced therein by the light-sensitive material whereby desilverization ability of the bleach-fixing solution becomes low. As one of means for solving the problems, to increase the supplemental amount in order to lessen the silver concentration involves many problems on pollution and further on cost, whereby the present invention can be accomplished.

The method in which the bleach-fixing bath is to make counter-current system having 2 or more baths and a supplementing solution is introduced in the final bath as in the present invention is a preferred processing method from the viewpoint of accelerating desilverization and heightening rapidity, and also from the viewpoint of low pollution. However, during processing, some color developing solution is carried over (contaminates) into the bleach-fixing bath (first bath) nearer to the color developing solution whereby a problem that stain, particularly magenta stain will likely be caused occurred. This problem is particularly easily caused in a counter-current system in which baths are made two or more and an overflow solution at a latter stage bath is flowed to a former stage bath as compared with a single bath bleach-fixing bath conventionally carried out. An effect of the present invention becomes remarkable mainly when a mixing ratio (contamination ratio) of the color developing solution is 5% or more, particularly 7% or more.

Also, according to the investigations by the present inventors, by making not only processing with bleach-fixing solution but also stabilizing substituted for water washing rapid, drying contamination will occur, and particularly when the light-sensitive material is processed, this will conspicuously appear by accumulation of the bleach-fixing components contaminated from the bleach-fixing tank (bath) to the tank (bath) for stabilizing processing substituted for water washing.

However, when the bleach-fixing processing step is a step which is a counter-current system by use of an organic metal complex as the oxidizing agent and uses a continuous bleach-fixing tank of at least 2 tanks, by maintaining the silver concentration in the bleach-fixing solution in the final tank of said bleach-fixing tank at 80% or less of the silver concentration in the bleach-fixing solution in the first tank, this can be found to be prevented, thereby accomplishing the processing method of the present invention.

In the following, the present invention will be described in more detail.

The number of the baths (tanks) of the bleach-fixing baths (tanks) of the present invention may be as many as possible to give greater effect in lowering the silver concentration and the amount replenished, but may be practically 2 to 4 tanks, most preferably 2 tanks of the tank constitution.

The silver concentration in the bleach-fixing solution is determined depending on the silver quantity in the light-sensitive material to be processed and the amount replenished of the bleach-fixing solution, but the drying contamination inhibiting effect of the present invention becomes more marked by controlling the silver concentration in the bleach-fixing solution in the final tank at 80% or lower of the silver concentration in the bleach-fixing solution in said first tank, preferably 60% or less, more preferably 40% or less, most preferably 25% or less. The silver concentration in the final tank should be preferably 0.07 mole or less, more preferably 0.03 mole or less per one liter of the bleach-fixing solution.

For further enhancing the effect of the present invention, a remarkable improvement effect can be obtained by controlling the iodide concentration in the bleach-fixing solution. Specifically, the absolute concentration of the iodide in the first tank is preferably 0.002 to 0.03 mole/liter, more preferably 0.003 to 0.02 mole/liter.

The iodide concentration can be controlled depending on the light-sensitive material to be processed according to the amount replenished of the bleach-fixing replenishing solution and the amount of inflow of the counter-current overflow.

As the counter-current system of the bleach-fixing solution in the present invention, it is preferable to employ the system in which the replenishing bleach-fixing solution is replenished from the final tank and replenished successively to the preceding tank in the counter-current system in the method wherein processing is conducted in a continuous bleach-fixing tank comprising 2 or more baths.

As the organic acid metal complex to be used as the bleaching agent in the bleach-fixing bath of the present invention, there may be included, for example, organic complexes such as iron (III), cobalt (III), chromium (IV), copper (II), etc. (e.g., aminopolycarboxylic acids such as ethylenediaminetetraacetic acid, diethylenetriaminepentaacetic acid, etc., aminopolyphosphonic acid, phosphonocarboxylic acid and organic phosphonic acid, etc.).

The bleaching agent to be used in the bleach-fixing processing according to the present invention may be preferably an organic acid ferric complex, and as the organic acid forming the organic acid ferric complex is preferred aminocarboxylic acid type compound and aminophosphonic acid type compound, representing respectively amino compound having at least one carboxylic acid and amino compound having at least one phosphonic acid, more preferably the compound represented by the following formulae (1) and (2):

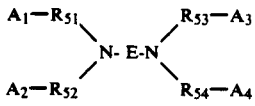

(1)

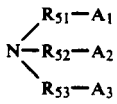

(2)

wherein E represents a substituted or unsubstituted alkylene group, a cylcoalkylene group, a phenylene group, $—R_{55}OR_{55}OR_{55}—$ or $R_{55}ZR_{55}—$; Z represents

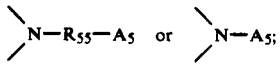

where $R_{51}$ to $R_{55}$ each represent a substituted or unsubstituted alkylene group, $A_1$ to $A_5$ each represent a hydrogen atom, —OH, —COOM, $—PO_3M_2$, and M represents a hydrogen atom or an alkali metal atom.

In the following, preferred specific exemplary compounds represented by these formulae (1) and (2) are shown.

(Exemplary compounds)

(1 - 1) Ethylenediaminetetraacetic acid
(1 - 2) Diethylenetriaminepentaacetic acid
(1 - 3) Ethylenediamine-N-(β-hydroxyethyl)-N,N',N'-triacetic acid
(1 - 4) Propylenediaminetetraacetic acid
(1 - 5) Triethylenetetraminehexaacetic acid
(1 - 5) Cyclohexanediaminetetraaacedic acid
(1 - 6) Diaminopropanetetraacetic acid
(1 - 7) 1,2-Diaminopropanetetraacetic acid
(1 - 8) 1,3-Diaminopropan-2-ol-2-tetraacetic acid
(1 - 9) Ethyletherdiaminetetraacetic acid
(1 - 10) Glycoletherdiaminetetraacetic acid
(1 - 11) Ethylenediaminetetrapropionic acid
(1 - 12) Phenylenediaminetetraacetic acid
(1 - 13) Disodium ethylenediaminetetraacetate
(1 - 14) Tetra(trimethylammonium) ethylenediaminetetraacetate
(1 - 15) Tetrasodium ethylenediaminetetraacetate
(1 - 16) Pentasodium diethylenetriaminepentaacetate
(1 - 17) Sodium ethylenediamine-N-(β-hydroxyethyl)-N,N',N'-triacetate
(1 - 18) Sodium propylenediaminetetraacetate
(1 - 19) Ethylenediaminetetramethylenephosphonic acid
(1 - 20) Sodium cyclohexanediaminetetraacetate
(1 - 21) Diethylenetriaminepentamethylenephosphonic acid
(1 - 22) Cyclohexanediaminetetramethylenephosphonic acid
(2 - 1) Nitrilotriacetic acid
(2 - 2) Iminodiacetic acid
(2 - 3) Hydroxyethyliminodiacetic acid
(2 - 4) Nitrilotripropionic acid
(2 - 5) Nitrilotrimethylenephosphonic acid
(2 - 6) Iminodimethylenephosphonic acid
(2 - 7) Hydroxyethyliminodimethylenephosphonic acid
(2 - 8) Trisodium nitrilotriacetate Of these aminocarboxylic acid type compounds and aminophosphonic acid type compounds, the compounds particularly preferably used from the point of the effect of the object of the present invention may include (1 - 1), (1 - 2), (1 - 4), (1 - 5), (1 - 7), (1 - 8), (1 - 10), (1 - 19), (2 - 1), (2 - 3) and (2 - 5).

Above all, among these aminocarboxylic acid type compounds and aminophosphonic acid type compounds, those with molecular weight of 300 or higher may be particularly preferably used for good fixing performance, and for example, (1 - 2), (1 - 4), (1 - 7) and (1 - 10) may be employed as particularly preferred compound.

The ferric complex of the organic acid according to the present invention may be used as free acid (hydroxy acid), alkali metal salts such as sodium salts, potassium salts, lithium salts, etc. or ammonium salts or water-soluble amine salts such as triethanolamine salts, etc., but preferably as potassium salt, sodium salt and ammonium salt. These ferric complexes may be used as at least one kind, but it is also possible to use two or more kinds in combination.

The iron (III) complex salt may be used as one more kind of already formed complex salt, or alternatively a ferric ion complex may be formed by reacting an iron (III) salt (e.g., ferric sulfate, ferric chloride, ferric nitrate, ferric ammonium sulfate, ferric phosphate, etc.) with a chelating agent (aminopolycarboxylic acid, aminopolyphosphonic acid, phosphonocarboxylic acid, etc.) in a solution. When the complex is formed in a solution, either one or both of the ferric salts and the chelating agent may also use two or more kinds in combination. In either case of the already formed complex, or formation of complex, the chelating agent may be used in an amount of stoichiometric amount or more. Metal ions of cobalt, copper, etc. other than iron and complexes of these or hydrogen peroxide may be also included.

The persulfate which can be used in the present invention is an alkali metal persulfate such as potassium persulfate, sodium persulfate or ammonium persulfate.

The amount of the bleaching agent per one liter of the processing bath having bleach-fixing ability may be generally 0.1 to 2 moles, preferably 0.25 to 1.0 mole, particularly preferably 0.30 to 1.0 mole.

As described above, ferric ion complexes of aminopolycarboxylic acids, aminopolyphosphonic acids, phosphonocarboxylic acids, organic phosphonic acids may be preferably used, and further other than the ferric ion complexes of the above chelating agents, free chelating agents may be used for stabilization of the ferric ion complexes. However, according to the investigation by the present inventors, it has been found that color restration characteristic is liable to be deteriorated if contained in an amount of 7.5 mole % or more relative to ferric ion complexes. Accordingly, the free chelating agents should be 7.5 mole % or less, particularly 5 mole % or less relative to the ferric ion complexes for other purpose of the present invention, namely from the standpoint of color restration characteristic.

The preferable pH range of the bleach-fixing bath of the present invention is 0.5 to 9.0 in the case of ferric ion complexes, particularly 4.0 to 8.5 in the case of ferric ion complexes of aminopolycarboxylic acids, aminopolyphosphonic acid, phosphonocarboxylic acids, organic phosphonic acids. Among them, in the case of ferric complex of ethylenediaminetetraacetic acid, pH of 4.5 to 6.5 is preferably, while in the case of ferric complex of diethylenetriaminepentaacetic acid, pH of 6.0 to 8.0 is preferred.

In the case of persulfate, a concentration of 0.1 to 2 moles/liter, a pH in the range of 1 to 8.5 is preferred.

Also, in the bleach-fixing solution according to the present invention, when at least one compound represented by the following formulae (I) to (IX) is contained, the effect of the object of the present invention can be better exhibited, and further other effect of improving precipitation based on silver in the bleach-fixing solution so that they are more preferably used in the present invention.

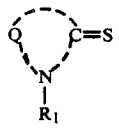

(I)

wherein Q represents a group of atoms necessary for formation of a nitrogen-containing hetero ring (including fused unsaturated rings of 5 to 6 members), $R_1$ represents a hydrogen atom, an alkyl group having 1 to 6 carbon atoms, a cycloalkyl group, an aryl group, a heterocyclic group (including fused unsaturated rings of 5 to 6 members) or an amino group.

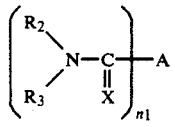

(II)

wherein $R_2$ and $R_3$ each represent a hydrogen atom, an alkyl group having 1 to 6 carbon atoms, a hydroxy group, a carboxy group, an amino group, an acyl group having 1 to 3 carbon atoms, an aryl group or an alkenyl group; A represents

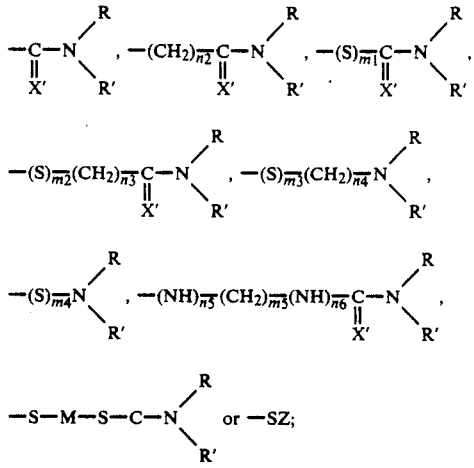

or a hetero ring residue of $n_1$ valence (including also fused unsaturated rings of 5 to 6 members), X represents =S, =O or =NR''; here, R and R' are the same as $R_2$ and $R_3$, respectively; X' is the same as X; Z represents a hydrogen atom, an alkali metal atom, an ammonium group, an amino group, a nitrogen-containing heterocyclic residue, an alkyl group or

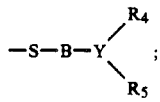

M represents a divalent metal atom; R'' represents a hydrogen atom, an alkyl group having 1 to 6 carbon atom, a cycloalkyl group, an aryl group, a heterocyclic residue (including also fused unsaturated rings of 5 to 6 members) or an amino group; $n_1$ to $n_6$ and $m_1$ to $m_5$ each represent an integer of 1 to 6; B represents an alkylene group having 1 to 6 carbon atoms; Y represents —N< or —CH<; and $R_4$ and $R_5$ are the same as $R_2$ and $R_3$, respectively; provided that $R_4$ and $R_5$ may each represent —B—SZ, and also $R_2$ and $R_3$, R and R', and $R_4$ and $R_5$ may be bonded together to form a ring.

The compounds represented by said formula are also inclusive of ethanolated derivatives and salts thereof.

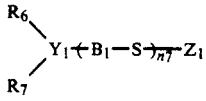

(III)

wherein $R_6$ and $R_7$ each represent a hydrogen atom, an alkyl group having 1 to 6 carbon atoms, a hydroxy group, a carboxy group, an amino group, an acyl group having 1 to 3 carbon atoms, an aryl group, an alkenyl group or $—B_1—S—Z_1$; provided that $R_6$ and $R_7$ may be bonded together to form a ring; $Y_1$ represents >N— or >CH—; $B_1$ represents an alkylene group having 1 to 6 carbon atoms; $Z_1$ represents a hydrogen atom, an alkali metal atom, an ammonium group, an amino group, a nitrogen-containing heterocyclic residue or

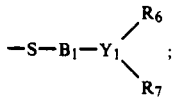

and $n_7$ represents an integer of 1 to 6.

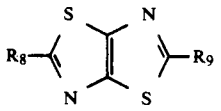

(IV)

wherein $R_8$ and $R_9$ each represent

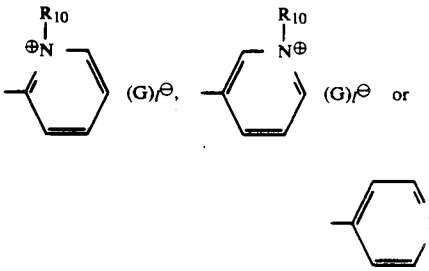

$R_{10}$ represents an alkyl group or $-(CH_2)_{n\ 8}SO_3\ominus$ (provided that when $R_{10}$ is $-(CH_2)_{n\ 8}SO_3\ominus$, 1 represents 0, and when an alkyl group, it represents (1); $G\ominus$ represents an anion; $n_8$ represents an integer of 1 to 6.

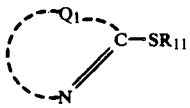

(V)

wherein $Q_1$ represents a group of atoms necessary for formation of a nitrogen-containing hetero ring (including also fused unsaturated rings or saturated rings of 5 to 6 members); $R_{11}$ represents a hydrogen atom,

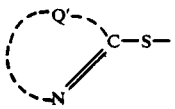

or an alkyl group; provided that Q' is the same as $Q_1$.

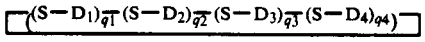

(VI)

wherein $D_1$, $D_2$, $D_3$ and $D_4$ each represent a mere bonding arm, an alkylene group having 1 to 8 carbon atoms or a vinylene group; $q_1$, $q_2$, $q_3$ and $q_4$ each represent 0, 1 or 2; the ring formed together with sulfur atom may be further fused with a saturated or unsaturated ring of 5 to 6 members.

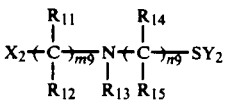

(VII)

wherein $X_2$ represents —COOM', —OH, $-SO_3M'$, $-CONH_2$, $-SO_2NH_2$, $-NH_2$, —SH, —CN, $-CO_2R_{16}$, $-SO_2R_{16}$, $-OR_{16}$, $-NH_{16}R_{17}$, $-SR_{16}$, $-SO_3R_{16}$, $-NHCOR_{16}$, $-NHSO_2R_{16}$, $-OCOR_{16}$ or $-SO_2R_{16}$; $Y_2$ represents

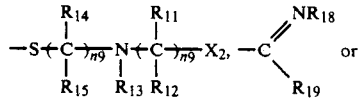

or a hydrogen atom; $m_9$ and $n_9$ each represent an intefer of 1 to 10; $R_{11}$, $R_{12}$, $R_{14}$, $R_{15}$, $R_{17}$ and $R_{18}$ each represent a hydrogen atom, a lower alkyl group, an acyl group or

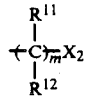

where $R^{11}$ and $R^{12}$ each have the same meanings as the above $R_{11}$ and $R_{12}$, respectively; $R_{16}$ represents a lower alkyl group; $R_{19}$ represents $-NR_{20}R_{21}$, $-OR_{22}$ or $-SR_{22}$; $R_{20}$ and $R_{21}$ each represent a hydrogen atom or a lower alkyl group; $R_{22}$ represents a group of atoms necessary for formation of a ring by bonding to $R_{18}$; $R_{20}$ or $R_{21}$ may also form a ring by bonding to $R_{18}$; M' represents a hydrogen atom or a cation.

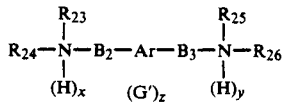

(VIII)

wherein Ar represents a divalent aryl group or divalent organic group comprising a combination of an aryl group with oxygen atom and/or an alkylene group; $B_2$ and $B_3$ each represent a lower alkylene group; $R_{23}$, $R_{24}$, $R_{25}$ and $R_{26}$ each represent a hydroxy-substituted lower alkylene group; x and y each represent 0 or 1; G' represents an anion; and z represents 0, 1 or 2.

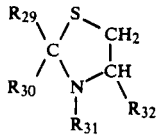

(IX)

wherein $R_{29}$ and $R_{30}$ each represent a hydrogen atom, an alkyl group, an aryl group or a heterocyclic group; $R_{31}$ represents a hydrogen atom or an alkyl group; and $R_{32}$ represents a hydrogen atom or a carboxy group.

The compounds represented by the formulae (I) to (IX) preferably used in the present invention are compounds generally used as the bleaching accelerators, and hereinafter called bleaching accelerators of the present invention.

Representative specific examples of the bleaching accelerators of the present invention represented by the above formulae (I) to (IX) may include those shown below, which are not limitative of the present invention.

Exemplary compounds
(I-1)
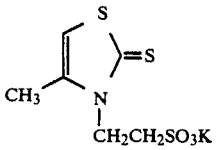
(I-2)
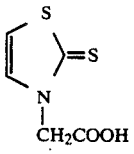
(I-3)
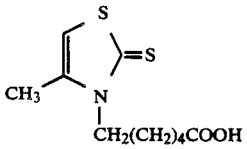
(I-4)
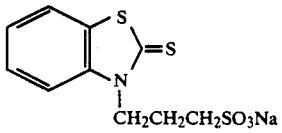
(I-5)
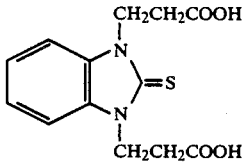
(I-6)
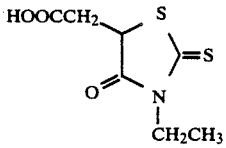
(I-7)
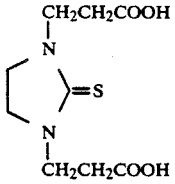
(I-8)
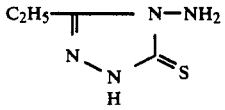
(I-9)
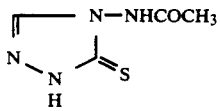
(I-10)
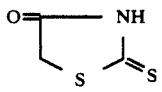
(II-1)
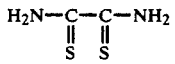

-continued
Exemplary compounds
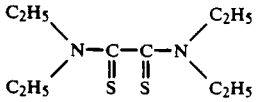
(II-2)
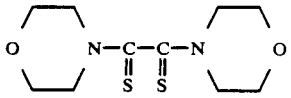
(II-3)
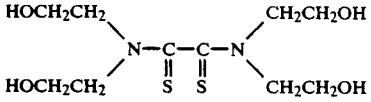
(II-4)
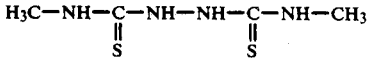
(II-5)
$H_2N—CSNHNHCS—NH_2$ (II-6)
$H_2N—CSNH(CH_2)_2NHCS—NH_2$ (II-7)
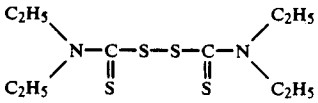
(II-8)
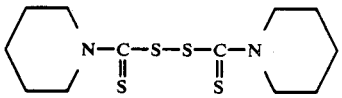
(II-9)
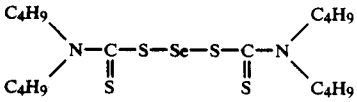
(II-10)
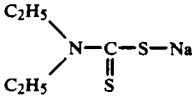
(II-11)
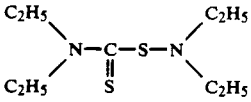
(II-12)
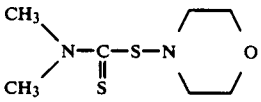
(II-13)
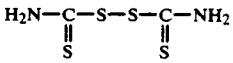
(II-14)
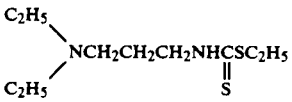
(II-15)
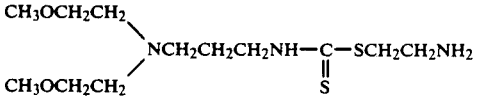
(II-16)
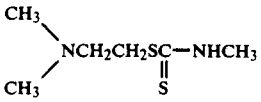
(II-17)

-continued
Exemplary compounds
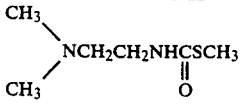
(II-18)
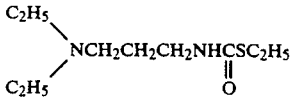
(II-19)
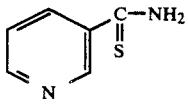
(II-20)
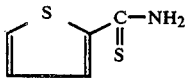
(II-21)
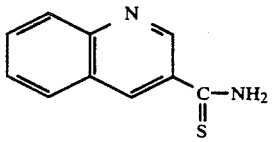
(II-22)
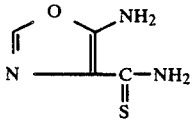
(II-23)
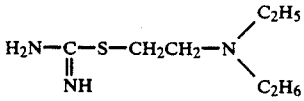
(II-24)
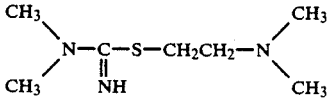
(II-25)
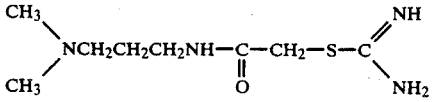
(II-26)
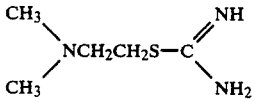
(II-27)
$H_2N—CH_2CH_2—SH$ (III-1)
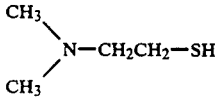
(III-2)
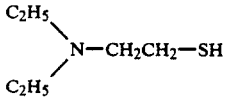
(III-3)
$HOOC—CH_2CH_2—SH$ (III-4)
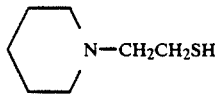
(III-5)

-continued
Exemplary compounds
(III-6)
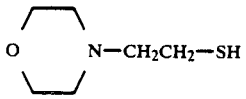
(III-7)
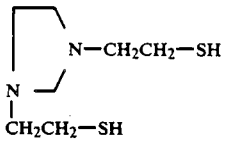
(III-8)
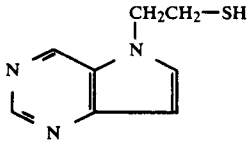
(III-9)
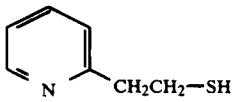
(III-10)
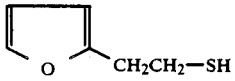
(III-11)
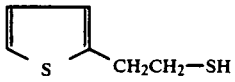
(III-12)
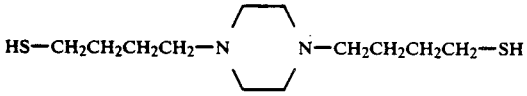
(III-13)
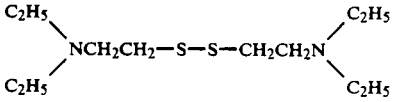
(III-14)
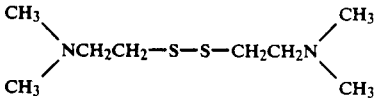
(III-15)
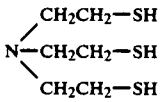
(IV-1)
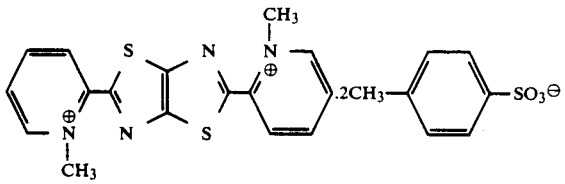
(IV-2)
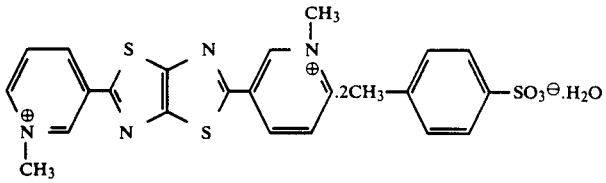

-continued
Exemplary compounds
(IV-3)
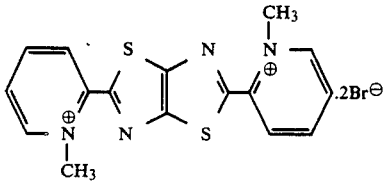
(V-1)
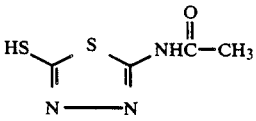
(V-2)
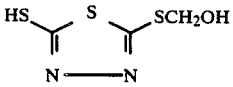
(V-3)
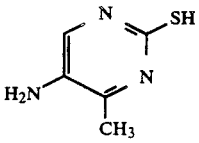
(V-4)
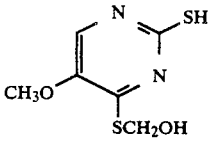
(V-5)
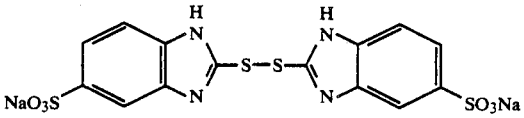
(V-6)
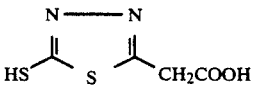
(V-7)
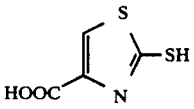
(V-8)
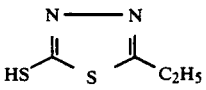
(V-9)
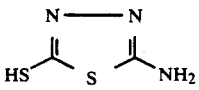
(V-10)
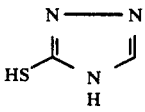
(V-11)
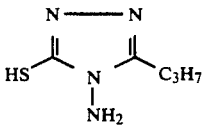

-continued
Exemplary compounds
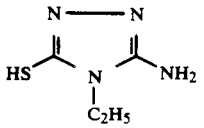
(V-12)
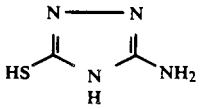
(V-13)
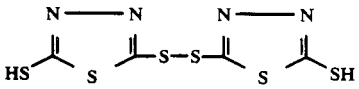
(V-14)
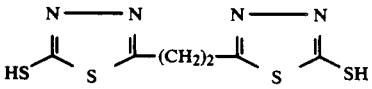
(V-15)
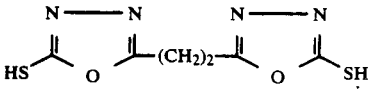
(V-16)
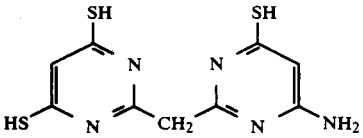
(V-17)
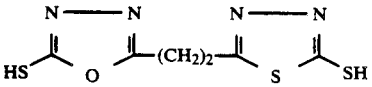
(V-18)
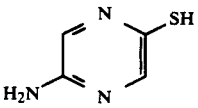
(V-19)
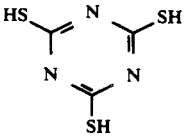
(V-20)
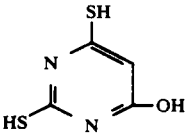
(V-21)
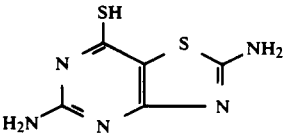
(V-22)
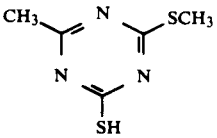
(V-23)

-continued
Exemplary compounds
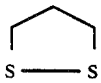
(VI-1)
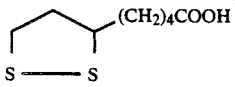
(VI-2)
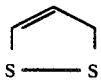
(VI-3)
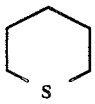
(VI-4)
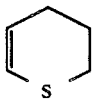
(VI-5)
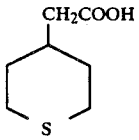
(VI-6)
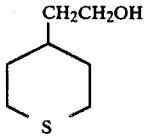
(VI-7)
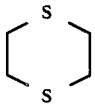
(VI-8)
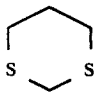
(VI-9)
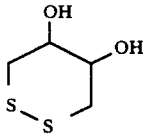
(VI-10)
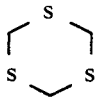
(VI-11)
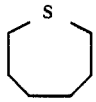
(VI-12)
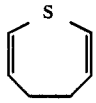
(VI-13)

-continued

Exemplary compounds (VI-14)

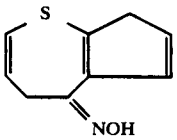

(VI-15)

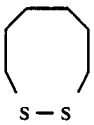

(VI-16)

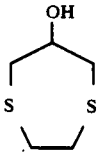

(VI-17)

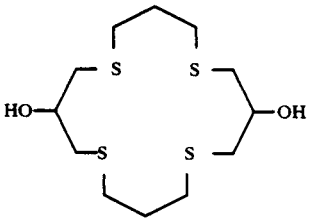

(VII-1)

$$\leftarrow SCH_2CH_2N\left(\begin{matrix}CH_2CH_2SO_2CH_3\\ \\ CH_2CH_2SO_2CH_3\end{matrix}\right)_2$$

(VII-2)

$$\leftarrow SCH_2CH_2N\left(\begin{matrix}CH_2CH_2CO_2CH_3\\ \\ CH_2CH_2CO_2CH_3\end{matrix}\right)_2$$

(VII-3)

$$\leftarrow SCH_2CH_2N\left(\begin{matrix}CH_2CH_2CN\\ \\ CH_2CH_2CN\end{matrix}\right)_2$$

(VII-4)

$$\leftarrow SCH_2CH_2N\left(\begin{matrix}CH_2CH_2CONH_2\\ \\ CH_2CH_2CONH_2\end{matrix}\right)_2 2HCl$$

(VII-5)

$$\leftarrow SCH_2CH_2N\left(\begin{matrix}CH_2CH_2SO_3Na\\ \\ CH_2CH_2SO_3Na\end{matrix}\right)_2$$

(VII-6)

$$\leftarrow SCH_2CH_2N\left(\begin{matrix}CH_2COOH\\ \\ CH_2COOH\end{matrix}\right)_2$$

(VII-7)

$$\begin{matrix}HN\\ \diagup\!\!\!\!\diagdown\\ H_2N\end{matrix}C-SCH_2CH_2\underset{\underset{CH_3}{|}}{N}CH_2CH_2SO_2CH_3.2HCl$$

(VII-8)

$$\begin{matrix}HN\\ \diagup\!\!\!\!\diagdown\\ H_2N\end{matrix}C-SCH_2CH_2\underset{\underset{CH_3}{|}}{N}CH_2CH_2CO_2CH_3.2HCl$$

-continued
Exemplary compounds
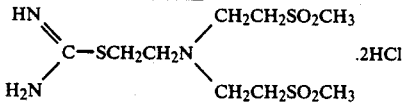
(VII-9)
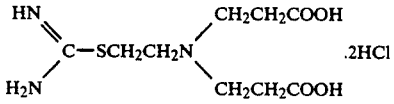
(VII-10)
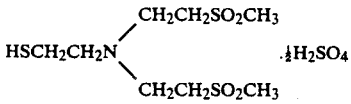
(VII-11)
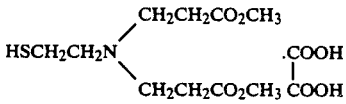
(VII-12)
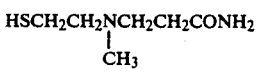
(VII-13)
$HSCH_2CH_2NHCH_2CH_2OH$ (VII-14)
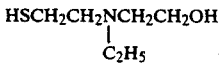
(VII-15)
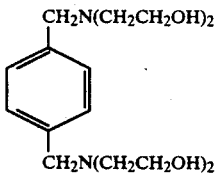
(VIII-1)
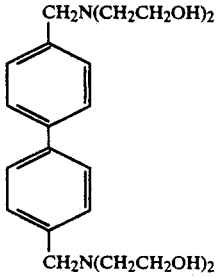
(VIII-2)
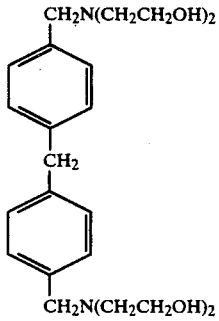
(VIII-3)
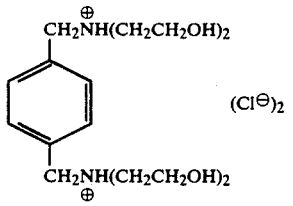
(VIII-4)

-continued

Exemplary compounds

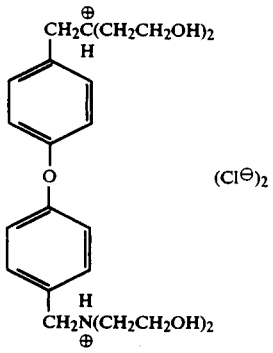

(VIII-5)

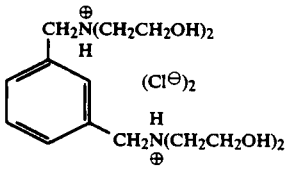

(VIII-6)

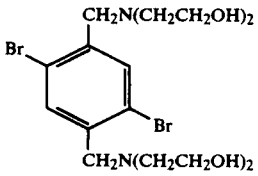

(VIII-7)

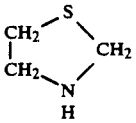

(IX-1)

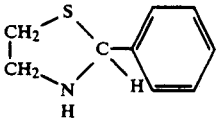

(IX-2)

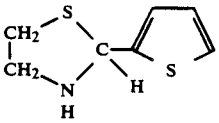

(IX-3)

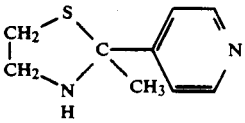

(IX-4)

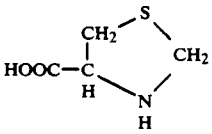

(IX-5)

Other than the bleaching accelerators of the present invention as exemplified above, the exemplary compounds described on page 51 to page 155 in Japanese Provisional Patent Publication No. 123459/1987, Nos. I-2, I-4 to 7, I-9 to 13, I-16 to 21, I-23, I-24, I-26, I-27, I-30 to 36, I-38, II-2 to 5, II-7 to 10, II-12 to 20, II-22 to 25, II-27, II-29 to 33, II-35, II-36, II-38 to 41, II-43, II-45 to 55, II-57 to 60, II-62 to 64, II-67 to 71, II-73 to 79, II-81 to 84, II-86 to 99, II-101, II-102, II-104 to 110, II-112 to 119, II-121 to 124, II-126, II-128 to 144, II-146, II-148 to 155, II-157, III-4, III-6 to 8, III-10, III-11, III-13, III-15 to 18, III-20, III-22, III-23, III-25, III-27, III-29 to 32, III-35, III-36, IV-3, IV-4, V-3 to 6, V-8 to 14, V-16 to 38, V-40 to 42, V-44 to 46, V-48 to 66, V-68 to 70, V-72 to 74, V-76 to 79, V-81, V-82, V-84 to V-100, V-102 to 108, V-110, V-112, V-113, V-116 to 119, V-121 to 123, V-125 to 130, V-132 to 144, V-146 to 162, V-164 to 174, V-176 to 184, VI-4, VI-7, VI-10, VI-12, VI-13, VI-16, VI-19, VI-21, VI-22, VI-25, VI-27 to 34, VI-36, VII-3, VII-6, VII-13, VII-19, VII-20, etc. can be also similarly used.

These bleaching accelerators may be used either singly or as the combination of two or more kinds, and the amount added may be generally about 0.01 to 100 g per one liter of the bleach-fixing solution to give favorable results. However, generally the bleaching acceleration effect is small when the amount added is too small, and precipitation may occur is the amount added is too large than is necessary to stain the light-sensitive material to be processed, and therefore a preferred amount is 0.05 to 50 g per one liter of the bleach-fixing solution, more preferably 0.05 to 15 g per one liter of the bleach fixing solution.

When a bleaching accelerator is to be added, it may be also added as such and dissolved, but generally dissolved previously in water, alkali organic acid, etc. before addition, and if necessary, it may be also dissolved in an organic solvent such as methanol, ethanol, acetone, etc. before addition.

As the bleach-fixing solution according to the present invention, it is preferably to apply a solution with a composition containing the organic acid iron (III) complex as described above as the bleaching agent and also a silver halide fixing agent, and optionally persulfate. Also, a bleach fixing solution comprising a composition having a small amount of a halide compound such as potassium bromide added in a small amount in addition to the organic acid iron (III) complex bleaching agent and the silver halide fixing agent as described above, or a bleach-fixing solution comprising a composition having a halide compound such as potassium bromide added on the contrary in a large amount, and further a special bleach-fixing agent comprising a combination of the organic acid iron (III) comples bleaching agent with a large amount of a halide compound such as potassium bromide, etc. can be also used. As the above halide compound, other than potassium bromide, hydrochloric acid, hydrobromic acid, lithium bromide, sodium bromide, ammonium bromide, sodium iodide, potassium iodide, ammonium iodide, etc. can be also used.

Representative examples of the above silver halide fixing agent to be contained in the bleach-fixing solution may include compounds capable of forming water-soluble complexes through the reaction with silver halide as used in conventional fixing treatment, for example, thiosulfates such as potassium thiosulfate, sodium thiosulfate and ammonium thiosulfate, thiocyanates such as potassium thiocyanate, sodium thiocyanate, ammonium thiocyanate, or thioura, thioethers, etc. These fixing agents can be used in amounts of 5 g/liter or more within the range which can be dissolved.

In the bleach-fixing solution, pH buffering agents comprising various salts such as boric acid, borax, sodium hydroxide, potassium hydroxide, sodium carbonate, potassium carbonate, sodium bicarbonate, potassium bicarbonate, acetic acid, sodium acetate, ammonium hydroxide, etc. can be contained either singly or as a combination of two or more kinds. Further, various fluorescent brighteners or defoaming agents or surfactants can be contained. Also, preservatives such as hydroxylamine, hydrazine, bisulfate adducts of aldehyde compounds, etc., organic chelating agents such as aminopolycarboxylic acids, etc. or stabilizers such as nitroalcohol, nitrates, etc., organic solvents such as methanol, dimethylsulfonamide, dimethylsulfoxide, etc. can be also suitably contained.

In the processing method of the present invention, it is preferable to perform a bleach-fixing subsequent to color developing, but after bleach-fixing the stabilizing processing substituting for processing of the present invention may be performed, followed by conventional stabilizing processing.

Further, prior to color developing of the present invention, the respective steps of black and white developing, fogging, stopping, water washing, etc., namely the processing steps conventionally used may be also used as desired.

In the present invention, the processing time for bleach-fixing should be within 6 minutes and 30 seconds, preferably within 5 minutes from the standpoint of rapidness. In that case, the processing time in the first bath is preferably 2 seconds to 4 minutes so that the silver halide may be sufficiently dissolved in the first bath, but the processing time in the first bath is preferably 50% or longer for exhibiting the effect of the present invention.

Next, the cyan coupler to be used in the red-sensitive silver halide emulsion layer of the light-sensitive material according to the present invention will be explained.

The cyan coupler of the present invention can be represented by the above formula (A), (B) or (C).

First, the above formulae (A) and (B) will be explained, In said formulae, Y is a group represented by

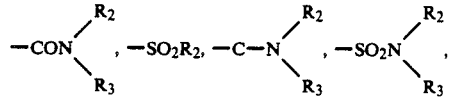

$-CONHCOR_2$ or $-CONHSO_2R_2$. Here, $R_2$ and $R_3$ each represent an alkyl group, preferably an alkyl group having 1 to 20 carbon atoms (for example, each groups of methyl, ethyl, t-butyl, dodecyl, etc.), an alkenyl group, preferably an alkenyl group having 2 to 20 carbon atoms (for example, an allyl group, a heptadecenyl group, etc.), a cycloalkyl group, preferably those having 5 to 7-membered ring (for example, cyclohexyl, etc.), an aryl group (for example, a phenyl group, a tolyl group, a naphthyl group, etc.), a heterocyclic group, preferably 5-membered or 6-membered heterocyclic group containing 1 to 4 nitrogen atom, oxygen atom or sulfur atom (for example, a furyl group, a thienyl group, a benzothiazolyl group, etc.). $R_3$ represents a hydrogen atom or a group represented by $R_2$. $R_2$ and $R_3$ may be bonded with each other to form a 5- or 6-membered heterocyclic ring. In $R_1$ and $R_2$, optional substituents can be introduced therein, and there may be mentioned, for example, an alkyl group having 1 to 10 carbon atoms (for example, methyl, i-propyl, i-butyl, t-butyl, t-octyl, etc.), an aryl group (for example, phenyl, naphthyl, etc.), a halogen atom (fluorine, chlorine, bromine, etc.), a cyano group, a nitro group, a sulfonamido group (for example, methanesulfonamido, butansulfonamido, p-toluenesulfonamido, etc.), a sulfamoyl group (for example, methylsulfamoyl, phenylsulfamoyl, etc.), a sulfonyl group (for example, methanesulfonyl, p-toluenesulfonyl, etc.), a fluorosulfonyl group, a carbamoyl group (e.g., dimethylcarbamoyl, phenylcarbamoyl, etc.), and oxycarbonyl group (e.g., ethoxycarbonyl, phenoxycarbonyl, etc.), an acyl group (e.g., acetyl, benzoyl, etc.), a heterocyclic group (e.g., a pyridyl group, a pyrazolyl group, etc.), an alkoxy group, an aryloxy group, an acyloxy group and the like.

In the formulae (A) and (B), $R_1$ represents a ballast group necessary for providing a diffusion resistance to the cyan coupler represented by the formulae (A) and (B) and a cyan dye derived from said cyan coupler. Preferably, $R_1$ may be an alkyl group having 4 to 30 carbon atoms, an aryl group or a heterocyclic group. For example, $R_1$ may include a straight or branched alkyl group (e.g. t-butyl, n-octyl, t-octyl, n-dodecyl, etc.), an alkenyl group, a cycloalkyl group, a 5-membered or 6-membered heterocyclic group and the like.

In the formulae (A) and (B), Z represents a hydrogen atom or a group eliminatable through the coupling reaction with a color developing agent. For example, Z may include a halogen atom (e.g. chlorine, bromine, fluorine, etc.), a substituted or unsubstituted alkoxy group, an aryloxy group, a heterocyclyloxy group, an acyloxy group, a carbamoyloxy group, a sulfonyloxy group, an alkylthio group, an arylthio group, a heterocyclicthio group or a sulfonamido group, and more specifically, those as disclosed in U.S. Pat. No. 3,741,563, Japanese Provisional Patent Publication No. 37425/1972, Japanese Patent Publication No. 36894/1973, Japanese Provisional Patent publication Nos. 10135/1975, 108841/1976, 120343/1975, 18315/1977, 105226/1978, 14736,1979, 48237/1979, 32071/1980, 65957/1980, 1938/1981, 12643/1981, 27147/1981, 146050/1984, 166956/1984, 24547/1985, 35731/1985 and 37557/1985.

In the present invention, the cyan couplers represented by the following formula (D) is more preferred.

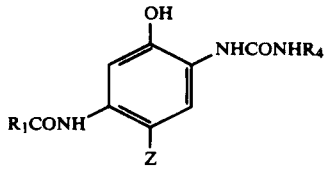

(D)

In the formula (D), $R_4$ is a substituted or unsubstituted aryl group (particularly preferred is a phenyl group). As the substituent for said aryl group represented by $R_4$, they may be mentioned at least one substituent selected from $-SO_2R_5$ a halogen atom (e.g., fluorine, bromine, chlorine, etc.), $-CF_3$, $-NO_2$, $-CN$, $-COR_5$, $-COOR_5$, $-SO_2OR_5$,

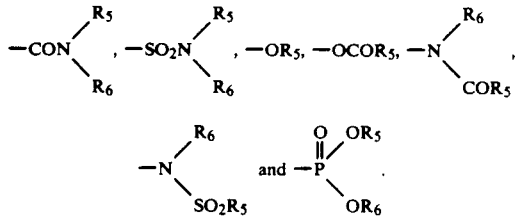

In the above, $R_5$ represents an alkyl group, preferably an alkyl group having 1 to 20 carbon atoms (e.g., each groups of methyl, ethyl, tert-butyl, dodecyl, etc.), an alkenyl group, preferably an alkenyl group having 2 to 20 carbon atoms (e.g., an aryl group, a heptadecenyl group, etc.), a cycloalkyl group, preferably 5 to 7-membered ring group (e.g., a cyclohexyl group, etc.), an aryl group (e.g., a phenyl group, a tolyl group, a naphthyl group, etc.); and $R_6$ is a hydrogen atom or a group represented by the above $R_5$.

The preferred compounds of the phenol type cyan coupler represented by (D) includes a compound in which $R_4$ is a substituted or unsubstituted phenyl group, and the substituent for the phenyl group includes a cyano group, a nitro group, $-SO_2R_7$ (in which $R_7$ is an alkyl group), a halogen atom or a trifluoromethyl group.

In the above formula (D), Z and $R_1$ each have the same meanings as in the formulae (A) and (B). Preferred examples of the ballast group represented by $R_1$ is a group represented by the following formula (E):

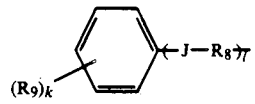

(E)

In the formula, J represents an oxygen atom, a sulfur atom or a sulfonyl group; k represents an integer of 0 to 4; represents 0 or 1; provided that k is 2 or more, 2 or more of $R_9$ may be the same or different from each other; $R_8$ represents a straight or branched alkylene group having 1 to 20 carbon atoms which may be substituted by an aryl group, etc.; $R_9$ represents a monovalent group, preferably a hydrogen atom, a halogen atom (e.g., chlorine, bromine, etc.), an alkyl group, preferably a straight or branched alkyl group having 1 to 20 carbon atoms (e.g., each groups of methyl, t-butyl, t-pentyl, t-octyl, dodecyl, pentadecyl, benzyl, phenethyl, etc.), an aryl group (e.g., a phenyl group), a heterocyclic group (preferably a nitrogen containing heterocyclic group), an alkoxy group, preferably a straight or branched alkoxy group having 1 to 20 carbon atoms (e.g., methoxy, ethoxy, t-butoxy, octyloxy, decyloxy, dodecyloxy, etc.), an aryloxy group (e.g., a phenoxy group), a hydroxy group, an acyloxy group, preferably an alkylcarbonyloxy group, an arylcarbonyloxy group (e.g., an acetoxy group, a benzoyloxy group), a carboxy group, an alkyloxycarbonyl group, preferably a straight or branched alkyloxycarbonyl group having 1 to 20 carbon atoms, an aryloxycarbonyl group, preferably a phenoxycarbonyl group, an alkylthio group preferably having 1 to 20 carbon atoms, an acyl group, a straight or branched alkylcarbonyl group which may preferably have 1 to 20 carbon atoms, an acylamino group, a straight or branched alkylcarboamido group which may preferably have 1 to 20 carbon atoms, a benzenecarboamido group, a sulfonamido group, preferably a straight or branched alkylsulfonamido group having 1 to 20 carbon atoms or a benzenesulfonamido group, a carbamoyl group, a straight or branched alkylaminocarbonyl group which may preferably have 1 to 20 carbon atoms or a phenylaminocarbonyl group, a sulfamoyl group, a straight or branched alkylaminosulfonyl group which may preferably have 1 to 20 carbon atoms or a phenylaminosulfonyl group, and the like.

Next, representative exemplary compounds of the cyan coupler represented by the formula (A) or (B) is shown below, but the present invention is not limited by these compounds.

[Exemplary compounds]
C-1
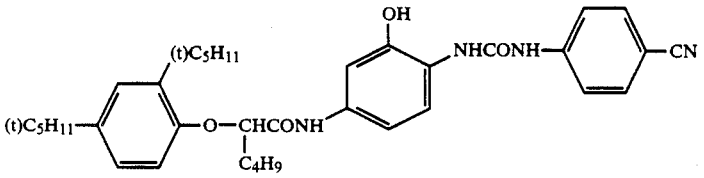
C-2
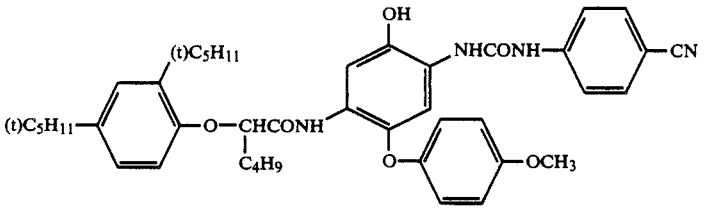
C-3
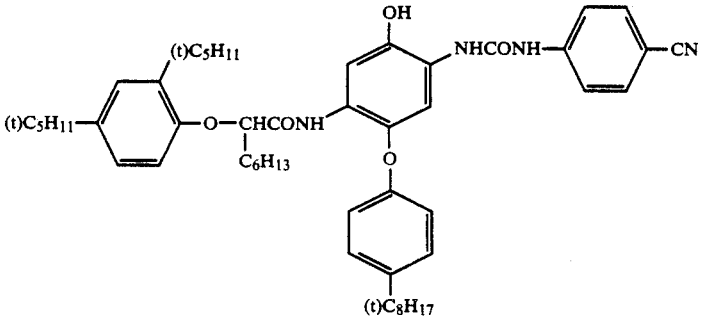
C-4
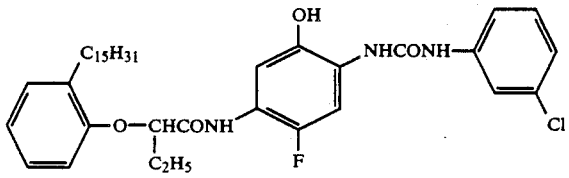
C-5
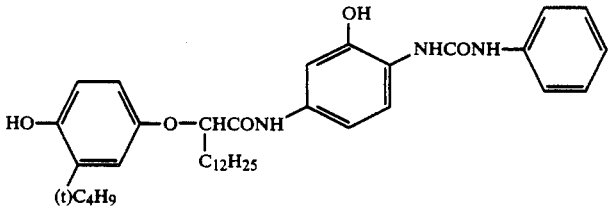
C-6
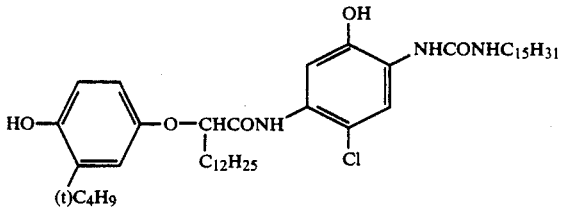
C-7
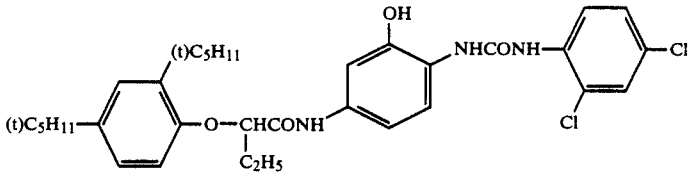

-continued
[Exemplary compounds]
C-8
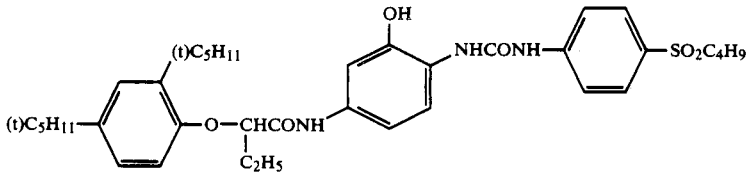
C-9
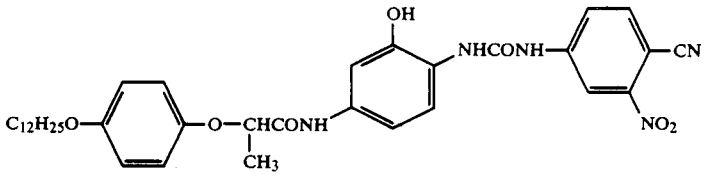
C-10
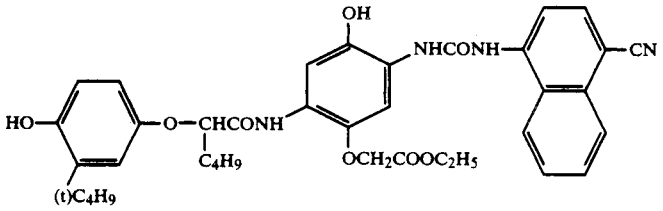
C-11
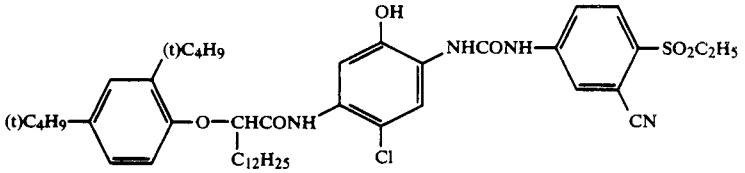
C-12
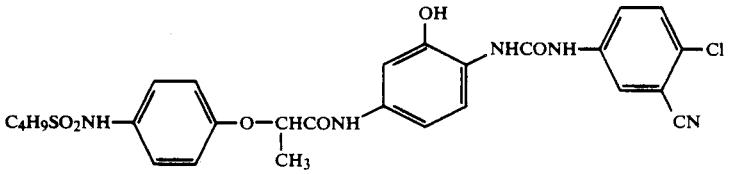
C-13
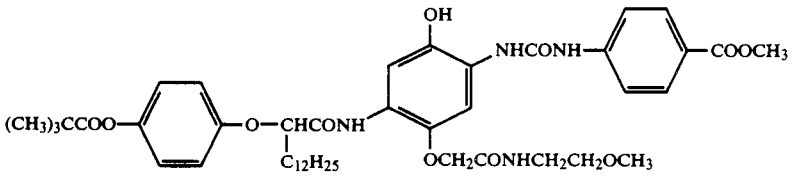
C-14
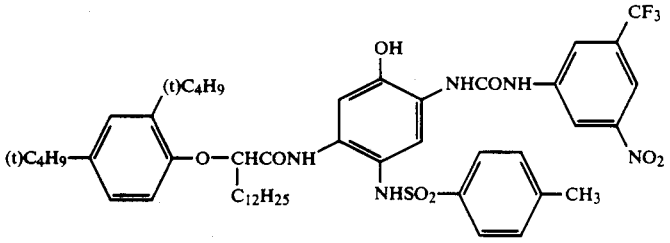
C-15
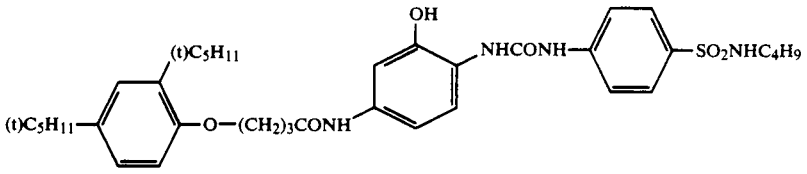

-continued
[Exemplary compounds]
C-16
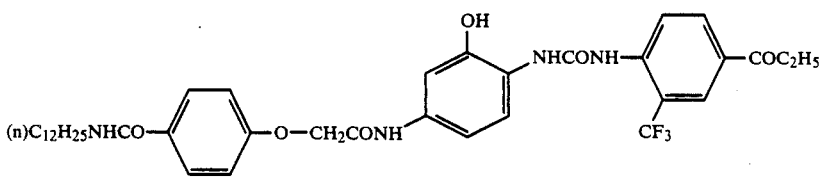
C-17
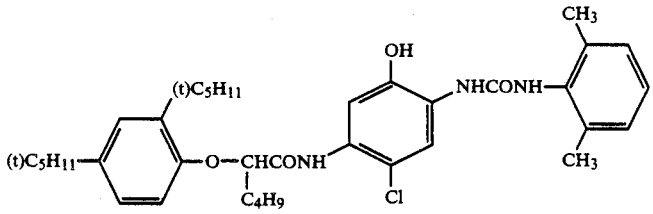
C-18
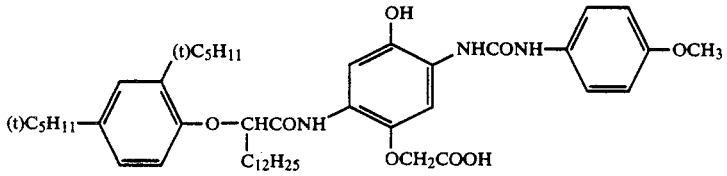
C-19
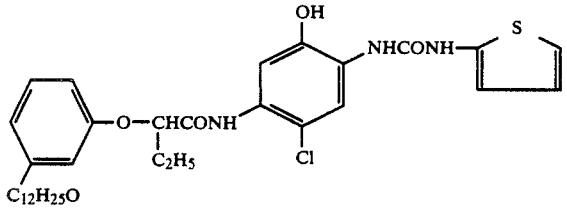
C-20
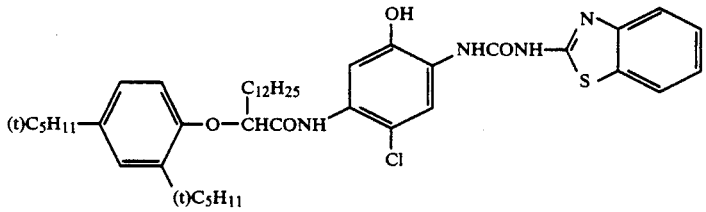
C-21
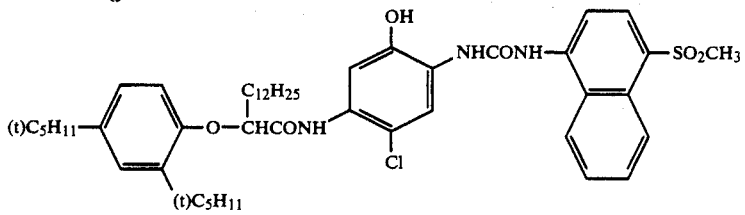
C-22
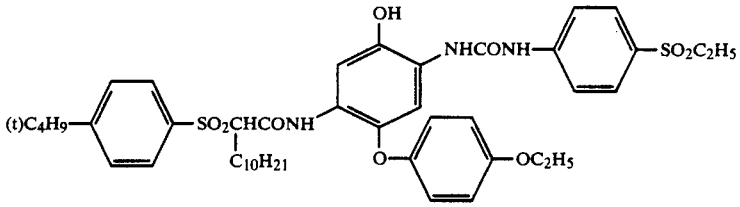

-continued
[Exemplary compounds]
C-23
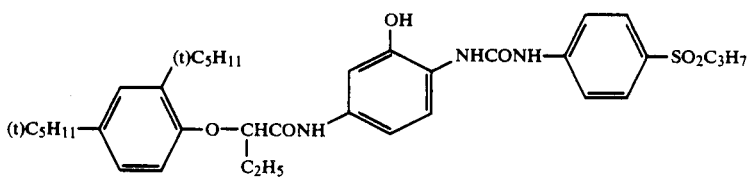
C-24
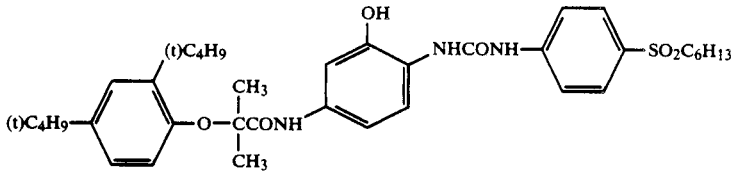
C-25
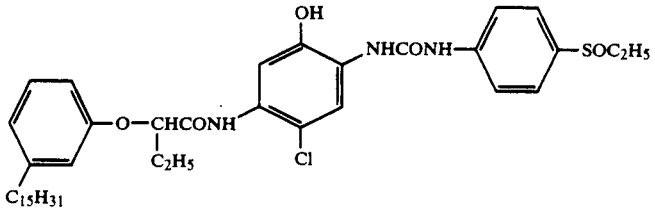
C-26
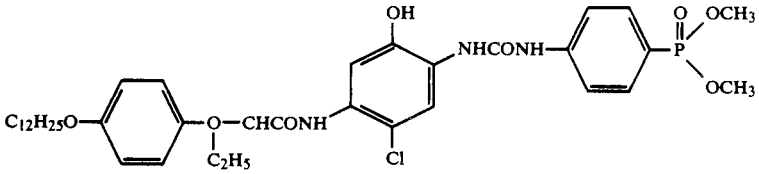
C-27
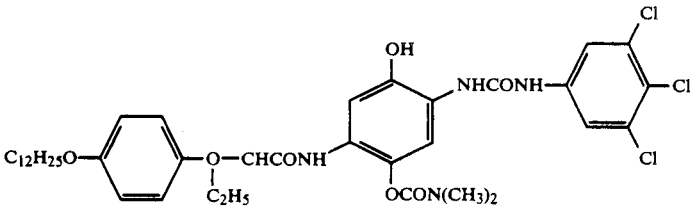
C-28
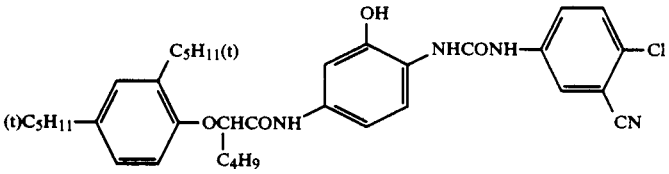
C-29
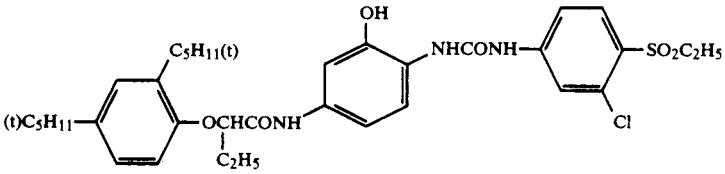
C-30
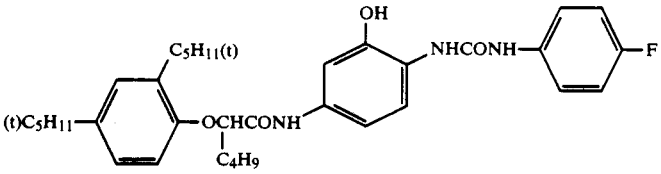

-continued
[Exemplary compounds]
C-31
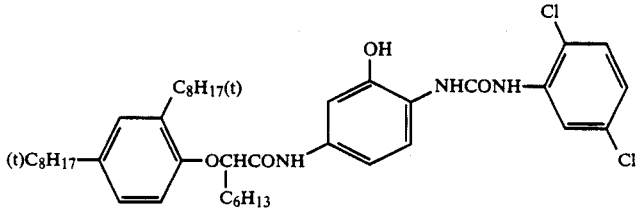
C-32
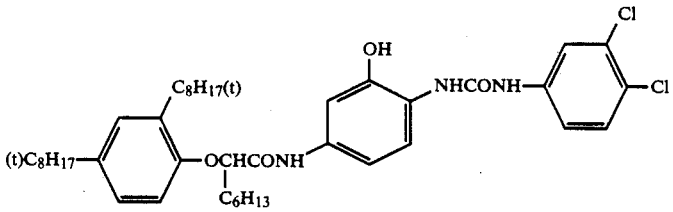
C-33
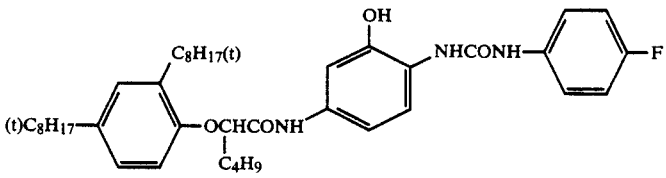
C-34
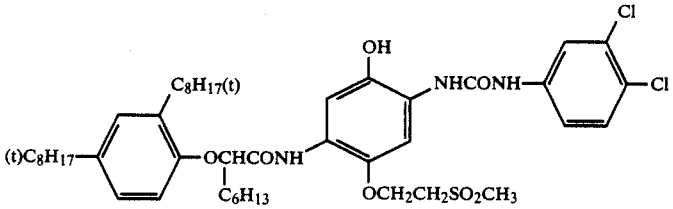
C-35
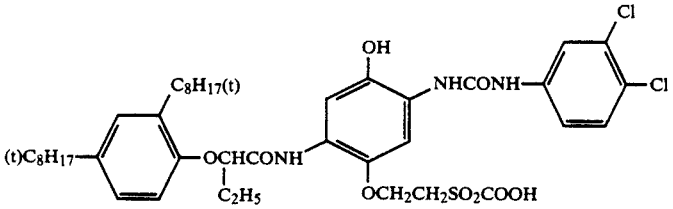
C-36
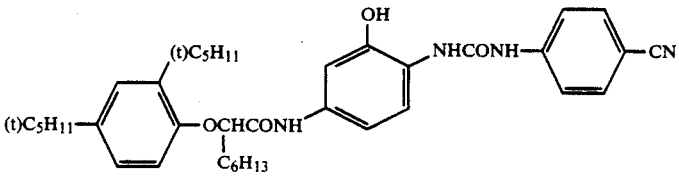
C-37
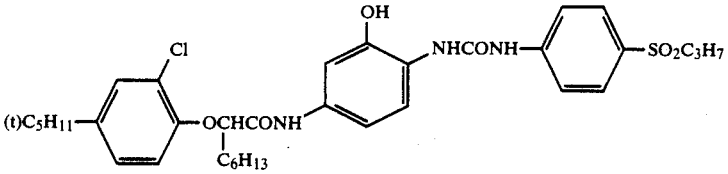

-continued
[Exemplary compounds]
C-38
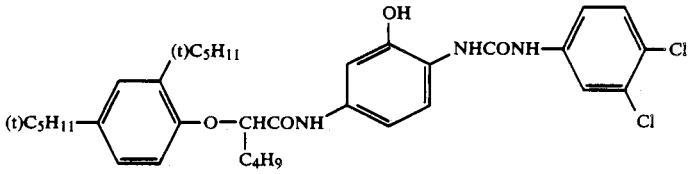
C-39
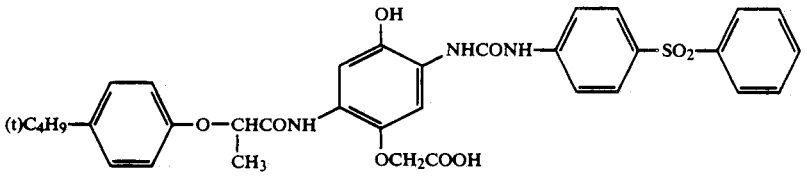
C-40
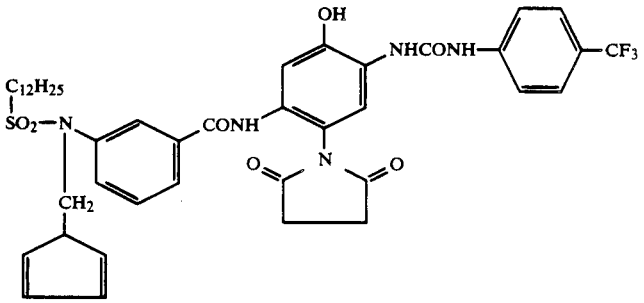
C-41
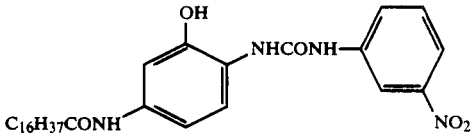
C-42
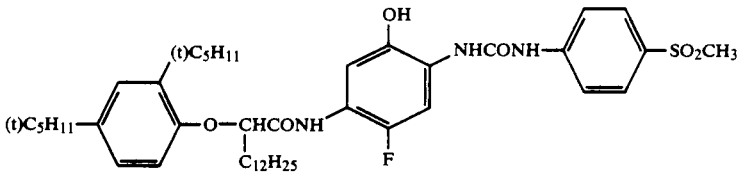
C-43
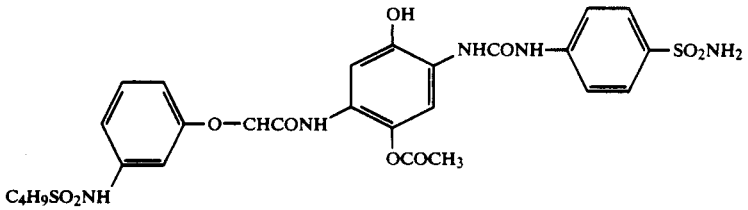
C-44
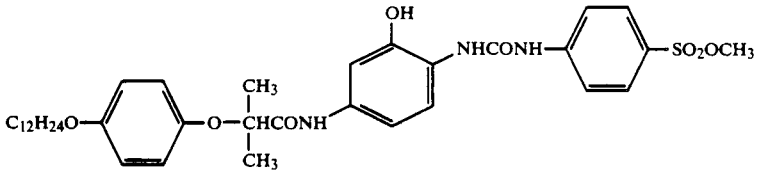

-continued

[Exemplary compounds]

C-45

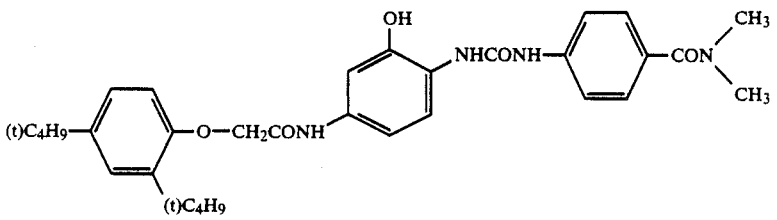

C-46

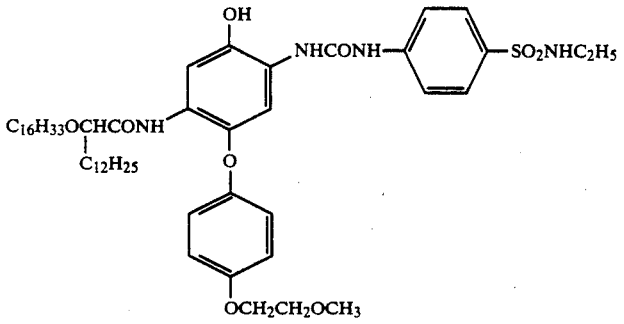

Next, with respect to the above formula (C) will be explained.

Each group represented by $R_{12}$ to $R_{17}$ in the formula (C) contains those having a substituent or substituents.

As to $R_{16}$, preferred is an aliphatic group having 1 to 30 carbon atoms, an aromatic group having 6 to 30 carbon atoms, a heterocyclic group having 1 to 30 carbon atoms, and as to $R_{14}$ and $R_{15}$, preferred are hydrogen atom and those mentioned as preferred in $R_{16}$.

As to $R_{12}$, preferred is a hydrogen atom which is bonded to NH directly or through NH, CO or $SO_2$, an aliphatic group having 1 to 30 carbon atoms, an aromatic group having 6 to 30 carbon atoms, a heterocyclic group having 1 to 30 carbon atoms, $—OR_{18}$, $—COR_{18}$,

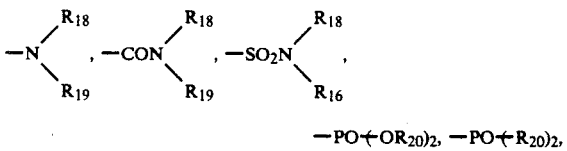

$—CO_2R_{20}$ or $—CO_2OR_{20}$ (where $R_{18}$, $R_{19}$ and $R_{20}$ each are the same as $R_{14}$, $R_{15}$ and $R_{16}$ as mentioned above, respectively, and $R_{18}$ and $R_{19}$ may be combined with each other to form a ring).

$R_{17}$ is preferably an aromatic group having 6 to 30 carbon atoms, and representative substituents of $R_{17}$ may be mentioned a halogen atom, a hydroxy group, an amino group, a carboxyl group, a sulfonic acid group, a cyano group, an aromatic group, a heterocyclic group, a carbonamido group, a sulfonamido group, a carbamoyl group, a sulfamoyl group, a ureido group, an acyl group, an acyloxy group, an aliphatic oxy group, an aromatic oxy group, an aliphathic thio group, an aromatic thio group, an aliphatic sulfonyl group, an aromatic sulfonyl group, a sulfamoylamino group, a nitro group, an imido group, an aliphatic group, an aliphatic oxycarbonyl group, etc. When it is substituted by a plural number of substituents, they may be combined with each other to form a ring and example thereof may include a dioxymethylene group, etc.

Representative examples of $R_{13}$ may include a halogen atom, a hydroxy group, an amino group, a carboxyl group, a sulfonic acid group, a cyano group, an aromatic group, a heterocyclic group, a carbonamido group, a sulfonamido group, a carbamoyl group, a sulfamoyl group, a ureido group, an acyl group, an acyloxy group, an aliphatic oxy group, an aromatic oxy group, an aliphatic thio group, an aromatic thio group, an aliphatic sulfonyl group, an aromatic sulfonyl group, a sulfamoylamino group, a nitro group, an imido group, etc. The carbon number included in this $R_{13}$ is preferably 0 to 30. When m=2, example of cyclic $R_{13}$ may include a dioxymethylene group, etc.

When l is 1, $—CONR_{14}R_{15}$ is particularly preferred as $R_{11}$, m is preferably 0. As to $R_{12}$, particularly preferred are $—OR_{18}$, $—COOR_{20}$, $—SO_2R_{20}$, $—CONR_{18}R_{19}$ and $—SO_2NR_{18}R_{19}$ which are directly bonded to NH, more preferred are $—COOR_{20}$, $—OR_{18}$ and $—SO_2R_{20}$ which are directly bonded to NH, and above all, $—COOR_{20}$ is most preferred.

Also, those which form polymer of dimer or more through $R_{11}$ to $R_{13}$ or X may be included in the present invention.

In the formula (C), in case of l =0 is preferred.

Specific examples of the coupler represented by the formula (C) are described in Japanese Provisional Patent Publication Nos. 237448/1985, 153640/1986, 145557/1986, 85242/1987, 15529/1973, 11742/1975, 18315/1977, 90932/1977, 52423/1978, 48237/1979, 66129/1979, 32071/1980, 65957/1980, 105226/1980, 1938/1981, 12643/1981, 27147/1981, 126832/1981 and 95346/1983, and U.S. Pat. No. 3,488,193 and the like, and they may be synthesized by the methods as disclosed in them.

For adding the coupler into a light-sensitive material, various methods can be used in accordance with physical properties of the coupler (for example, solubility) such as an oil-in-water type emulsification method using water-insoluble high-boiling point organic solvent, an alkali dispersion method adding as alkaline solution, a latex dispersion method and a solid dispersion method directly adding as fine solid, etc.

The amount of the coupler to be added is generally in the range of $1.0\times10^{-3}$ mole to 1.0 mole, preferably $5.0\times10^{-3}$ mole to $8.0\times10^{-1}$ mole per one mole of silver halide.
Next, representative examples of the coupler represented by the formula (C) are shown but the present invention is not limited by these.
[Exemplary compounds]
C
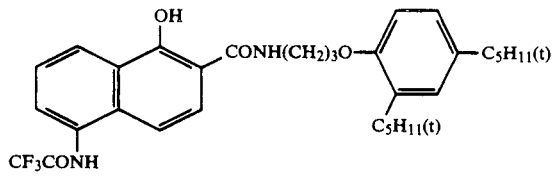
C
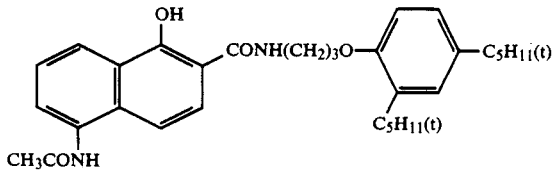
C
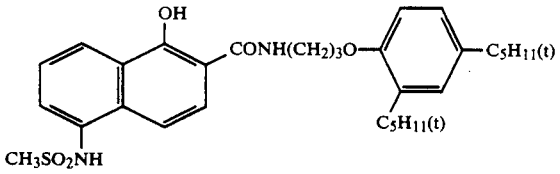
C
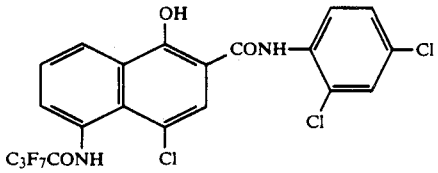
C
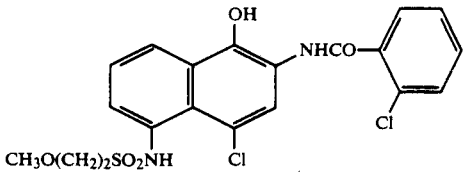
C
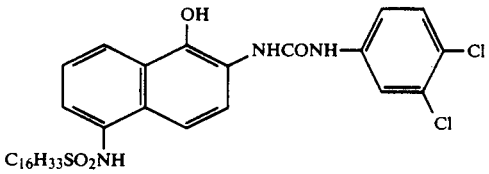
C
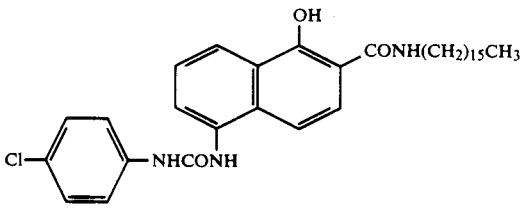

-continued
[Exemplary compounds]
C-58
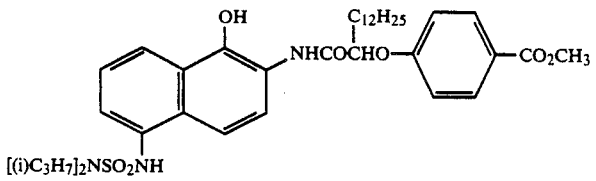
C-59
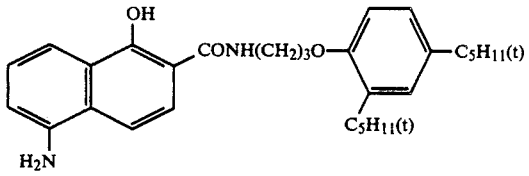
C-60
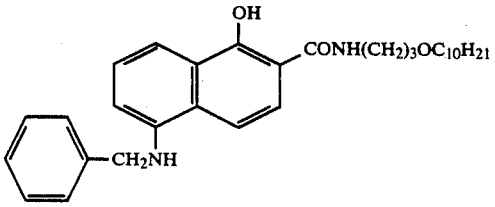
C-61
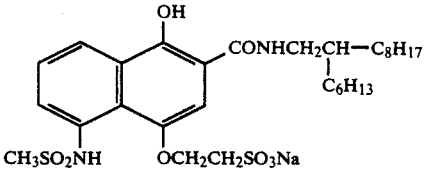
C-62
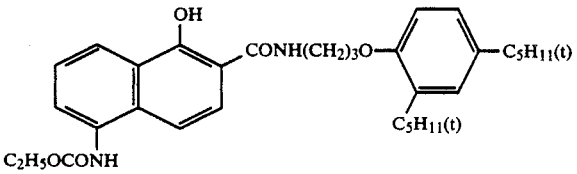
C-63
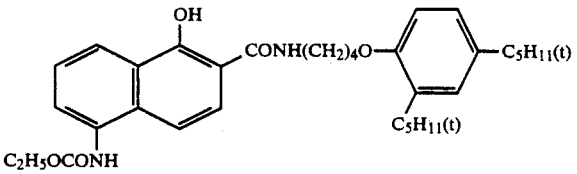
C-64
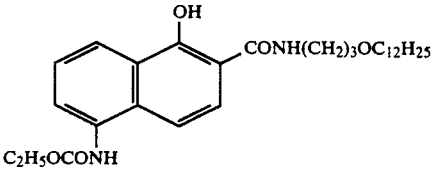
C-65
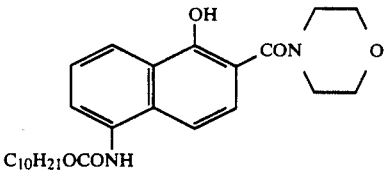

-continued
[Exemplary compounds]
C-66
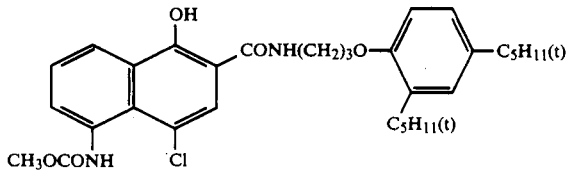
C-67
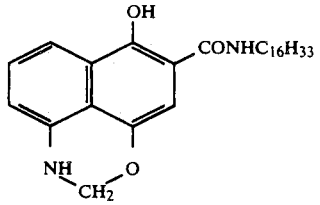
C-68
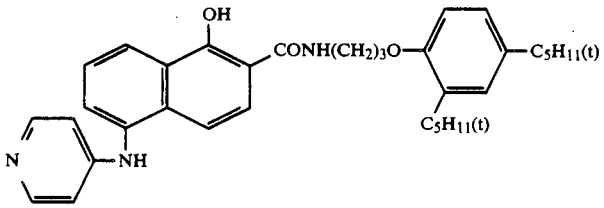
C-69
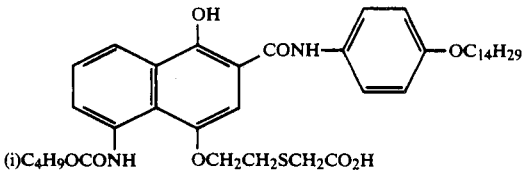
C-70
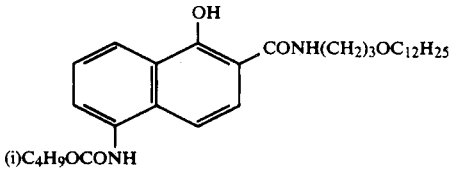
C-71
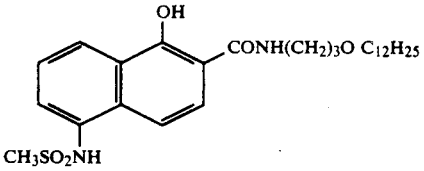
C-72
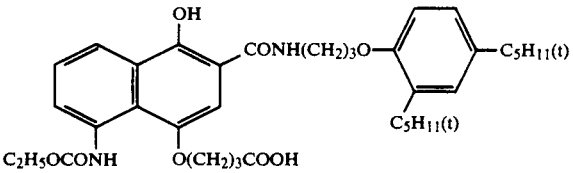
C-73
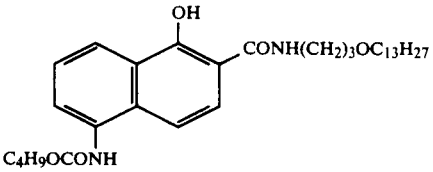

-continued
[Exemplary compounds]
C-74
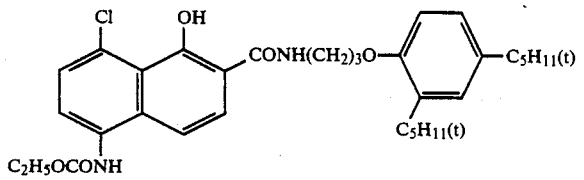
C-75
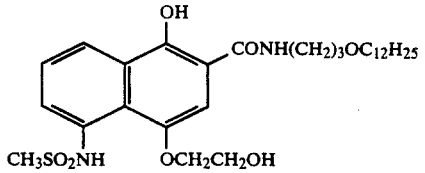
C-76
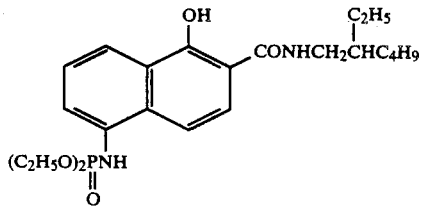
C-77
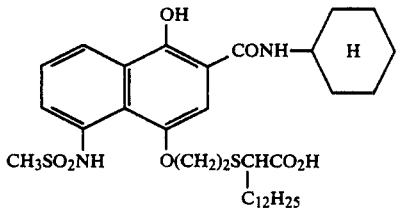
C-78
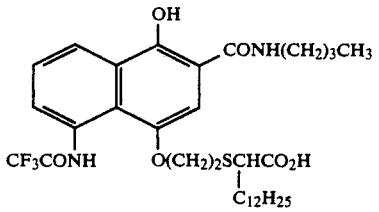
C-79
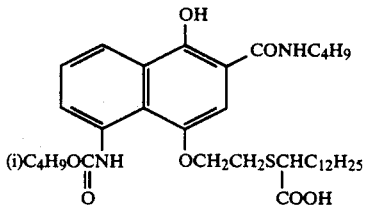
C-80
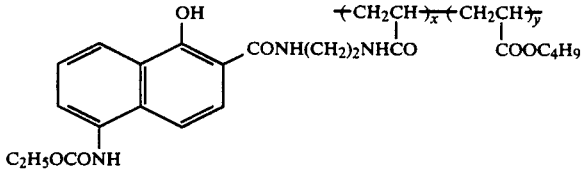
x:y = 60:40 (molar ratio)

-continued
[Exemplary compounds]
C-81
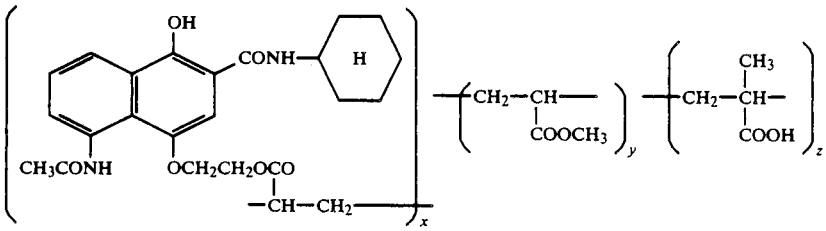
x:y:z = 5:4:1 (weight ratio)
C-82
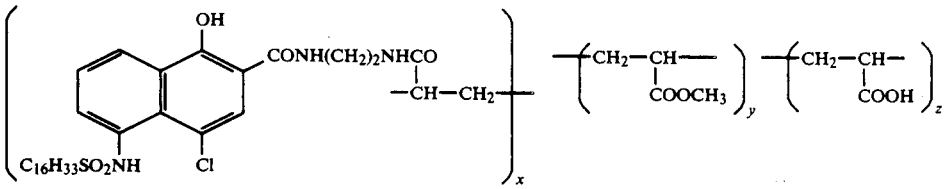
x:y:z = 67:26:7 (weight ratio)
C-83
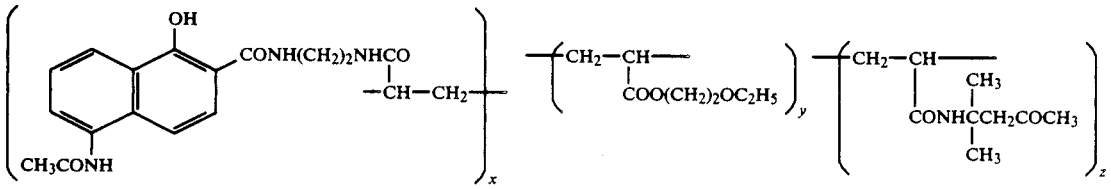
x:y:z = 2:1:1 (weight ratio)
C-84
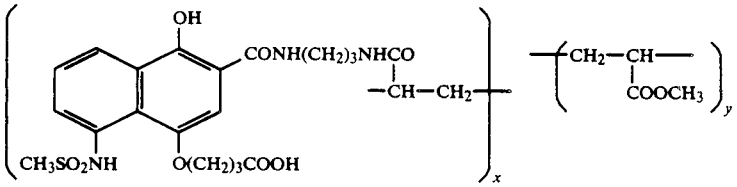
x:y = 1:4 (weight ratio)
C-85
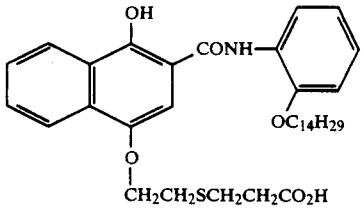
C-86
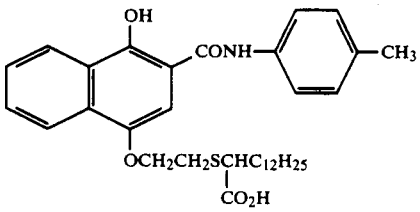
C-87
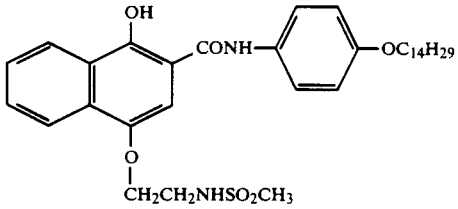

-continued
[Exemplary compounds]
C-88
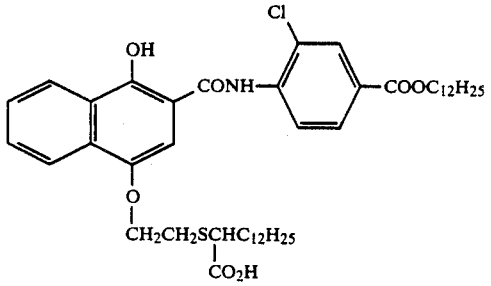
C-89
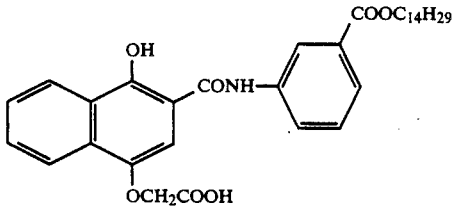
C-90
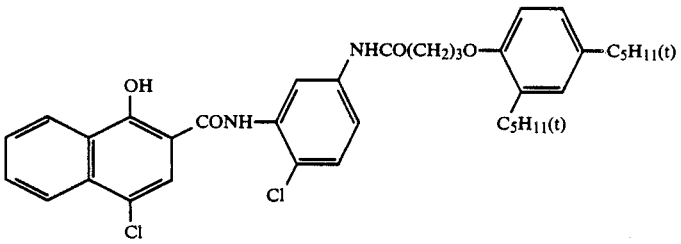
C-91
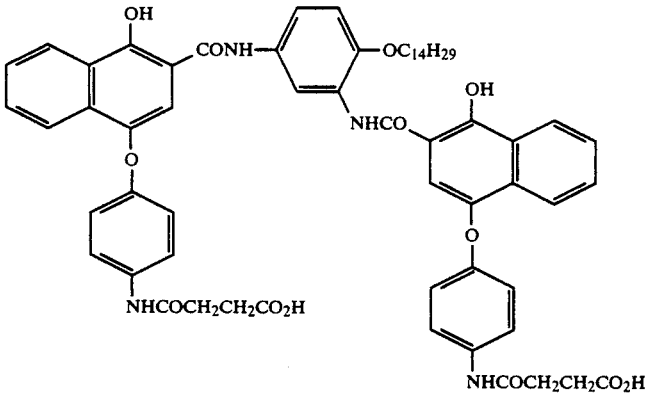
C-92
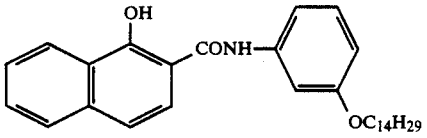
C-93
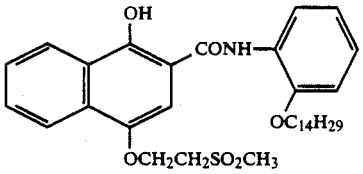

-continued
[Exemplary compounds]
C-94
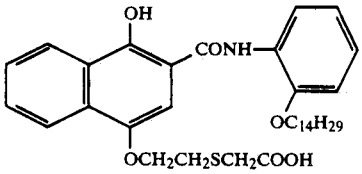
C-95
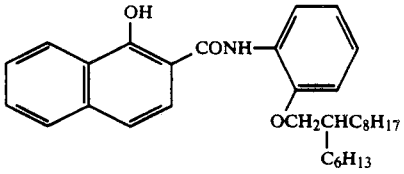
C-96
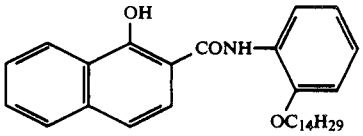
C-97
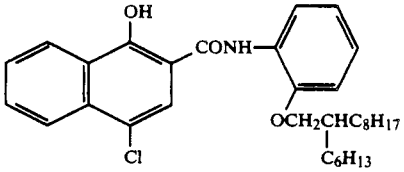
C-98
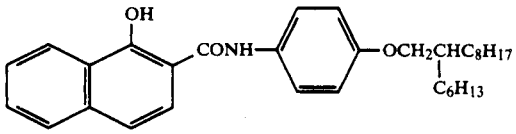
C-99
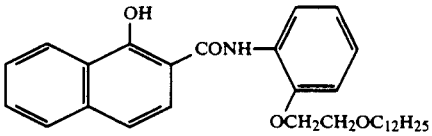
C-100
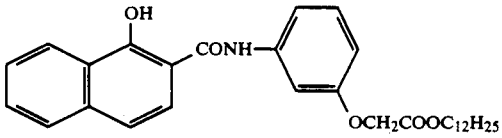
C-101
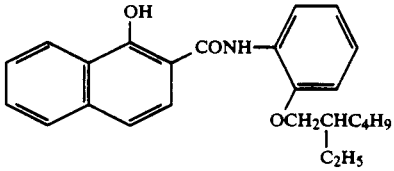
C-102
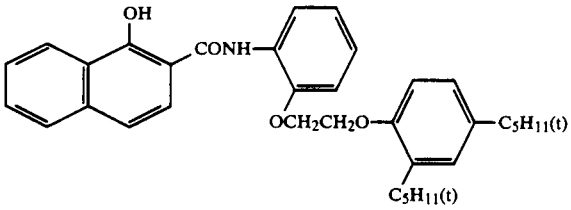

-continued
[Exemplary compounds]
C-103
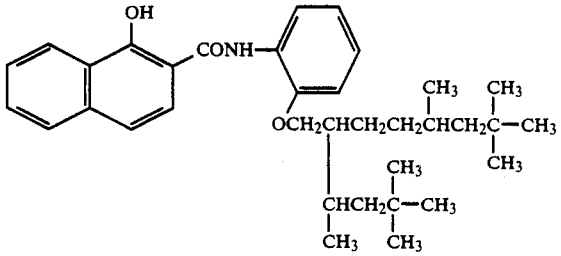
C-104
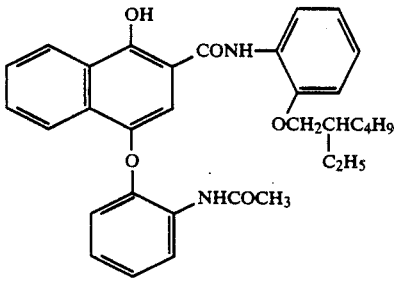
C-105
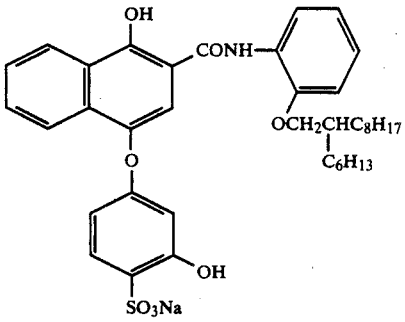
C-106
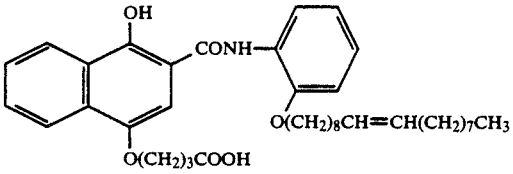
C-107
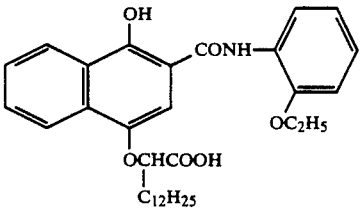
C-108
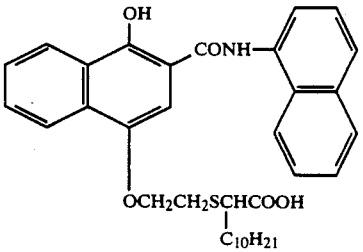

-continued
[Exemplary compounds]
C-109
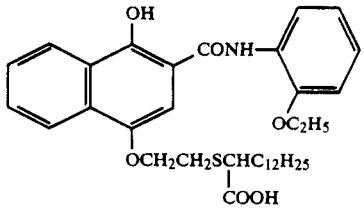
C-110
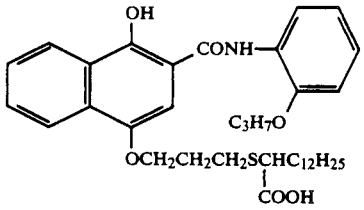
C-111
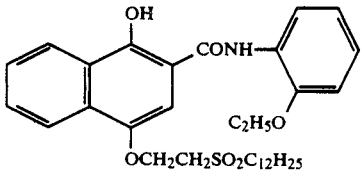
C-112
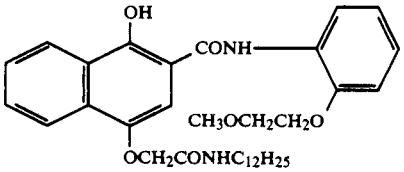
C-113
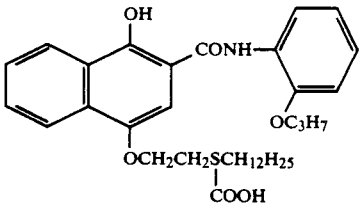
C-114
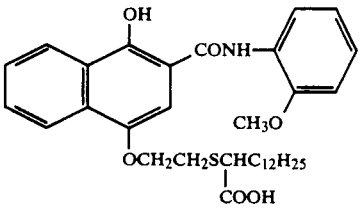
C-115
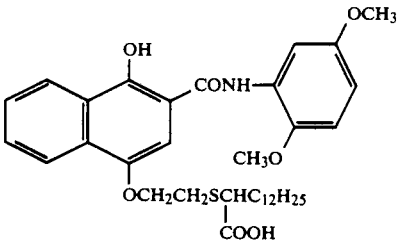

-continued

[Exemplary compounds]

C-116

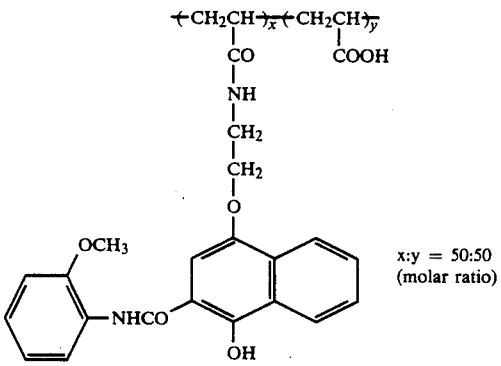

C-117

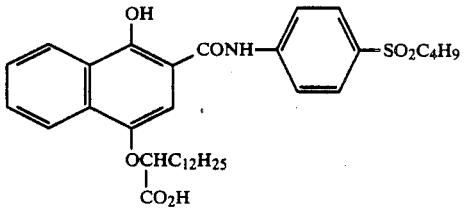

C-118

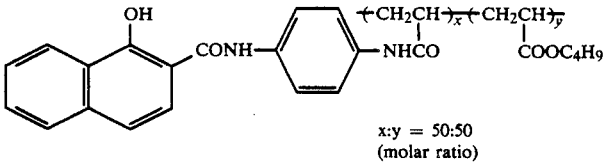

In the preferred embodiment of the present invention, it is preferred to process a light-sensitive material with an alkaline solution having a pH of 8 or more immediately after a bleach-fixing processing from the point of color reproducibility of a cyan dye image.

For the alkaline solution having a pH of 8 or more, known buffering agents are used in order to enhance buffering ability of pH. Preferred buffering agents may include sodium carbonate, potassium carbonate, potassium bicarbonate, boric acid, borax, sodium metaborate, sodium phosphate, potassium phosphate, sodium dihydrogenphosphate, sufosalycylic acid, etc.

The buffering agent may preferably be used in an amount of 0.2 to 50 g, more preferably 0.5 to 30 g per one liter of the alkaline solution.

Next, the magenta coupler to be used in the green-sensitive silver halide emulsion layer of the light-sensitive material according to the present invention will be explained.

In the magenta coupler represented by the above formula (M-I) according to the present invention, Z represents a group of non-metallic atoms necessary for forming a nitrogen-containing heterocyclic ring, and the ring formed by said Z may have a substituent or substituents.

X represents a hydrogen atom or a substituent eliminatable through the reaction with the oxidized product of a color developing agent.

Also, R represents a hydrogen atom or a substituent or substituents.

As the substituent represented by R, there is not particularly limited, but representatively, it may include each groups of alkyl, aryl, anilino, acylamino, sulfonamido, alkylthio, arylthio, alkenyl, cycloalkyl, etc., and in addition to them, there may be mentioned halogen atoms and each groups of cycloalkenyl, alkynyl, heterocyclic ring, sufonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl and heterocyclylthio, as well as a spiro compound residueal group and a bridged hydrocarbon compound residual group.

The alkyl group represented by R may include preferably those having 1 to 32 carbon atoms, and it may be straight or branched.

The aryl group represented by R may preferably be a phenyl group.

The acylamino group represented by R may be mentioned an alkylcarbonylamino group, an arylcarbonylamino group, etc.

The sulfonamido group represented by R may be mentioned an alkylsulfonylamino group, an arylsulfonylamino group, etc.

An alkyl component and aryl component of the alkylthio group and the arylthio group represented by R may be mentioned the above alkyl group and aryl group represented by R.

As the alkenyl group represented by R, those having 2 to 32 carbon atoms, and the cycloalkyl group is those having 3 to 12 carbon atoms, particularly preferably 5 to 7 carbon atoms, and the alkenyl group may be straight or branched.

As the cycloalkenyl group represented by R, those having 3 to 12 carbon atoms, particularly 5 to 7 carbon atoms are preferred.

The alkylsulfonyl group represented by R may include an alkylsulfonyl group, an arylsulfonyl group, etc.; the sulfinyl group may include an alkylsulfinyl group, an arylsufinyl group; the phosphonyl group may include an alkylphosphonyl group, an alkoxyphosphonyl group, an aryloxyphosphonyl group, an arylphosphonyl group, etc.; the acyl group may include an akylcarbonyl group, an arylcarbonyl group, etc.; the carbamoyl group may include an alkylcarbamoyl group, an arylcarbamoyl group, etc.; the sulfamoyl group may include an alkylsulfamoyl group, an arylsulfamoyl group, etc.; the acyloxy group may include an akylcarbonyloxy group, an aryloxycarbonyloxy group, etc.; the carbamoyloxy group may include an alkylcarbamoyloxy group, an arylcarbamoyloxy group, etc.; the ureido group may include an alkylureido group, an arylureido group, etc.; the sulfamoylamino group may include an alkylsulfamoylamino group, an arylsulfamoylamino group, etc.; the heterocyclic group may preferably be 5 to 7-membered, and more specifically a 2-furyl group, a 2-thienyl group, a 2-pyrimidinyl group, a 2-benzothiazolyl group, etc.; the heterocyclyloxy group may preferably be those having 5 to 7-membered heterocyclic ring, for example, a 3,4,5,6-tetrahydropyranyl-2-oxy group, a 1-phenyltetrazol-5-oxy group, etc.; the heterocyclylthio group may preferably be those having 5 to 7-membered heterocyclylthio group, for example, a 2-pyridylthio group, a 2-benzothiazoythio group, a 2,4-diphenoxy-1,3,5-triazol-6-thio group, etc.; the siloxy group may include a trimethylsiloxy group, a triethylsiloxy group, a dimethylbutylsiloxy group, etc.; the imido group may include a succinimido group, a 3-heptadecylsuccinimido group, a phthalimido group, a glutarimido group, etc.; a spiro compound residual group may include a spiro[3.3]heptan-1-yl group, etc; the bridged hydrocarbon residueal group may include a bicyclo[2.2.1]heptan-1-yl group, a tricyclo[3.3.1.1$^{3,7}$]-decan-1-yl group, a 7,7-dimethylbicyclo[2.2.1]heptan-1-yl group, etc.

The atom eliminatable through the reaction with the oxidized product of a color developing agent represented by X may include halogen atoms (e.g. a chlorine atom, a bromine atom, a fluorine atom, etc.) and also each groups of alkoxy, aryloxy, heterocyclyloxy, acyloxy, sulfonyloxy, alkoxycarbonyloxy, aryloxycarbonyl, alkyloxzalyloxy, alkoxyoxzalyloxy, alkylthio, arylthio, heterocyclylthio, alkyloxycarbonylthio, acylamino, sulfonamido, nitrogen-containing heterocyclic ring combined with N-atom, alkyloxycarbonylthiamino, aryloxycarbonylamino, carboxyl,

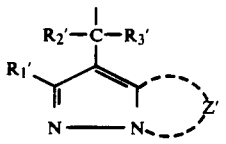

wherein $R^1$, has the same meaning as the above R, Z' has the same meaning as the above Z, $R^{2'}$ and $R^{3'}$ each represent a hydrogen atom, an aryl group, an alkyl group or a heterocyclic group, and the like, but preferably halogen atoms, and particularly a chlorine atom.

Also, the nitrogen-containing heterocyclic ring formed by Z or Z' may include a pyrazole ring, an imidazole ring, a triazole ring, a tetrazole ring, etc. and the substituent or substituents which may be bonded to said rings may include those as mentioned for the above R.

The magenta coupler represented by the formula (M-I) may be mentioned more specifically, for example, by the formulae (M-II) to (M-VII) below:

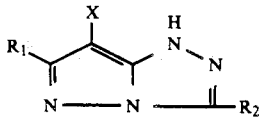

(M-II)

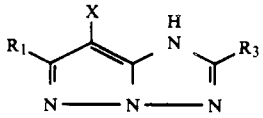

(M-III)

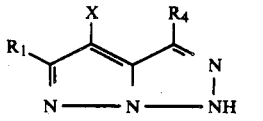

(M-IV)

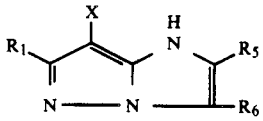

(M-V)

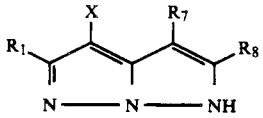

(M-VI)

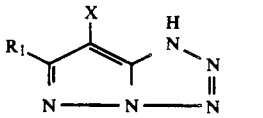

(M-VII)

In the above formulae (M-II) to (M-VII), $R_1$ to $R_8$ and X have the same meanings as the above R and X.

Also, of the compounds represented by the formula (M-I), preferred are the compound represented by the following formula (M-VIII):

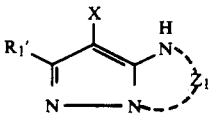

(M-VIII)

wherein $R_1$, X and $Z_1$ have the same meanings as R, X and Z in the formula (M-I).

Of the magenta couplers represented by the formulae (M-II) to (M-VII), the magenta coupler represented by the formula (M-II) is particularly preferred.

As the substituent(s) on the ring formed by Z in the formula (M-I) and on the ring formed by $Z_1$ in the formula (M-VIII), and $R_2$ to $R_8$ in the above formulae (M-II) to (M-VI), that represented by the formula (M-IX) is preferred.

$$-R^1-SO_2-R^2 \qquad \text{(M-IX)}$$

In the formula, $R^1$ represents an alkylene group, and $R^2$ represents an alkyl group, a cycloalkyl group or an aryl group.

The alkylene group represented by $R^1$ may preferably have carbon number at straight chain portion of 2 or more, more preferably 3 to 6 and may be straight or branched.

The alkyl group represented by $R^2$ may preferably be 5- to 6-membered ones.

Also, when it is used for forming a positive image, the most preferred substituent R and $R_1$ on the above heterocyclic ring are that represented by the following formula (M-X):

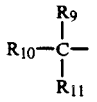

(M - X)

In the above formula, $R_9$, $R_{10}$ and $R_{11}$ have the same meanings as in the above R.

Also, two of the above $R_9$, $R_{10}$ and $R_{11}$, for example, $R_9$ and $R_{10}$, may be combined with each other to form a saturated or unsaturated ring (e.g., cycloalkane, cycloalkene, heterocyclic ring), and $R_{11}$ is further combined to said ring to form a bridged hydrocarbon residual group.

Among the formula (M-X), preferred are (i) the case where at least two of $R_9$ to $R_{11}$ are alkyl groups, and (ii) is a hydrogen atom and the other two of $R_9$ and $R_{10}$ are combined with each other to form cycloalkyl with root carbon atoms.

Further, among (i), preferred is the case where two of $R_9$ to $R_{11}$ are alkyl groups, and the other one is a hydrogen atom or an alkyl group.

Also, when it is used for forming a negative image, the most preferred substituent R and $R_1$ on the above heterocyclic ring are that represented by the following formula (M-XI):

$$R_{12}—CH_2— \qquad \text{(M-XI)}$$

In the formula, $R_{12}$ has the same meaning as in the above R.

$R_{12}$ may preferably be a hydrogen atom or an alkyl group.

In the following, representative specific examples of the compounds according to the present invention will be mentioned.

[Exemplary compounds]

1

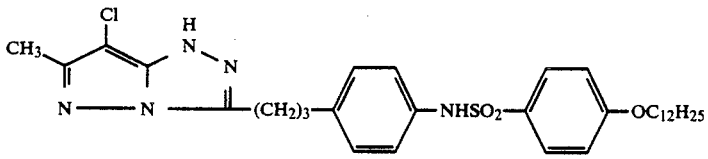

2

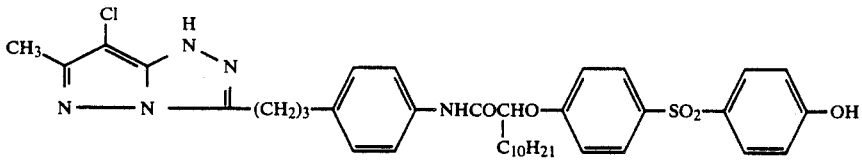

3

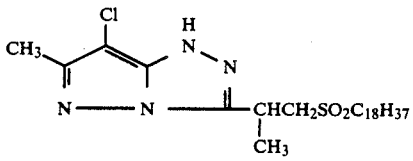

4

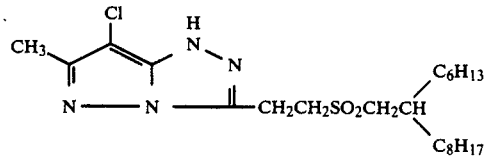

5

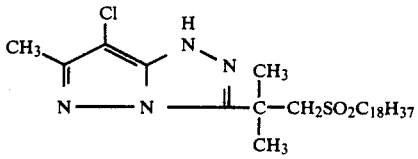

-continued
6
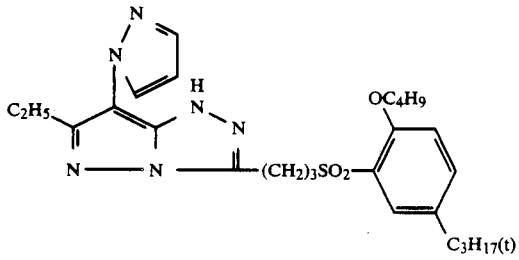
7
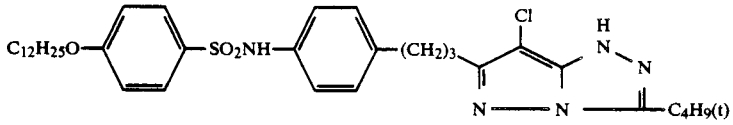
8
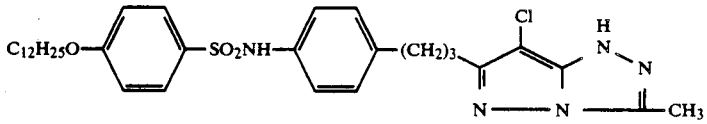
9
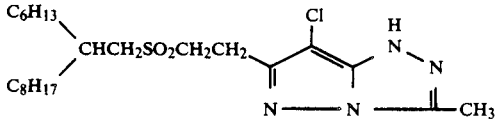
10
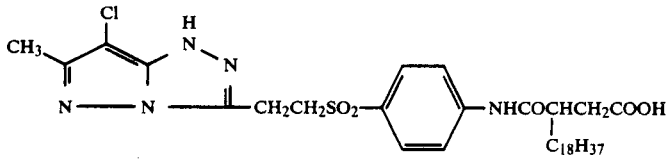
11
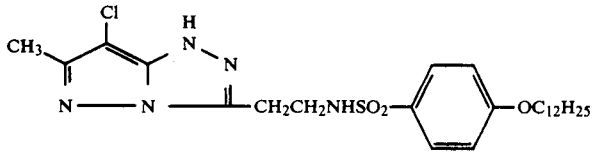
12
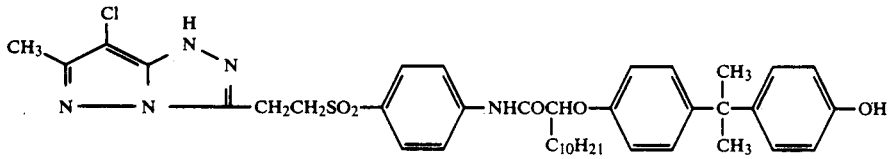
13
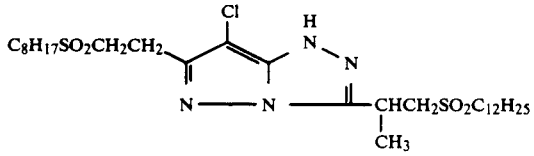
14
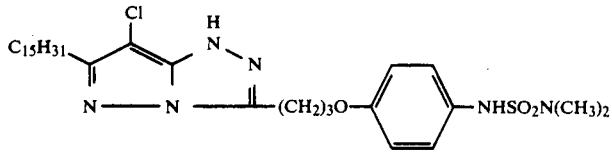

-continued
15
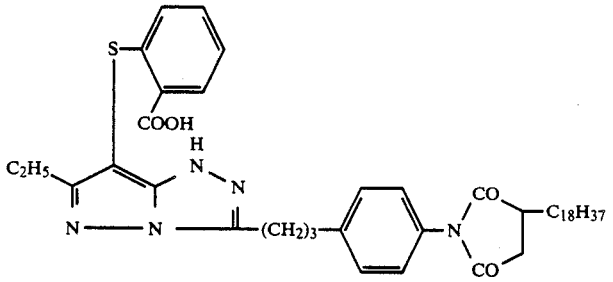
16
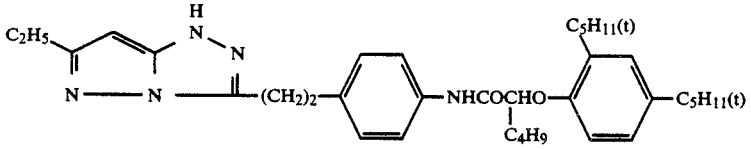
17
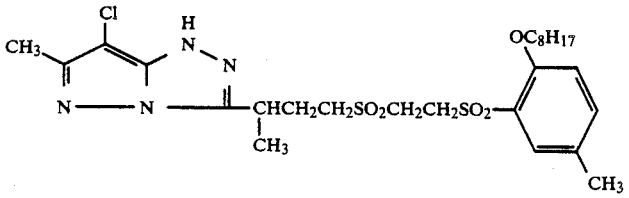
18
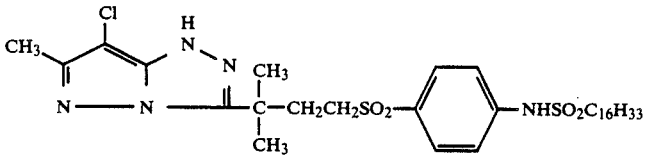
19
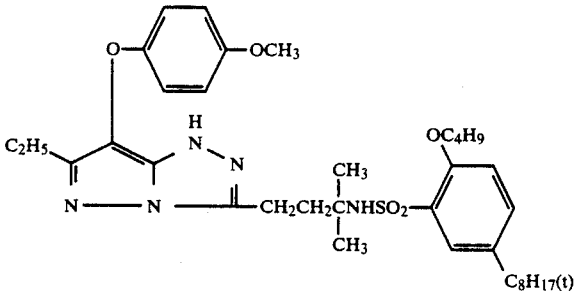
20
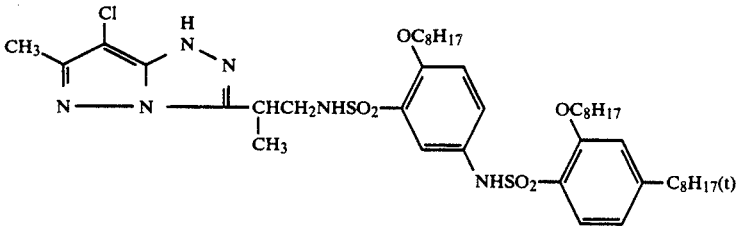
21
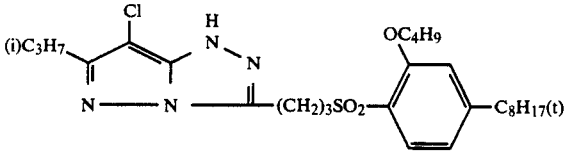

-continued
22
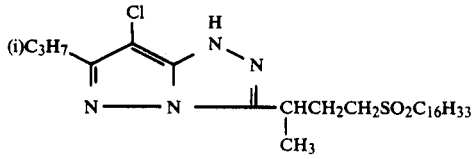
23
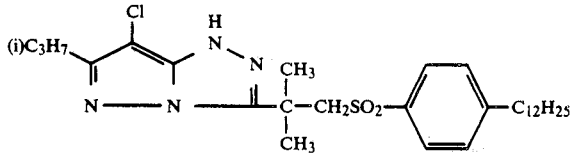
24
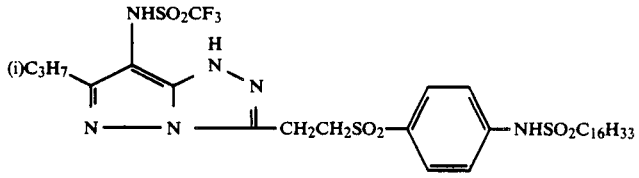
25
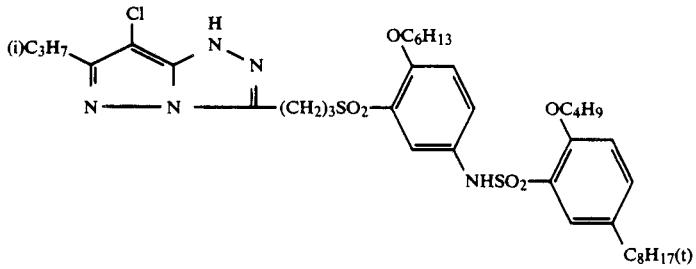
26
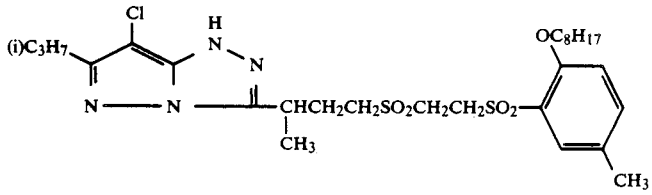
27
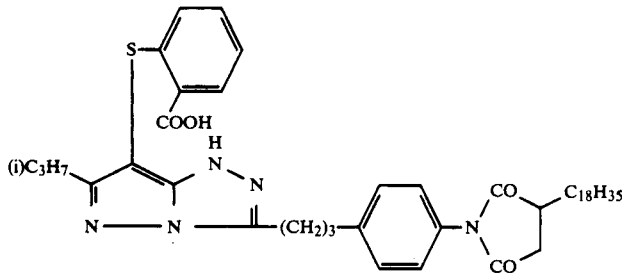
28
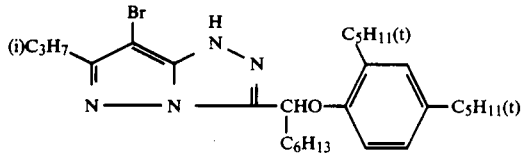
29
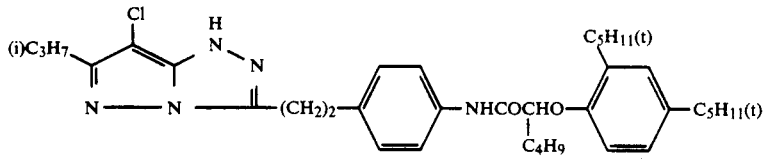

-continued
30
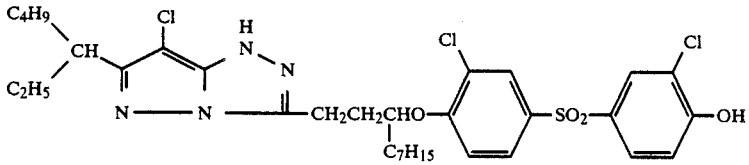
31
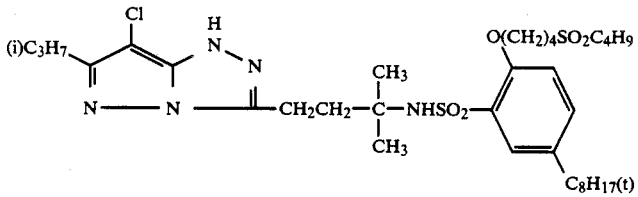
32
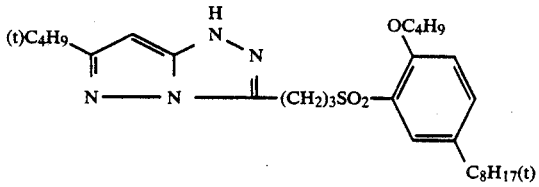
33
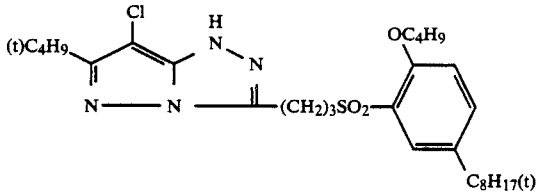
34
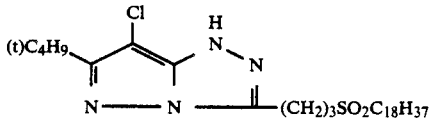
35
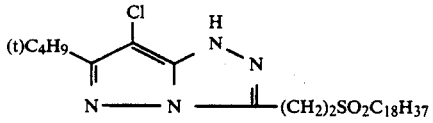
36
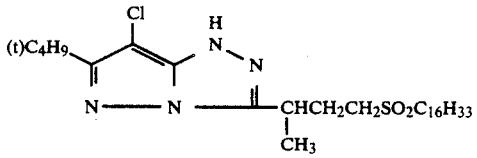
37
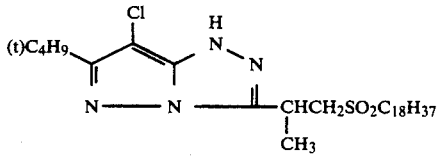
38
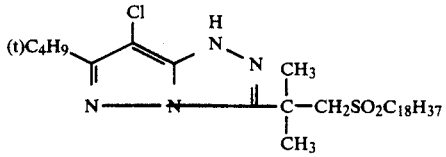

-continued
39
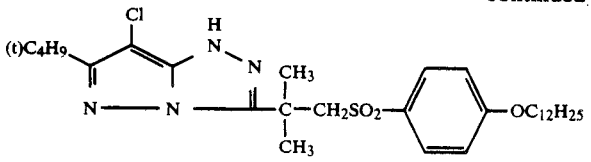
40
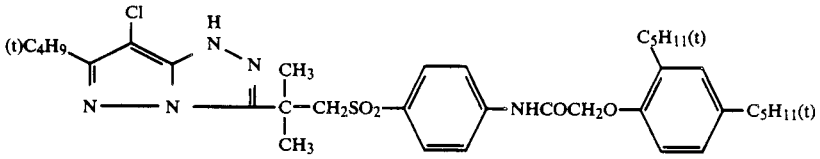
41
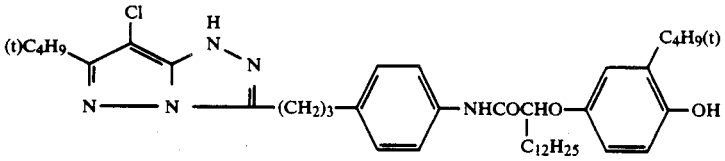
42
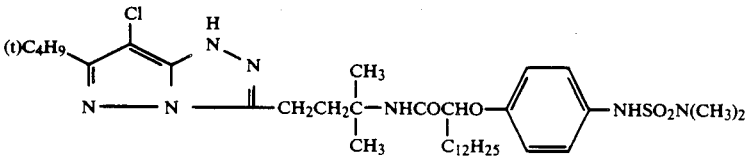
43
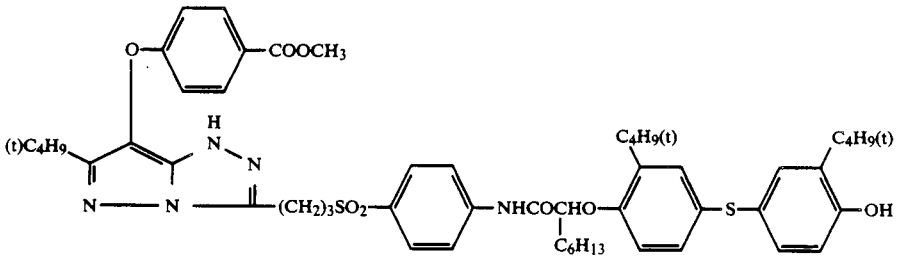
44
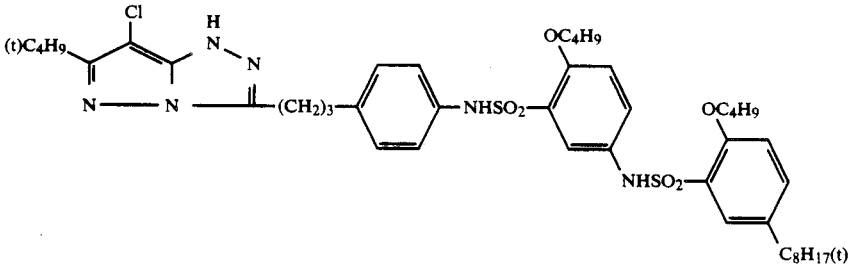
45
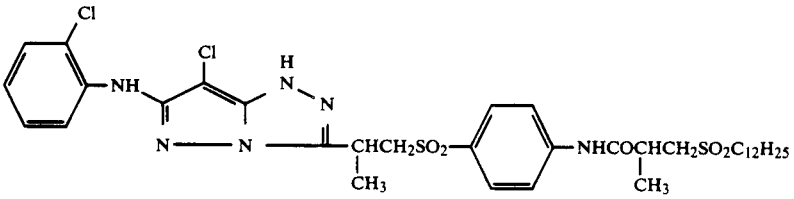
46
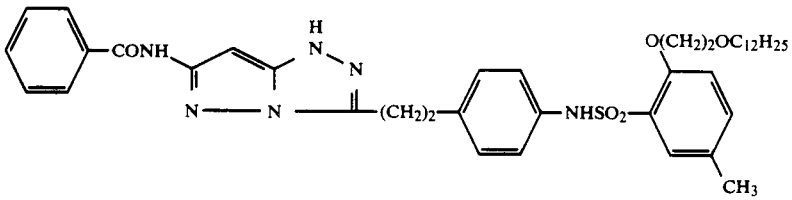

-continued
47
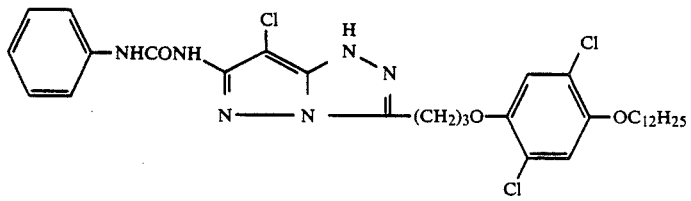
48
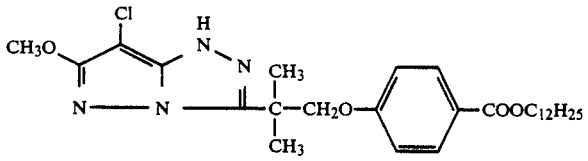
49
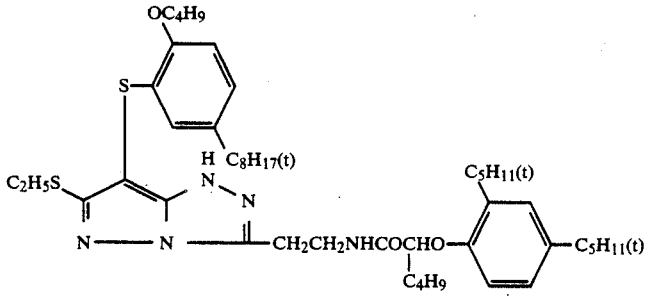
50
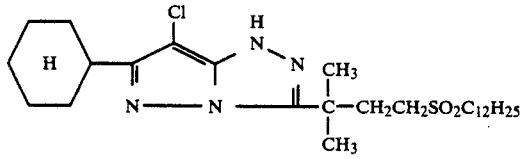
51
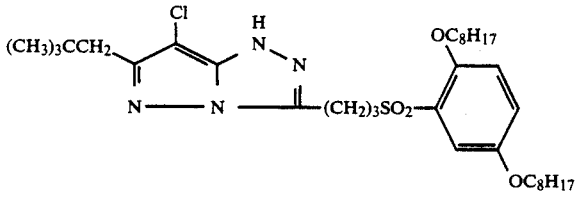
52
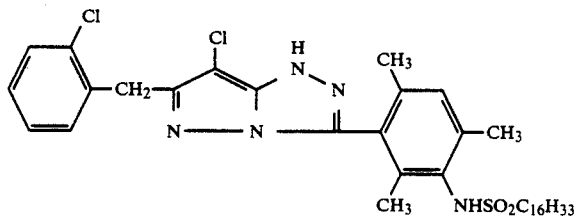
53
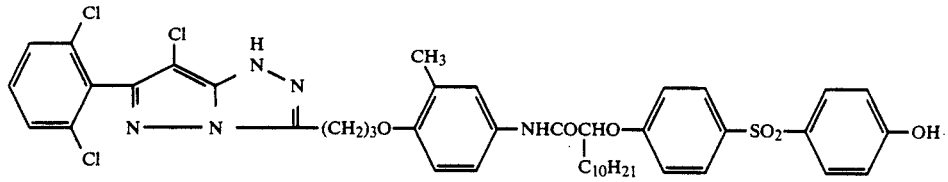

-continued
54
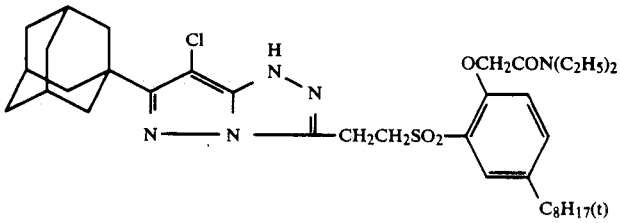
55
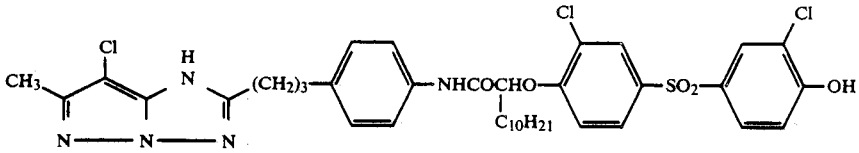
56
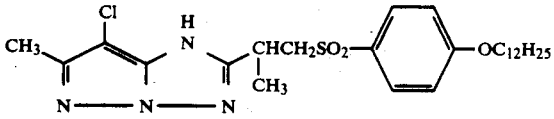
57
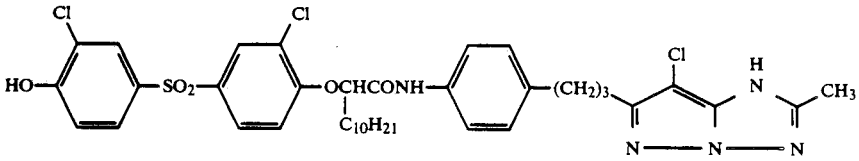
58
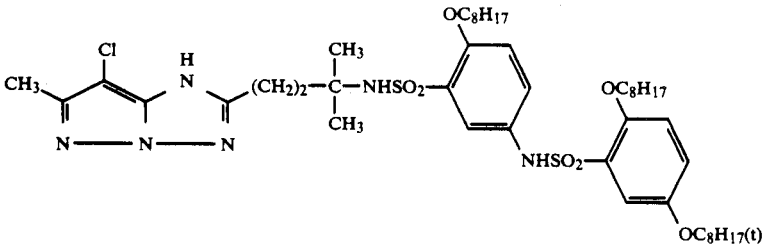
59
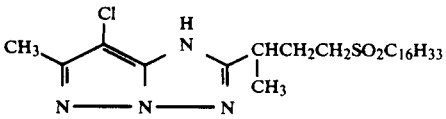
60
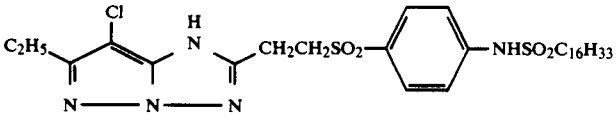
61
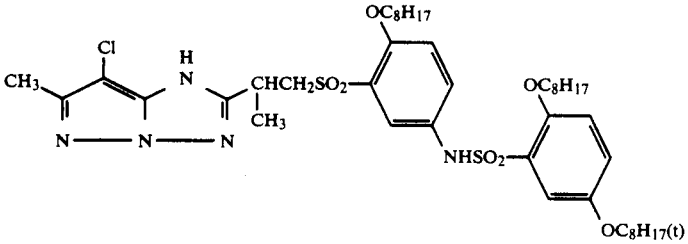
62
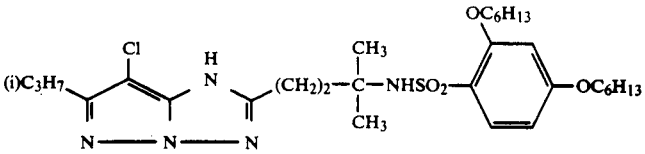

-continued
63
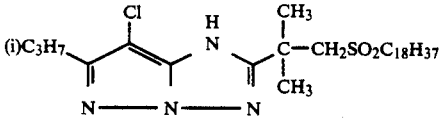
64
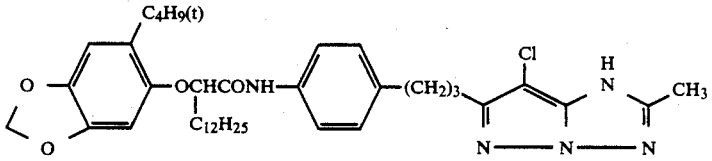
65
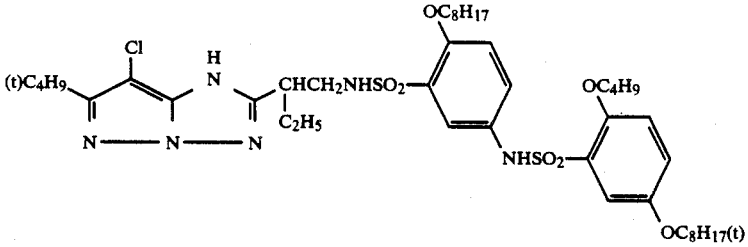
66
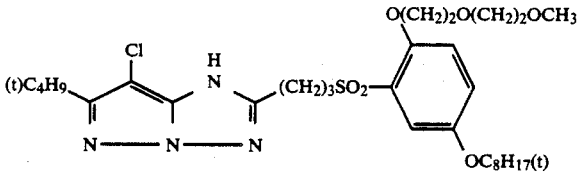
67
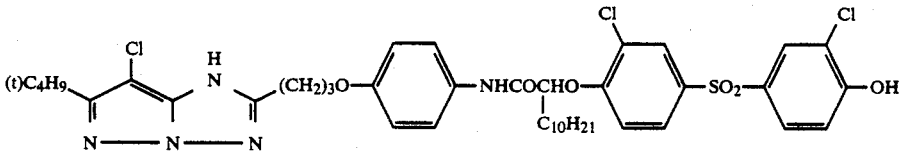
68
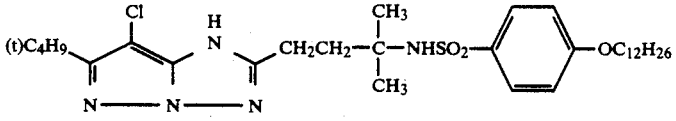
69
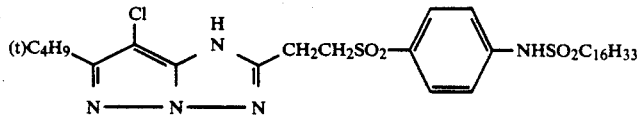
70
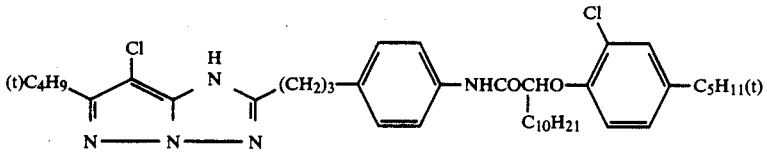
71
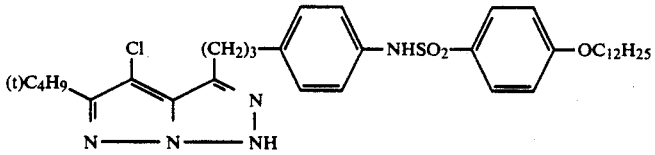

-continued

72

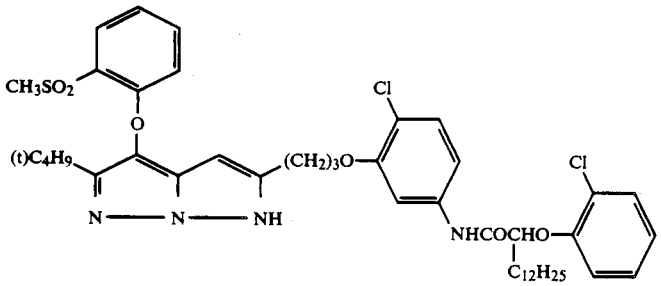

73

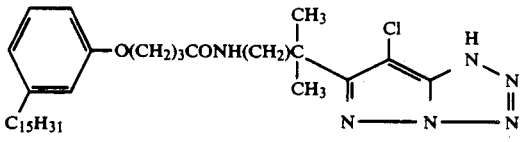

74

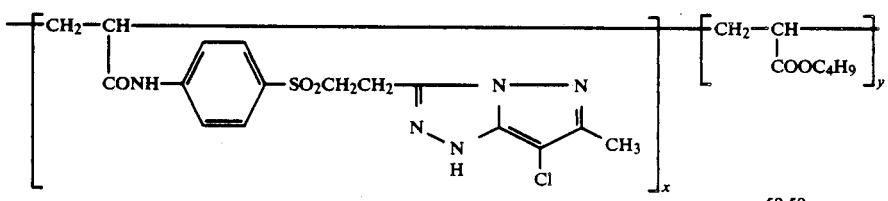

x:y = 50:50

75

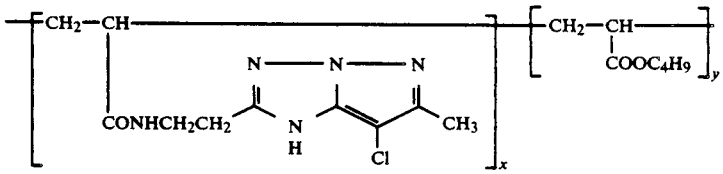

x:y = 50:50

76

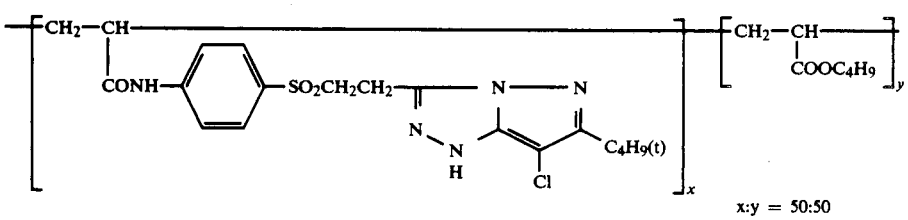

x:y = 50:50

77

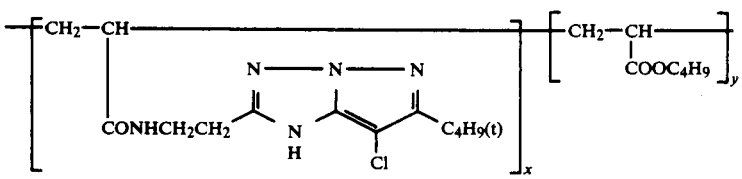

x:y = 50:50

In addition to the above representative exemplary compounds according to the present invention, specific exemplary compounds according to the present invention may be mentioned, among the compounds described on pages 66 to 122 of Japanese Provisional Patent Publication No. 166339/1987, the compounds represented by Nos. 1 to 4, 6, 8 to 17, 19 to 24, 26 to 43, 45 to 59, 61 to 104, 106 to 121, 123 to 162 and 164 to 223.

Also, the above couplers can be synthsized by referring to Journal of the Chemical Society, Perkin I (1977), pp. 2047 to 2052, U.S. Pat. No. 3,725,067 and Japanese Provisional Patent Publications Nos. 99437/1984, 42045/1983, 162548/1984, 171956/1984, 33552/1985, 43659/1985, 172982/1985 and 190779/1985.

The coupler of the present invention can be used in an amount generally within the range of from $1\times10^{-3}$ mole to 1 mole, preferably from $1\times10^{-2}$ mole to $8\times10^{-1}$ mole per one mole of the silver halide.

Also, the coupler of the present invention can be used in combination with other kinds of magenta couplers.

In the present invention, "processing with stabilizing solution substituted for water washing" refers to processing for stabilizing processing in which stabilizing processing is performed immediately after processing with a processing solution having fixing ability without performing substantially water washing processing, and the processing solution to be used for said stabilizing processing is called stabilizing solution substituted for water washing, and the processing tank is called stabilizing bath (tank) substituted for water washing or stabilizing bath (tank).

In the present invention, the stabilizing bath substituted for water washing may be one tank, but desirably 2 to 3 tanks, but preferably at most 9 tanks or less. That is, if the amount supplemented is the same, the concentration of contamination component in the final stabilizing bath substituted for water washing becomes lower as the number of the tanks is more.

As described above, processing with the stabilizing solution substituted for water washing of the present invention is performed after processing with a processing solution having fixing ability.

In the present invention, as the compound preferably used in the stabilizing solution substituted for water washing, there may be included chelating agents having a chelating stabilization constant of 8 or more relative to iron ions, and these may be used preferably for accomplishing the object of the present invention.

Here, the chelating stabilization constant means the constant generally known in the art from L. G. Sillen-A. E. Martell, "Stability Constants of Metal Ion Complexes", The Chemical Society, London (1964), S. Chaberek-A. E. Martell, "Organic Sequestering Agents", Wiley (1959).

As the chelating agent having a chelate stabilizing constant of 8 or more relative iron ions preferably used in the stabilizing solution substituted for water washing of the present invention, there may be included organic carboxylic acid chelating agents, organic phosphoric acid chelating agents, inorganic phosphoric acid chelating agents, polyhydroxy compounds, etc. The above ison ions mean ferric ions ($Fe^{3+}$).

Specific exemplary compound of the chelating agent having a chelating stabilization constant of 8 or more relative to ferric ions may include the following compounds, but the present invention is not limited to these. That is, there may be included ethylenediamineorthohydroxyphenylacetic acid, diaminopropanetetraacetic acid, nitrilotriacetic acid, hydroxyethylenediaminetriacetic acid, dihydroxyethylglycine, ethylenediaminediacetic acid, ethylenediaminedipropionic acid, iminodiacetic acid, diethylenetriaminepentaacetic acid, hydroxyethyliminodiacetic acid, diaminopropanoltetraacetic acid, transcyclohexanediaminetetraacetic acid, glycoletherdiaminetetraacetic acid, ethylenediaminetetrakismethylenephosphonic acid, nitrilotrimethylenephosphonic acid, 1-hydroxyethylene-1,1-diphosphonic acid, 1,1-diphosphonoethane-2-carboxylic acid, 2-phosphonobutane-1,2,4-tricarboxylic acid, 1-hydroxy-1-phosphonopropane-1,2,3-tricarboxylic acid, catechol-3,5-diphosphonic acid, sodium pyrophosphate, sodium tetrapolyphosphate, sodium hexamethaphosphate, particularly preferably diethylenetriaminepentaacetic acid, nitrilotriacetic acid, nitrilotrimethylenephosphonic acid, 1-hydroxyethylidene-1,1-diphosphonic acid, etc. Among them, 1-hydroxyethylidene-1,1-diphosphonic acid may be most preferably used.

The amount of the above chelating agent used may be preferably 0.01 to 50 g per one liter of the stabilizing solution substituted for water washing, more preferably in the range of 0.05 to 50 g.

Further, as the compound to be added in the solution substituted for water washing in the present invention, ammonium compounds may be included as particularly preferred compounds.

These are supplied from various ammonium salts of inorganic compounds, and specific examples may include ammonium hydroxide, ammonium bromide, ammonium carbonate, ammonium chloride, ammonium hypophosphate, ammonium phosphate, ammonium phosphite, ammonium fluoride, acidic ammonium fluoride, ammonium fluoroborate, ammonium arsenate, ammonium hydrogencarbonate, ammonium sulfate, ammonium iodide, ammonium nitrate, ammonium pentaborate, ammonium acetate, ammonium adipate, ammonium laurintricarboxylate, ammonium benzoate, ammonium carbamate ammonium citrate, ammonium diethyldithiocarbamate, ammonium formate, ammonium hydrogenmaleate, ammonium hydrogensuccinate, ammonium phthalate, ammonium hydrogentartarate, ammonium thiosulfate, ammonium sulfite, ammonium ethylenediaminetetraacetate, ammonium ferric ethylenediaminetetraacetate, ammonium lactate, ammonium malate, ammonium maleate, ammonium oxalate, ammonium phthalate, ammonium picrate, ammonium pyrrolidinedithiocarbamate, ammonium salicylate, ammonium succinate, ammonium sulfanilate, ammonium tartarate, ammonium thioglycolate, 2,4,6-trinitrophenolammonium, etc. Among these ammonium compounds, particularly ammonium thiosulfate is preferred in accomplishing the effect of the present invention.

The amount of the ammonium compound added may be preferably $1.0\times10^{-5}$ or more, more preferably 0.001 to 5.0 mole per one liter of the stabilizing solution, further preferably 0.002 to 1.0 mole.

It is also desirable to incorporate a sulfite in the stabilizing solution substituted for water washing in the present invention within the range which is not opposite to the object of the present invention, namely within the range wherein no generation of bacteria, etc. occurs.

In the present invention, as the sulfite to be incorporated in the stabilizing solution substituted for water washing, any of organic and inorganic materials, etc. may be employed so long as sulfite ions can be released, but preferably inorganic salts. Preferred specific compounds may include sodium sulfite, potassium sulfite, ammonium sulfite, ammonium bisulfite, potassium bisulfite, sodium bisulfite, sodium metabisulfite, potassium metabisulfite, ammonium metabisulfite and hydrosulfite, sodium carthalaldehydebisbisulfite, sodium succinatealdehydebisbisulfate, etc.

The above sulfite should be preferably added in an amount of at least $1.0\times10^{-5}$ mole/liter, more preferably $5\times10^{5}$ mole/liter in the stabilizing solution substituted for water washing. The addition method may be by way of direct addition into the stabilizing solution substituted for water washing, but it is preferably added in the supplemental stabilizing solution substituted for water washing.

The stabilizing solution substituted for water washing to be used in the present invention should desirably contain an antifungal agent, whereby sulfidization prevention and image storability can be more improved.

Preferably antifungal agent to be added in the stabilizing solution of the present invention may include sorbic acid, benzoic acid type compounds, phenol type compounds, thiazole type compounds, pyridinium type compounds, guanidine type compounds, carbamate type compounds, triazole type compounds, morpholine type compounds, quaternary phosphonium compounds, ammonium type compounds, urea type compounds, isoxazole type compounds, propanolamine type compounds, sulfamide type compounds, pyronon type compounds and amino type compounds.

The above benxoic acid type compounds may be salicylic acid, hydroxybenzoic acid and ester compounds of hydroxybenzoic acid such as methyl ester, ethyl ester, propyl ester, butyl ester, etc., but preferably n-butyl ester, isobutyl ester, propyl ester of hydroxybenzoic acid and salicylic acid, more preferably a mixture of the three kinds of said hydroxybenzoic acid esters.

The phenolic compounds may be a compound which may have a halogen atom, a nitro group, a hydroxyl group, a carboxylic acid group, an amino group, an alkyl group (particularly alkyl group having 1 to 6 carbon atoms) or a phenyl group, etc. as the substituent, and preferably orthphenylphenol and orthocyclohexylphenol, nitrophenol, chlorophenol, cresol, guaiacol, aminophenol, phenol, etc.

The thiazole type compounds may be a compound having a nitrogen atom and a sulfur atom in a 5-membered ring, preferably 1,2-benzisothiazolin-3-one, 2-methyl-4-isothiazolin-3-one, 2-octyl-4-isothiazolin-3-one, 5-chloro-2-methyl-4-isothiazolin-3-one, 2-(4-thiazolyl)benzimidazole.

The pyridinium type compounds may include specifically 2,6-dimethylpyridine, 2,4,6-trimethylpyridine, sodium-2-pyridinthiol-1-oxide, etc., and preferably sodium-2-pyridinthiol-1-oxide.

The guanidine type compounds may be specifically cyclohexydine, polyhexamethylenebiguanidine hydrochloride, dodecylguanidine hydrochloride, etc., and preferably dodecylguanidine and salts thereof.

The carbamate type compounds may be specifically methyl-1-(butylcarbamoyl)-2-benzimidazolecarbamate, methylimidazolecarbamate, etc.

The morpholine type compounds may be specifically 4-(3-nitrobutyl)morpholine, 4-(3-nitrobutyl)morpholine, etc.

The quaternary phosphonium type compounds may be specifically tetraalkylphosphonium salts, tetraalkoxyphosphonium salts, etc., and preferably tetraalkylphosphonium salt. More specifically, preferred compounds are tri-n-butyltetradecylphosphonium chloride and triphenylnitrophenylphosphonium chloride.

Specific examples of the quaternary ammonium type compounds may be include benzalkonium salts, benzethonium salts, tetraalkylamminium salts, alkylpyridium salts, etc., more specifically dodecyldimethylbenzylammonium chloride, dodecyldimethylammonium chloride, laurylpyridinium chloride, etc.

The urea type compounds may be specifically N-(3,4-dichlorophenyl)-N'-(4-chlorophenyl)urea, N-(3-trifluoromethyl)-N'-(4-chlorophenyl)urea, etc.

The isoxazole type compounds may be specifically 3-hydroxy-5-methyl-isoxazole, etc.

The propanolamino type compounds may include n-propanols and isopropanols, specifically DL-2-benzylamino-1-propanol, 3-diethylamino-1-propanol, 2-dimethylamino-2-methyl-1-propanol, 3-amino-1-propanol, idopropanolamine, diisopropanolamine, N,N-dimethyl-isopropanolamine, etc.

Specific examples of the sulfamide type compounds may include o-nitrobenzenesulfamide, p-aminobenzenesulfamide, fluorinated sulfamide, 4-chloro-3,5-dinitrobenzenesulfamide, α-amino-p-toluenesulfamide, sulfanylamide, acetosulfaguanidine, sulfathiazole, sulfadiazine, suflamerazine, sulfamethazine, sulfaisoxazole, homosulfamine, sulfamidine, sulfaguanidine, sulfamethizole, sulfapyrazine, phthalisosulfathiazole, succinylsulfathiazole, etc.

The pyronone type compounds may be specifically dehydroacetic acid, etc.

The amino acid type compounds may be N-lauryl-β-alanine.

The triazole type compounds may be specifically 2-aminotriazole, benzotriazole and 5-methyl-benzotriazole.

Among the above antifungal agent added in the stabilizing solution may be preferably within the range of 0.001 to 30 g, more preferably 0.003 to 5 g per one liter of the stabilizing solution.

The pH of the stabilizing solution to be used in the present invention is not particularly limited, but preferably within the range of pH 0.5 to 12.0, more preferably pH 5.0 to 9.0, particularly preferably pH 6.0 to 9.0.

The amount of the stabilizing solution of the present invention supplemented may be preferably 3000 ml or less, more preferably 500 ml or less, particularly preferably in the range of 50 ml to 500 ml, per 1 $m^2$ of the light-sensitive material.

The stabilizing solution in the present invention should preferably contain a metal salt in combination with the chelating agent.

Such metal salts may be metal salts of Ba, Ca, Ce, Co, In, La, Mn, Ni, Bi, Pb, Sn, Zn, Ti, Zr, Mg, Al or Sr, and they can be supplied as halides, hydroxides, inorganic salts such as sulfates, carbonates, phosphates, acetates, etc. or water-soluble chelating agent. The amount of the metal salt used may be within the range of $1\times10^{-4}$ to $1\times10^{-1}$ mole, preferably $4\times10^{-4}$ to $2\times10^{-2}$ mole per one liter of the stabilizing solution.

The processing method of the present invention is color developing—bleach-fixing—stabilizing and the total time of the processing may be particularly preferably within 6 minutes for the present invention, more preferably within 5 minutes, particularly preferably within the range from 2 minutes to 3 minutes and 30 seconds.

As other compounds which can be further added into the stabilizing solution substituted for water washing in the present invention, there may be included organic acids (citric acid, acetic acid, succinic acid, oxalic acid, benzoic acid, etc.), pH buffering agents (phosphoric acid, borate, hydrochloric acid, sulfuric acid, etc.) or surfactants, etc., and the amount of these compounds added may be within the range which is necessary for maintaining the pH of the stabilizing solution substituted for water washing according to the present invention and will not affect badly stability and generation of precipitates during storage of color photographic images, and any compound may be used according to any combination.

The processing temperature during stabilizing processing may be 50° C. or lower, particularly preferably 15° C. to 50° C., more preferably in the range of 30° C. to 45° C. The processing time should be preferably as short as possible from the standpoint of rapid processing, but generally 20 seconds to 10 minutes, most preferably 1 minute to 5 minutes. In the case of stabilizing processing of a plural number of tanks, it is preferred that the tank in the earlier stage should be processed with shorter time, and the processing time should be longer for the tanks in the later stages, particularly, it is desirable to perform form processing successively with processing time increased by 20% to 50% relative to the preceding tank. After the stabilizing processing of the present invention, no water washing processing is required at all, but rinsing, surface washing, etc. with a small amount of water within the very short time can be optionally performed, if necessary.

The method for feeding the stabilizing solution substituted for water washing in the stabilizing processing step according to the present invention, in the case when a multi-tank counter-current system is employed, should be preferably practiced by feeding the solution to the later bath and permitting the solution to be overflowed from the earlier bath. Of course, processing is possible in a single tank. As the method for adding the above compounds, etc., there are various methods such as the method in which they are added as concentrated solutions into the stabilizing tank, or the method in which the above compounds and other additives are added in the stabilizing solution substituted for water washing to be fed into the stabilizing solution and this is made the feeding solution to the stabilizing supplemental solution substituted for water washing, etc., but they can be added according to any addition method.

Next, the light-sensitive material according to the present invention is to be described supplementarily.

The light-sensitive material according to the present invention may be the internal developing system containing couplers in the light-sensitive material (see U.S. Pat. Nos. 2,376,679 and 2,801,171) or otherwise the external developing system containing couplers in the developer (see U.S. Pat. Nos. 2,252,718, 2,5923,243 and 2,590,970). As the coupler, any one generally known in the field of this art can be used. For example, as cyan couplers, those based on the naphthol or phenol structure capable of forming indoaniline dyes by coupling may be included; as the magenta coupler, those having 5-pyrazolone ring having active methylene group as the skeltal structure and pyrazoleazole type couplers; as the yellow coupler, those of benzoylacetanilide structure, etc. either having or not having substituents at the coupling position can be employed. As such couplers, either the so-called divalent type coupler and tetravalent coupler can be applied.

The silver halide emulsion available in the present invention may be any silver halide of silver chloroiodide, silver iodobromide, silver chloroiodobromide containing 0.5 mole % or more of silver iodide, but preferably silver iodobromide containing 0.5 mole % or more of silver iodide. It may also be a flat plate silver halide emulsion, or core/shell emulsion. As the protective colloid for these silver halides, other than natural product such as gelatin, etc. various colloids obtained by synthesis can be used. In the silver halide emulsion, conventional additives for photography such as stabilizer, sensitizer, film hardener, sensitizing dye, surfactant, etc. may be contained.

As the light-sensitive material to be used in the present invention, all of the light-sensitive materials applicable for the processing step having the color developing step (including activator processing) and the bleach-fixing step such as color negative film, color paper, color reversal film, color reversal paper, etc. can be used, but color negative film for photographing is the most preferred.

In the color developing solution of the present invention, it is preferred to use p-phenylenediamine type color developing agents, and they are generally used in the form of a salt, for example, in the form of hydrochlorides or sulfates since they are more stable than in the free form. Also, said p-phenylenediamine type color developing agent is generally used in concentration of about 0.5 g to about 30 g per one liter of the color developing solution.

In the present invention, particularly useful p-phenylenediamine type color developing agents are aromatic primary amine color developing agents having an amino group which has at least one water-soluble group, and particularly preferred is the compound represented by the following formula (XIV):

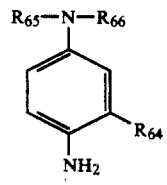

(XIV)

In the formula, $R_{64}$ represents a hydrogen atom, a halogen atom or an alkyl group, and the alkyl group is a straight or branched alkyl group having 1 to 5 carbon atoms, which may have a substituent or substituents. $R_{65}$ and $R_{66}$ each represent a hydrogen atom, an alkyl group or an aryl group, and these groups may have a substituent or substituents, and when they are alkyl groups, alkyl groups substituted by an aryl group are preferred. And at least one of $R_{65}$ and $R_{66}$ is an alkyl group which is substituted by a water soluble group such as a hydroxy group, a carboxylic acid group, a sulfonic acid group, an amino group, a sulfonamido group, or $(CH_2)_tO)_rR_{67}$. The alkyl group may have a further substituent or substituents.

In the above, $R_{67}$ represents a hydrogen atom or an alkyl group, and the alkyl group represents a straight or branched alkyl group having 1 to 5 carbon atoms, and t and r are each an integer of 1 to 5.

Next, representative examples of the compounds represented by the above formula (XIV) are mentioned, but the present invention is not limited by them.

[Exemplary compounds]

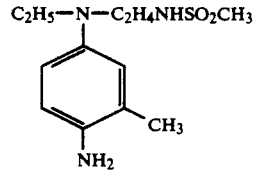

(E-1)

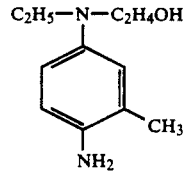

(E-2)

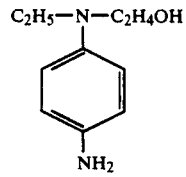

(E-3)

-continued

[Exemplary compounds]

(E-4)

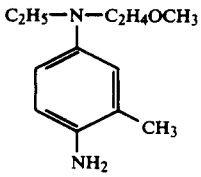

(E-5)

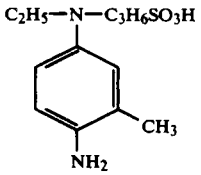

(E-6)

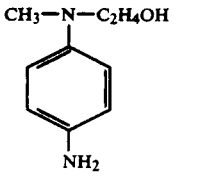

(E-7)

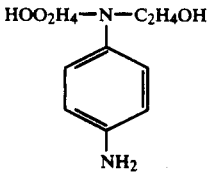

(E-8)

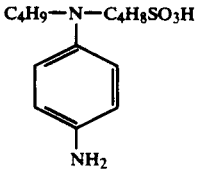

(E-9)

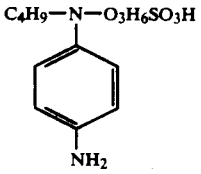

(E-10)

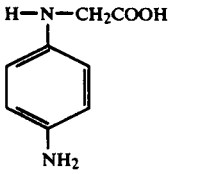

(E-11)

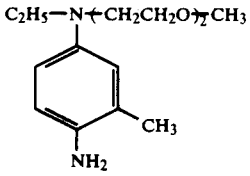

-continued

[Exemplary compounds]

(E-12)

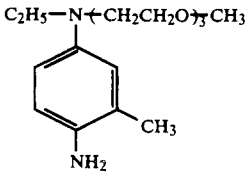

(E-13)

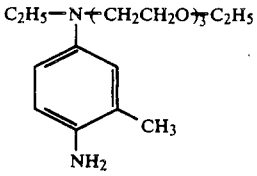

(E-14)

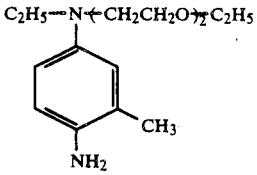

(E-15)

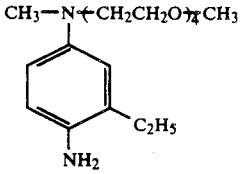

(E-16)

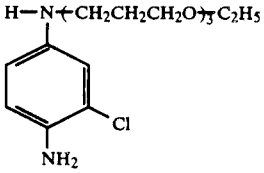

These p-phenylenediamine derivatives represented by the formula (XIV) can be used as salts of organic acids and inorganic salts, and they can be used, for example, hydrochlorides, sulfates, phosphates, p-toluenesulfonates, sulfites, oxalates, benzenedisulfonates, etc. In the present invention, among the p-phenylenediamine derivatives represented by the formula (XIV), when the compound where $R_{65}$ and/or $R_{66}$ is/are $\leftarrow(CH_2\rightarrow_t O\rightarrow_r R_{67}$ (where t, r and $R_{67}$ have the same meanings as defined above), the effects of the present invention can particularly effectively be obtained.

According to the present invention, desilverization can be accomplished rapidly and sufficiently as a matter of course, and it can be provided a desilverization method which can prevent leuco of a cyan dye as well as prevent occurrence of magenta stain. And also, occurrence of drying contamination can be prevented by making stabilizing processing substituted for water washing rapid.

EXAMPLES

The present invention is described in detail by referring to the following Examples, by which the embodiments of the present invention are not limited at all. The amount added is per 100 $cm^2$ unless otherwise particularly noted. In the following, stabilization substituted for water washing is called water washing-free stabilization.

EXAMPLE 1

The respective layers shown below were arranged successively from the side of a triacetyl cellulose film support to prepare Sample No. 1. The amount of silver coated was made 80 mg/100 $cm^2$, with the dried film thickness being 25 ↑.

Layer 1 . . . A dispersion of 0.8 g of black colloidal silver exhibiting high absorption at the light of wavelength region of 400 to 700 mm obtained by reduction of silver nitrate with hydroquinone as the reducing agent in 3 g of gelatin was prepared and a halation preventive layer was provided by coating.

Layer 2 . . . Intermediate layer comprising gelatin.

Layer 3 . . . Low sensitivity red-sensitive silver halide emulsion layer containing 1.5 g of low sensitivity red-sensitive silver iodobromide emulsion (AgI: 7 mole %), 1.6 g of gelatin and 0.4 g of tricresyl phosphate (hereinafter abbreviated to TCP) containing 0.85 g of the cyan coupler (C-28) of the present invention, 0.030 g of 1-hydroxy-4-[4-(1-hydroxy-8-acetamido-3,6-disulfo-2-naphthylazo)phenoxy]-N-[δ-(2,4-di-t-amylphenoxy)-butyl]-2-naphthoamide-disodium (hereinafter called "colored cyan coupler (CC-1)") dissolved therein.

Layer 4 . . . High sensitivity red-sensitive silver halide emulsion layer containing 1.3 g of high sensitivity red-sensitive silver iodobromide emulsion (AgI: 6 mole %), 1.3 g of gelatin and 0.17 g of TCP containing 0.28 g of the cyan coupler (C-28) and 0.020 g of the colored cyan coupler (CC-1) dissolved therein.

Layer 5 . . . Intermediate layer containing 0.04 g of di-n-butylphthalate (hereinafter called DBP) containing 0.08 g of 2,5-di-t-octylhydroquinone (hereinafter called "stain preventive (HQ-1)") dissolved therein and 1.2 g of gelatin.

Layer 6 . . . Low sensitivity green-sensitive silver halide emulsion layer containing 1.5 g of high sensitivity green-sensitive silver iodobromide emulsion (AgI: 6 mole %), 1.7 g of gelatin and 0.3 g of TCP containing 3 kinds of couplers of 0.32 g of 1-(2,4,6-trichlorophenyl)-3-[3-(2,4-di-t-amylphenoxyacetamido)benzeneamido]-5-pyrazolone (hereinafter called "magenta coupler (M-1)"), 0.20 g of 4,4-methylenebis-11-(2,4,6-trichlorophenyl)-3-[3-(2,4-di-tamylphenoxyacetamido)-benzeneamido]-5-pyrazolone (hereinafter called "magenta coupler (M-2)") and 0.066 g of 1-(2,4,6-trichlorophenyl)-4-(1-naphthylazo)-3-(2-chloro-5-octadecenylsuccinimidoanilino)-5-pyrazolone (hereinafter called "colored magenta coupler (CM-1)") dissolved therein.

Layer 7 . . . High sensitivity green-sensitive silver halide emulsion layer containing 1.5 g of high sensitivity green-sensitive silver iodobromide emulsion (AgI: 8 mole %), 1.9 g of gelatin and 0.12 g of TCP containing 0.10 g of the magenta coupler (M-1), 0.098 g of the magenta coupler (M-2) and 0.049 g of the colored magenta coupler (CM-1) dissolved therein.

Layer 8 . . . Yellow filter layer containing 0.2 g of yellow colloidal silver, 0.11 g of DBP containing 0.2 g of the stain preventive (HQ-1) dissolved therein and 2.1 g of gelatin.

Layer 9 . . . Low sensitivity blue-sensitive silver halide emulsion layer containing 0.95 g of low sensitivity blue-sensitive silver iodobromide emulsion (AgI: 7 mole %), 1.9 g of gelatin and 0.93 g of DBP containing 1.84 g of α-[4-(1-benzyl-2-phenyl-3,5-dioxo-1,2,4-triazolydinyl)]-α-pivaloyl-2-chloro-5-[γ-(2,4-di-t-amylphenoxy)butanamido]acetanilide (hereinafter called "yellow coupler (Y-1)"}dissolved therein.

Layer 10 . . . High sensitivity blue-sensitive silver halide emulsion layer containing 1.2 g of high sensitivity blue-sensitive silver iodobromide emulsion (AgI: 6 mole %), 2.0 g of gelaine and 0.23 g of DBP containing 0.46 g of the yellow coupler (Y-1) dissolved therein.

Layer 11 . . . The second protective layer comprising gelatin.

Layer 12 . . . The first protective layer containing 2.3 g of gelatin.

These samples were cut into pieces, and by use of the pieces to which wedge-type exposure was given in a conventional manner were subjected to processing according to the following steps.

Processing step 1 (comparative processing)

| Processing step | Processing temperature | Processing time | Supplemented amount* |
|---|---|---|---|
| 1. Color developing | 37.8° C. | 3 min 15 sec | 55 ml |
| 2. Bleach-fixing | 37.8° C. | 5 min | 34.5 ml |
| 3. Washing | | 2 min 10 sec | |
| 4. Stabilizing | 30 to 34° C. | 1 min 5 sec | 34.5 ml |
| 5. Drying | | | |

Processing step 2 (processing of the present invention)

| Processing step | Processing temperature | Processing time | Supplemented amount* |
|---|---|---|---|
| 1. Color developing | 37.8 ° C. | 3 min 15 sec | 55 ml |
| 2. Bleach-fixing (1) | 37.8 ° C. | 3 min | — |
| 3. Bleach-fixing (2) | 37.8 ° C. | 2 min | 34.5 ml |
| 4. Washing | | 2 min 10 sec | |
| 5. Stabilizing | 30 to 34 ° C. | 1 min 5 sec | 34.5 ml |
| 6. Drying | | | |

(note)
Bleach-fixings (1) and (2) are made counter-current system and supplemented from the second bath.
*per one film of 24 sheets photographying.

The color developing solution, the bleach-fixing solution and the stabilizing solution used are as shown below.

[Color developing solution]

| | |
|---|---|
| Potassium carbonate | 30 g |
| Sodium hydrogen carbonate | 2.5 g |
| Sodium sulfite | 5.0 g |
| Sodium bromide | 1.2 g |
| Potassium iodide | 2 mg |
| Hydroxylamine sulfate | 2.5 g |
| Sodium chloride | 0.6 g |
| Sodium diethylenetriaminepentaacetate | 2.0 g |
| N-ethyl-N-β-hydroxyethyl-3-methyl-4-amino-aniline sulfate | 4.5 g |
| Potassium hydroxide | 1.2 g |

(made up to one liter with addition of water and adjusted to pH 10.06 with sodium hydroxide or 20% sulfuric acid)

[Color developing replenishing solution]

| | |
|---|---|
| Potassium carbonate | 30 g |
| Sodium sulfite | 5.0 g |
| Hydroxylamine sulfate | 3.0 g |
| Diethylenetriamine pentaacetic acid | 3.0 g |
| Potassium bromide | 0.9 g |
| potassium hydroxide | 1.4 g |
| 6-Aminopurine | 0.06 g |
| N-ethylene-N-β-hydroxyethyl-3-methyl-4-aminoaniline sulfate | 5.2 g |

(made up to one liter with addition of water and adjusted to pH 10.10 with potassium hydroxide)

[Bleach-fixing solution and Bleach-fixing replenishing solution]

| | |
|---|---|
| Ammonium diethylenetriaminepentaacetate | 2.0 g |
| Ferric diammonium diethylenetriamine-pentaacetate | 150 g |
| Ammonium thiosulfate (70% aqueous solution) | 250 ml |
| Ammonium sulfite | 10 g |
| Mercaptobenztriazole | 2.5 g |

-continued

| | |
|---|---|
| Aqueous ammonia (made up to one liter with addition of water and adjusted to pH 7.0 with acetic acid and aqueous ammonia) | 7.3 ml |
| [Stabilizing solution and Stabilizing replenishing solution] | |
| Formalin (37% aqueous solution) | 2 ml |
| Konidax (trade name, produced by Konica Corporation) | 5 ml |
| Ammonium acetate (made up to one liter with addition of water) | 1 g |

According to the above processing steps, the light-sensitive material was 0.3R treated and then adjusted the silver amount so as to those as described in Table 1. the silver was added as silver bromide.

Next, light-sensitive material samples were processed according to the above, and a residual silver amount (mg/dm$^2$) at the maximum density portion of the Sample after processing was measured by the fluoroescent X-ray method, Further, a cyan dye density (transmitted density) was measured by using Sakura photodensitomer PDA-65 (trade name, produced by Konica Corporation). Then, by using the value, the same sample was measured according to the conventional method and a color restration rate was calculated from a cyan dye minimum density after treated with a 3% red prussiate solution at room temperature for 3 minutes as 100.

The results are all shown in Table 1.

TABLE 1

| Sample No | Silver amount in bleach-fixing solution (mole/liter): Comparative processing | Processing of this invention: 1st tank | Processing of this invention: 2nd tank | Residual silver amount (mg/100 cm$^2$) | Color restration rate (%) | Remarks |
|---|---|---|---|---|---|---|
| 1 | 0. 10 | — | — | 2.39 | 80 | Comparative |
| 2 | — | 0.02 | 0.08 | 2.15 | 84 | Comparative |
| 3 | — | 0 05 | 0.05 | 1.03 | 91 | Comparative |
| 4 | — | 0.06 | 0.04 | 0.70 | 96 | This invention |
| 5 | — | 0.07 | 0.03 | 0.57 | 98 | This invention |
| 6 | — | 0.08 | 0.02 | 0.42 | 99 | This invention |

As clearly seen from the results in Table 1, when the bleach-fixing bath is one tank (Sample No. 1), or when the silver amount of the first tank is low even when it is two tanks counter-current system (Samples No. 2 and No. 3), the residual silver amounts are high and it cannot be said that the color restration rates are high. Here, the reason why the desilverization property and color restration rate are both low nevertheless the silver concentration in the first tank is low and the processing time is longer than the second tank, it can be considered that the color developing solution is probably incorporated into the first tank of the bleach-fixing bath with a large amount.

EXAMPLE 2

By using the bleach-fixing solution used in Example 1, and further by using silver powder to form 20 g of ferrous complex salt and adjusted the silver amount so as to become the same as that of Sample No. 5 of Example 1.

Also, the cyan couplers in Layers 3 and 4 of the light-sensitive material were replaced by those as shown in Table 2 (equimolar amount), the same evaluations were ed out as in Example 1. A red minimum transmitted density (cyan stain) was also measured.

The results are shown in Table 2.

TABLE 2

| Sample No. | Cyan coupler | Residual silver amount (mg/100 cm$^2$) | Color restration rate (%) | Cyan* minimum transmitted density | Remarks |
|---|---|---|---|---|---|
| 7 | Comparative coupler 1 | 0.67 | 81 | 0.15 | Comparative |
| 8 | Comparative coupler 2 | 0.69 | 77 | 0.14 | Comparative |
| 9 | Exemplary compound C-1 | 0.66 | 96 | 0.11 | This invention |
| 10 | Exemplary compound C-2 | 0.66 | 95 | 0.12 | This invention |
| 11 | Exemplary compound C-23 | 0.65 | 95 | 0.12 | This invention |
| 12 | Exemplary compound C-32 | 0.65 | 97 | 0.10 | This invention |
| 13 | Exemplary compound C-36 | 0.65 | 97 | 0.10 | This invention |
| 14 | Exemplary compound C-70 | 0.67 | 96 | 0.11 | This invention |
| 15 | Exemplary compound C-79 | 0.67 | 96 | 0.11 | This invention |
| 16 | Exemplary | 0.65 | 95 | 0.12 | This in- |

TABLE 2-continued

| Sample No. | Cyan coupler | Residual silver amount (mg/100 cm$^2$) | Color restration rate (%) | Cyan* minimum transmitted density | Remarks |
|---|---|---|---|---|---|
| | compound C-96 | | | | vention |

*Cyan stain

Comparative coupler 1

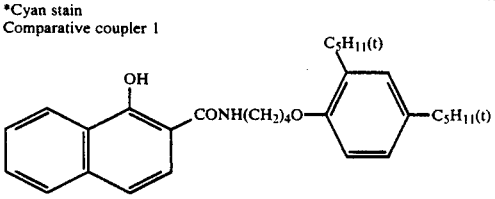

Comparative coupler 2

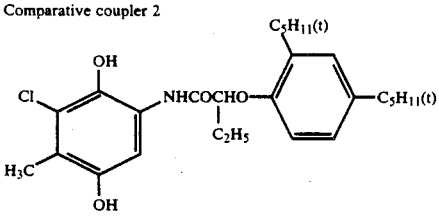

As clearly seen from the results in Table 2, even if 20 g or so of the ferrous complex salt is formed, it can be understood that the color restration rate is high and no bad effect exerts to desilverization by using the coupler of the present invention.

Also, investigation was carried out concerning ammonium ferric ethylenediaminetetraacetate, and the substantially the same results can be obtained.

EXAMPLE 3

The bleaching agent of the bleach-fixing solution of the present invention and the free chelating agent used in Example 1 were replaced by those as shown in Table 3 and the same treatment was carried out as in Example 1, and further KI (potassium iodide) was added as shown in Table 3, the same evaluations were carried out as in Example 1. Provided that the silver amount in the bleach-fixing solution of the present invention was the same as that described in Sample No. 4.

The results are shown in Table 3.

TABLE 3

| Sample No. | Bleaching agent Iron diethylenetriaminepentaacetate mole/liter | Free chelating agent Sodium diethylenetriaminepentaacetate mole/liter | Free chelatingagent / Bleaching agent (× 100) mole % | First tank / Second tank KI mole/liter | Desilverization property | Color restration rate |
|---|---|---|---|---|---|---|
| 17 | 0.20 | 0.005 | 2.5 | *0.002 / **— | 0.92 | 86 |
| 18 | 0.26 | 0.0065 | 2.5 | 0.002 / — | 0.85 | 90 |
| 19 | 0.32 | 0.008 | 2.5 | 0.002 / — | 0.72 | 95 |
| 20 | 0.32 | 0.016 | 5.0 | 0.002 / — | 0.75 | 92 |
| 21 | 0.32 | 0.0224 | 7.0 | 0.002 / — | 0.77 | 90 |
| 22 | 0.32 | 0.032 | 10.0 | 0.002 / — | 0.82 | 84 |
| 23 | 0.32 | 0.008 | 2.5 | 0.005 / 0.005 | 0.95 | 94 |
| 24 | 0.32 | 0.008 | 2.5 | 0.007 / 0.003 | 0.86 | 95 |
| 25 | 0.32 | 0.008 | 2.5 | 0.009 / 0.001 | 0.82 | 95 |

*determined value after 0.2R treatment,
**rounded off to the second decimal place As clearly seen from Table 3, in order to improve both of desilverization property and color restration rate, it is preferred that the bleaching agent is 0.25 mole or more and the free chelating agent to the bleaching agent is 7 mole % or less. Also, as the means for improving desilverization property, it can be understood when the KI at the second tank to the KI at the first tank is 50% or less, it is preferred.

EXAMPLE 4

The respective layers shown below were arranged successively from the side of a triacetyl cellulose film support to prepare Sample No. 26. The amount of silver coated was made 80 mg/100 cm$^2$, with the dried film thickness being 25 ↑ m.

Layer 1 . . . The same halation preventive layer as Layer 1 in Example 1.

Layer 2 . . . Intermediate layer comprising gelatin.

Layer 3 . . . Low sensitivity red-sensitive silver halide emulsion layer containing 1.5 g of low sensitivity red-sensitive silver iodobromide emulsion (AgI: 7 mole %), 1.6 g of gelatin and 0.4 g of TCP containing 0.85 g of 1-hydroxy-4-(β-methoxyethylaminocarbonylmethoxy)-N-[δ-2,4-di-t-amylphenoxy)butyl]-2-naphthoamide (hereinafter referred to "cyan coupler (C-120)") and 0.030 g of the colored cyan coupler CC-1 used in Example 1 dissolved therein.

Layer 4 . . . High sensitivity red-sensitive silver halide emulsion layer containing 1.3 g of high sensitivity red-sensitive silver iodobromide emulsion (AgI: 6 mole %), 1.3 g of gelatin and 0.17 g of TCP containing 0.28 g of the cyan coupler (C-120) and 0.020 g of the colored cyan coupler (CC-1) dissolved therein.

Layer 5 . . . Intermediate layer containing 0.04 g of DBP containing 0.08 g of stain preventive (HQ - 1) dissolved therein and 1.2 g of gelatin.

Layer 6 . . . Low sensitivity green-sensitive silver halide emulsion layer containing 1.6 g of high sensitivity green-sensitive silver iodobromide emulsion (AgI: 6 mole %), 2.0 g of gelatin and 0.45 g of TCP containing 2 kinds of couplers of 0.48 g of the magenta coupler of the present invention (exemplary compound 4) and 0.066 g of the colored magenta coupler (CM-1) used in Example 1 dissolved therein.

Layer 7 . . . High sensitivity green-sensitive silver halide emulsion layer containing 1.5 g of high sensitivity green-sensitive silver iodobromide emulsion (AgI: 8 mole %), 1.9 g of gelatin and 0.20 g of TCP containing 0.20 g of the magenta coupler of the present invention (exemplary compound 4) and 0.049 g of the colored magenta coupler (CM-1) dissolved therein.

Layer 8 . . . Yellow filter layer containing 0.2 g of yellow colloidal silver, 0.11 g of DBP containing 0.2 g of the stain preventive (HQ-1) dissolved therein and 2.1 g of gelatin.

Layer 9 . . . Low sensitivity blue-sensitive silver halide emulsion layer containing 0.95 g of low sensitivity blue-sensitive silver iodobromide emulsion (AgI: 7 mole %), 1.9 g of gelatin and 0.93 g of DBP containing 1.84 g of the yellow coupler (Y-1) used in Example 1 dissolved therein.

Layer 10 . . . High sensitivity blue-sensitive silver halide emulsion layer containing 1.2 g of high sensitivity blue-sensitive silver iodobromide emulsion (AgI: 6 mole %), 2.0 g of gelatin and 0.23 g of DBP containing 0.46 g of the yellow coupler (Y-1) used in Example 1 dissolved therein.

Layer 11 . . . The second protective layer comprising gelatin.

Layer 12 . . . The first protective layer containing 2.3 g of gelatin.

These samples were cut into pieces, and by use of the pieces to which wedge-type exposure was given in a conventional manner were subjected to the same processing as in Example 1.

The color developing solution, the bleach-fixing solution and the stabilizing solution used are the same as in Example 1.

According to the above processing steps, the light-sensitive material was 0.3R treated and then adjusted the silver amount so as to those as described in Table 1. the silver was added as silver bromide.

Next, light-sensitive material samples were processed according to the above, and a residual silver amount (mg/dm$^2$) at the maximum density portion of the Sample after processing was measured by the fluorescent X-ray method. Further, a magenta dye density (transmitted density) was measured by using Sakura photodensitomer PDA-65 (trade name, produced by Konica Corporation).

The result are all shown in Table 4.

TABLE 4

| Sample No | Silver amount in bleach-fixing solution (mole/liter) Comparative processing | Processing of this invention 1st tank | Processing of this invention 2nd tank | Residual silver amount (mg/100 cm$^2$) | Magenta Dye minimum transmitted density | Remarks |
|---|---|---|---|---|---|---|
| 26 | 0.10 | — | — | 2.35 | 0.36 | Comparative |
| 27 | — | 0.02 | 0.08 | 2.12 | 0.38 | Comparative |
| 28 | — | 0.05 | 0.05 | 1.01 | 0.38 | Comparative |
| 29 | — | 0.06 | 0.04 | 0.68 | 0.38 | This invention |
| 30 | — | 0.07 | 0.03 | 0.56 | 0.38 | This invention |
| 31 | — | 0.08 | 0.02 | 0.41 | 0.38 | This invention |

As clearly seen from the results in Table 4, when the bleach-fixing bath is one tank (Sample No. 26), or when the silver amount of the first tank is low even when it is two tanks counter-current system (Sample Nos. 27 and 28), the residual silver amounts are high and the desilverization properties are bad. Here, the reason why the desilverization property is low nevertheless the silver concentration in the first tank is low and the processing time thereof is longer than the second tank, it can be considered that the color developing solution is probably incorporated into the first tank of the bleach-fixing bath with a large amount.

EXAMPLE 5

By using the bleach-fixing solution used in Example 4, and further by using silver powder to form 20 g of ferrous complex salt and adjusted the silver amount so as to become the same as that of Sample No. 30 of Example 4.

Also, the magenta couplers in Layers 6 and 7 of the light-sensitive material were replaced by those as shown in Table 5 (equimolar amount), the same evaluations were carried out as in Example 4.

The results are shown in Table 5.

TABLE 5

| Sample No. | Magenta coupler | Residual silver amount (mg/100 cm$^2$) | Magenta stain magenta minimum transmitted density | Remarks |
|---|---|---|---|---|
| 32 | Comparative coupler 3 | 0.67 | 0.45 | Comparative |
| 33 | Comparative coupler 4 | 0.69 | 0.44 | Comparative |
| 34 | Exemplary compound 1 | 0.66 | 0.38 | This invention |
| 35 | Exemplary | 0.66 | 0.37 | This in- |

TABLE 5-continued

| Sample No. | Magenta coupler | Residual silver amount (mg/100 cm²) | Magenta stain magenta minimum transmitted density | Remarks |
|---|---|---|---|---|
| | compound 2 | | | vention |
| 36 | Exemplary compound 10 | 0.65 | 0.37 | This invention |
| 37 | Exemplary compound 21 | 0.67 | 0.36 | This invention |
| 38 | Exemplary compound 37 | 0.65 | 0.37 | This invention |
| 39 | Exemplary compound 61 | 0.67 | 0.36 | This invention |
| 40 | Exemplary compound 63 | 0.67 | 0.36 | This invention |
| 41 | Exemplary compound 68 | 0.65 | 0.37 | This invention |

As clearly seen from the results in Table 5, 1 it can be understood that stain of the magenta can be effectively prevented by using the coupler of the present invention.

Also, investigation was carried out with respect to ammonium ferric ethylenediaminetetraacetate in place of ferric diethylenetriaminepentaacetate, and the substantially the same results can be obtained.

EXAMPLE 6

The bleaching agent of the bleach-fixing solution of the present invention and the free chelating agent used in Example 4 were replaced by those as shown in Table 6 and the same treatment was carried out as in Example 4, and further KI (potassium iodide) was added as shown in Table 6, the same evaluations were carried out as in Example 4. Provided that the silver amount in the bleach-fixing solution of the present invention was the same as that described in Sample No. 29.

The results are shown in Table 3.

TABLE 6

| Sample No. | Bleaching agent Iron diethylenetriaminepentaacetate mole/liter | Free chelating agent Sodium diethylenetriaminepentaacetate mole/liter | Free chelating agent / Bleaching agent (× 100) mole % | First tank / Second tank KI mole/liter | Desilverization property |
|---|---|---|---|---|---|
| 42 | 0.20 | 0.005 | 2.5 | *0.002 / **— | 0.90 |
| 43 | 0.26 | 0.0065 | 2.5 | 0.002 / — | 0.84 |
| 44 | 0.32 | 0.008 | 2.5 | 0.002 / — | 0.71 |
| 45 | 0.32 | 0.016 | 5.0 | 0.002 / — | 0.73 |
| 46 | 0.32 | 0.0224 | 7.0 | 0.002 / — | 0.77 |
| 47 | 0.32 | 0.032 | 10.0 | 0.002 / — | 0.81 |
| 48 | 0.32 | 0.008 | 2.5 | 0.005 / 0.005 | 0.94 |
| 49 | 0.32 | 0.008 | 2.5 | 0.007 / 0.003 | 0.85 |
| 50 | 0.32 | 0.008 | 2.5 | 0.009 / 0.001 | 0.82 |

*determined value after 0.2R treatment,
**rounded off to the second decimal place.

Comparative coupler 3

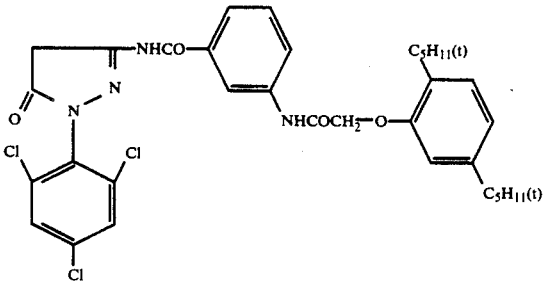

Comparative coupler 4

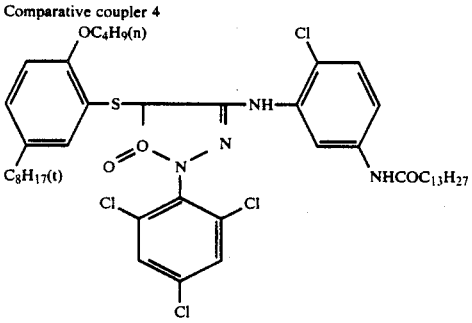

As clearly seen from Table 6, in order to improve desilverization property, it can be good results when the bleaching agent is 0.25 mole or more and the free chelating agent to the bleaching agent is 7.0 mole % or less, and further KI of the second tank to KI of the first tank is 50% or less.

However, with respect to the minimum transmitted density of the magenta dye, there is no substantial difference between Samples.

EXAMPLE 7

With respect to Sample Nos. 32 and 36 used in Example 5, contamination rates of the color developing solution of the first bleach-fixing tank solution were changed as shown in Table 7, and the same evaluations were carried out as in Example 5.

The results are shown in Table 7.

TABLE 7

| Sample No | Magenta coupler | Contamination rate of the color developing solution to bleach-fixing solution | Magenta dye minimum density |
|---|---|---|---|
| 51 | Comparative coupler 3 | 2.5 | 0.42 |
| 52 | Comparative coupler 3 | 5.0 | 0.45 |
| 53 | Comparative coupler 3 | 7.0 | 0.49 |
| 54 | Comparative coupler 3 | 15.0 | 0.56 |
| 55 | Exemplary compound 10 | 2.5 | 0.36 |
| 56 | Exemplary compound 10 | 5.0 | 0.37 |
| 57 | Exemplary compound 10 | 7.0 | 0.37 |
| 58 | Exemplary compound 10 | 15.0 | 0.39 |

As clearly seen from Table 7, when the coupler of the present invention is used, even if contamination of the color developing solution into the bleach-fixing solution becomes remarkable, increase of the minimum transmitted density of the magenta dye is not so remarkable. However, if the comparative coupler other than the present invention is used, accompanying increase of contamination rate, abrupt increase of the minimum transmitted density of the magenta dye can be observed.

EXAMPLE 8

The respective layers shown below were arranged successively from the side of a triacetyl cellulose film support to prepare Sample No. 59. The amount of silver coated was made 80 mg/100 cm$^2$, with the dried film thickness being 25 $\mu$m.

Layer 1 . . . The same halation preventive layer as Layer 1 in Example 1.

Layer 2 . . . Intermediate layer comprising gelatin.

Layer 3 . . . Low sensitivity red-sensitive silver halide emulsion layer containing 1.5 g of low sensitivity red-sensitive silver iodobromide emulsion (AgI: 7 mole %), 1.6 g of gelatin and 0.4 g of TCP containing 0.85 g of the cyan coupler (C - 28) and 0.030 g of the colored cyan coupler CC - 1 used in Example 1 dissolved therein.

Layer 4 . . . High sensitivity red-sensitive silver halide emulsion layer containing 1.3 g of high sensitivity red-sensitive silver iodobromide emulsion (AgI: 6 mole %), 1.3 g of gelatin and 0.17 g of TCP containing 0.28 g of the cyan coupler (C - 28) and 0.020 g of the colored cyan coupler (CC - 1) dissolved therein.

Layer 5 . . . Intermediate layer containing 0.04 g of DBP containing 0.08 g of the stain preventive (HQ - 1) dissolved therein and 1.2 g of gelatin.

Layer 6 . . . Low sensitivity green-sensitive silver halide emulsion layer containing 1.6 g of high sensitivity green-sensitive silver iodobromide emulsion (AgI: 6 mole %), 2.0 g of gelatin and 0.45 g of TCP containing 0.50 g of the magenta coupler of the present invention (exemplary compound 2) and 0.066 g of the colored magenta coupler (CM-1) used in Example 1 dissolved therein.

Layer 7 . . . High sensitivity green-sensitive silver halide emulsion layer containing 1.5 g of high sensitivity green-sensitive silver iodobromide emulsion (AgI: 8 mole %), 1.9 g of gelatin and 0.12 g of TCP containing 0.11 g of the magenta coupler of the present invention (exemplary compound 2) and 0.049 g of the colored magenta coupler (CM-1) dissolved therein.

Layer 8 . . . Yellow filter layer containing 0.2 g of yellow colloidal silver, 0.11 g of DBP containing 0.2 g of the stain preventive (HQ - 1) dissolved therein and 2.1 g of gelatin.

Layer 9 . . . Low sensitivity blue-sensitive silver halide emulsion layer containing 0.95 g of low sensitivity blue-sensitive silver iodobromide emulsion (AgI: 7 mole %), 1.9 g of gelatin and 0.93 g of DBP containing 1.84 g of the yellow coupler (Y - 2) shown below dissolved therein.

Layer 10 . . . High sensitivity blue-sensitive silver halide emulsion layer containing 1.2 g of high sensitivity blue-sensitive silver iodobromide emulsion (AgI: 6 mole %), 2.0 g of gelatin and 0.23 g of DBP containing 0.46 g of the yellow coupler (Y - 2) dissolved therein.

Layer 11 . . . The second protective layer comprising gelatin.

Layer 12 . . . The first protective layer containing 2.3 g of gelatin.

Yellow coupler (Y-2)

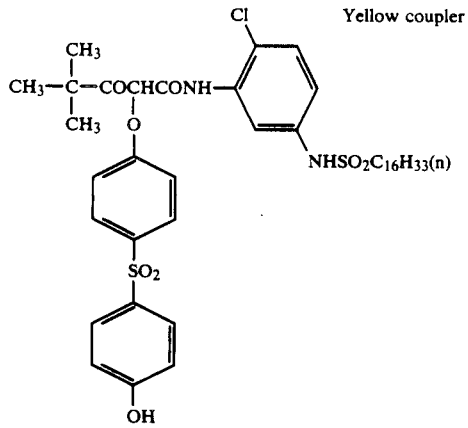

These samples were cut into pieces, and by use of the pieces to which wedge-type exposure was given in a conventional manner were subjected to processing according to the following steps.

| Processing step | Processing step A: Processing temperature (°C.) and processing time | Tank volume (l) / Supplemented amount (ml/dm$^2$) |
|---|---|---|
| Color developing | 38 ± 0.3<br>3 min 15 sec | 18 / 15 |
| Bleach-fixing (1) | 38 ± 5<br>shown in Table 8 | 15 / — |
| Bleach-fixing (2) | 38 ± 5<br>shown in Table 8 | 15 / 10 |
| Water washing-free stabilization A (1) | 38 ± 5<br>2 min | 15 / — |
| Water washing-free stabilization A (2) | 38 ± 5<br>2 min | 15 / 10 |
| Stabilization | 38 ± 5<br>2 min | 15 / 10 |
| Drying | 2 min 30 sec | |

From water washing-free stabilization A (2) to water washing-free stabilization A (1), a counter-current system (two stage counter-current) was employed and also for bleach-fixing a counter-current system was employed from bleach fixing (2) to bleach-fixing (1).

The amount of the processing solution carried over into each tank from the preceding tank was 0.6 ml/dm$^2$.

| Processing step | Processing step B: Processing temperature (°C.) and processing time | Tank volume (l) / Supplemented amount (ml/dm$^2$) |
|---|---|---|
| Color developing | 38 ± 0.3<br>3 min 15 sec | 18<br>15 |
| Bleach-fixing (1) | 38 ± 0.3<br>shown in Table 8 | 15<br>— |
| Bleach-fixing (2) | 38 ± 0.3<br>shown in Table 8 | 15<br>10 |
| Water washing-free stabilization B (1) | 38 ± 0.3<br>2 min | 15<br>— |
| Water washing-free stabilization B (2) | 38 ± 0.3<br>2 min | 15<br>— |
| Water washing-free stabilization B (3) | 38 ± 0.3<br>2 min | 15<br>10 |
| Drying | 2 min 30 sec | |

From water washing-free stabilization B (3) to water washing-free stabilization B (2), a counter-current system (three stage counter-current) was employed and also for bleach fixing a counter-current system was employed from bleach-fixing (2) to bleach-fixing (1).

In the following, the recipes of the respective tank solutions and the respective replenishing solutions are shown.

| [Color developing tank solution] | |
|---|---|
| Potassium carbonate | 30 g |
| Sodium sulfite | 2.0 g |
| Hydroxylamine sulfate | 2.0 g |
| 1-Hydroxyethylidene-1,1-diphosphonic acid (60% aqueous solution) | 1.0 g |
| Magnesium chloride | 0.2 g |
| Hydroxyethyliminodiacetic acid | 3.0 g |
| Potassium bromide | 1.2 g |
| Sodium hydroxide | 3.4 g |
| N-ethyl-N-β-hydroxyethyl-3-methyl-4-amino-aniline sulfate | 4.6 g |
| (made up to one liter with addition of water and adjusted to pH 10.1 with sodium hydroxide) | |
| [Color developing tank replenishing solution] | |
| Potassium carbonate | 40 g |
| Sodium sulfite | 3.0 g |
| Hydroxylamine sulfate | 3.0 g |
| Diethylenetriaminepentaacetic acid | 3.0 g |
| Potassium bromide | 0.9 g |
| Sodium hydroxide | 3.4 g |
| N-ethylene-N-β-hydroxyethyl-3-methyl-4-amino-aniline sulfate | 5.6 g |
| (made up to one liter with addition of water and adjusted to pH 10.2 with sodium hydroxide) | |
| [Bleach-fixing tank solution and replenishing solution] | |
| Ferric diammonium diethylenetriamine-pentaacetate | 0.5 mole |
| Hydroxyethyliminodiacetic acid | 20 g |
| Ammonium thiosulfate (70% weight/volume) | 250 ml |
| Ammonium sulfite | 15 g |
| Bleaching accelerator Exemplified compound (V-9) | 1.0 g/l |
| Aqueous ammonia (28%) | 20 ml |
| (made up to one liter with addition of water and adjusted to pH 7.6 with acetic acid and aqueous ammonia) | |
| [Water washing-free stabilization A tank solution and replenishing solution] | |
| 5-Chloro-2-methyl-4-isothiazolin-3-one | 0.01 g |
| 2-Methyl-4-isothiazolin-3-one | 0.01 g |
| Ethylene glycol | 2.0 g |
| (made up to one liter with addition of water and adjusted to pH 7.0 with sulfric acid and aqueous ammonia) | |
| [Stabilizing tank solution and replenishing solution] | |
| Formalin (37% aqueous solution) | 3 ml |
| Konidax (produced by Konica Corporation) | 7 ml |
| (made up to one liter with addition of water) | |
| [Water washing-free stabilization B tank solution and replenishing solution] | |
| 5-Chloro-2-methyl-4-isothiazolin-3-one | 0.01 g |
| 2-Methyl-4-isothiazolin-3-one | 0.01 g |
| Hexamethylenetetramine | 2.0 g |
| Ammonium sulfite | 1.0 g |
| Konidax (produced by Konica Corporation) | 5 ml |
| (made up to one liter with addition of water and adjusted to pH 7.0 with sulfric acid and aqueous ammonia) | |

The bleach-fixing step under the above conditions was made the time shown in Table 8, and continuous processing was conducted until the total amount supplemented of the bleach fixing solution became 3-fold of the tank volume. After the continuous processing, the silver concentration in the bleach-fixing solution was measured and written in Table 8. Next, after exposure of the above light-sensitive material as the sample, the time for water washing-free stabilization and stabilization were varied with 20 seconds as one unit, and the time when the drying contamination in the color film per dm$^2$ became one or more is shown in Table 8.

TABLE 8

| No. | Processing steps | Bleach-fixing time fixing (1) | Bleach-fixing time fixing (2) | Silver concentration (g/l) Bleach-fixing (1) | Silver concentration (g/l) Bleach-(each tank is the (2) | Time of not occurring drying contamination same time) | Remarks |
|---|---|---|---|---|---|---|---|
| 59 | Water washing-free stabilization A (1) (2) | 30 sec | 5 min 30 sec | 8.5 | 8.0 | 1 min 20 sec - 1 min 20 sec - 1 min 20 sec | Comparative |
| 60 | Stabilization | 3 min | 3 min | 8.5 | 0.9 | 40 sec - 40 sec - 40 sec | This invention |
| 61 | Water washing-free stabilization B | 30 sec | 5 min 30 sec | 8.5 | 8.0 | 1 min 40 sec - 1 min 40 sec - 1 min 40 sec | Comparative |
| 62 | (1) (2) (3) | 3 min | 3 min | 8.5 | 0.9 | 40 sec - 40 sec - 40 sec | This invention |

The present invention, as shown in the above Table 8, is free from generation of drying contamination even in short time processing, and is capable of rapid processing and very preferable. Further, even in B having no final stabilizing processing, similarly rapid processing is possible, whereby one liquid can be omitted and it can be appreciated that the present invention is very effective.

EXAMPLE 9

In the rapid step B in Example 8, the bleach-fixing (1) was made 3 minutes, the bleach-fixing (2) 3 minutes, into the bleach-fixing tank solution of (1) were added 6% of the color developing solution, silver in the Table 9 (added as silver bromide), and into the bleach-fixing tank solution of (2) 0.4% of the color developing solution and the silver shown below in Table 2 (added as silver bromide), respectively, and into the respective tanks of the water washing-free stabilizing solutions B (1), (2) and (3) were added respectively the solution in the above tank of the bleach-fixing (2), at 6% in the tank (1), 0.4% in the tank (2) and 0.3% in the tank (3), respectively, and the same evaluation as in Example 1 was conducted.

The results are shown in Table 9.

TABLE 9

| No. | Silver concentration (g/l) Bleach-fixing (1) | Silver concentration (g/l) Bleach-fixing (2) | Time of not occurring drying contamination (each tank is the same time) | Remarks |
|---|---|---|---|---|
| 63 | 10.0 | 10.0 | 1 min 40 sec - 1 min 40 sec - 1 min 40 sec | Comparative |
| 64 | 10.0 | 9.0 | 1 min 40 sec - 1 min 40 sec - 1 min 40 sec | |
| 65 | 10.0 | 8.0 | 1 min 20 sec - 1 min 20 sec - 1 min 20 sec | |
| 66 | 10.0 | 5.0 | 1 min - 1 min - 1 min | This invention |
| 67 | 10.0 | 2.0 | 40 sec - 40 sec - 40 sec | |
| 68 | 10.0 | 1.0 | 40 sec - 40 sec - 40 sec | |
| 69 | 10.0 | 0.5 | 40 sec - 40 sec - 40 sec | |

As is apparent from the results in Table 9, it can be understood that rapid processing is possible at a silver concentration in the bleach-fixing solution of 80% or less in the second tank (bleach-fixing (2)) relative to the first tank (bleach-fixing (1)), more effective at 50% or less, particularly effective at 25% or less.

EXAMPLE 10

The addition effect of bleaching accelerator was experimented. That is, in the processing step B in Example 8, the bleach-fixing time was varied as No. 1 and No. 2 in Table 10, and respective continuous processings were performed for 4 series and evaluated similarly as in Example 8.

The results of the number of drying contamination per 100 $cm^2$ in each case are shown in Table 10.

TABLE 10

| Processing time of water washing-free B | Number of drying contamination per 100 $dm^2$ (number): Bleaching accelerator not added: 1 tank method (10 min) Ag 8-9 g/l Comparative | Bleaching accelerator not added: 2 tank method (4 min × 2) (1) Ag 8-9 g/l (2) Ag 0.5-1.5 g/l This invention | Bleaching accelerator (V) - 9 added: 1 tank method (8 min) Ag 8-9 g/l Comparative | Bleaching accelerator (V) - 9 added: 2 tank method (3 min × 2) (1) Ag 8-9 g/l (2) Ag 0.5-1.5 g/l This invention |
|---|---|---|---|---|
| 20 sec - 20 sec - 20 sec | 28 | 15 | 52 | 19 |
| 40 sec - 40 sec - 40 sec | 11 | [0] | 39 | [0] |
| 60 sec - 60 sec - 60 sec | [0] | 0 | 18 | 0 |
| 1 min 20 sec - 1 min 20 sec - 1 min 20 sec | 0 | 0 | 7 | 0 |
| 1 min 40 sec - 1 min 40 sec - 1 min 40 sec | 0 | 0 | [0] | 0 |

The place shown by the bracket is the shortest time shown in Examples 8 and 9, and as is apparent from Table 10, although contamination is liable to occur in the presence of a bleaching accelerator, the present invention can perform processing within the same time even in the presence of a bleaching accelerator, thus being capable of preferable rapid processing.

EXAMPLE 11

The same experiment as in Example 10 was conducted except for using those shown in Table 11 in place of the bleaching accelerator V-9 in Example 10 and fixing the water washing-free stabilizing processing time at 40 sec—40 sec—40 sec. The results are shown in Table 11.

TABLE 11

| Experimental No. | Bleach-fixing accelerator added (2 g/l) | Bleach-fixing (1) Ag 8,5 g/l, 1 min 30 sec; Bleach-fixing (2) Ag 5.6 g/l, 4 min 30 sec (number)* | Bleach-fixing (1) Ag 8,5 g/l, 3 min; Bleach-fixing (2) Ag 0.9 g/l, 3 min (number)* |
|---|---|---|---|
| 11-1 | Not added | 11 | 0 |
| 11-2 | Exemplary compound (I-2) | 23 | 0 |
| 11-3 | Exemplary compound (I-9) | 24 | 0 |
| 11-4 | Exemplary compound (II-6) | 22 | 0 |
| 11-5 | Exemplary compound (II-5) | 23 | 0 |

TABLE 11-continued

| Experimental No. | Bleach-fixing accelerator added (2 g/l) | Bleach-fixing (1) Ag 8,5 g/l, 1 min 30 sec (number)* | Bleach-fixing (2) Ag 5.6 g/l, 4 min 30 sec (number)* | Bleach-fixing (1) Ag 8,5 g/l, 3 min Bleach-fixing (2) Ag 0.9 g/l, 3 min (number)* |
|---|---|---|---|---|
| 11-6 | Exemplary compound (II-27) | 26 | | 0 |
| 11-7 | Exemplary compound (III-13) | 21 | | 0 |
| 11-8 | Exemplary compound (III-14) | 22 | | 0 |
| 11-9 | Exemplary compound (III-15) | 20 | | 0 |
| 11-10 | Exemplary compound (IV-1) | 24 | | 0 |
| 11-11 | Exemplary compound (V-9) | 39 | | 0 |
| 11-12 | Exemplary compound (V-10) | 38 | | 0 |
| 11-13 | Exemplary compound (V-13) | 39 | | 0 |
| 11-14 | Exemplary compound (VI-8) | 25 | | 0 |
| 11-15 | Exemplary compound (VI-9) | 24 | | 0 |
| 11-16 | Exemplary compound (VII-3) | 25 | | 0 |
| 11-17 | Exemplary compound (VIII-1) | 27 | | 0 |
| 11-18 | Exemplary compound (VIII-4) | 28 | | 0 |
| 11-19 | Exemplary compound (IX-1) | 26 | | 0 |

*Numbers of stain in 100 $cm^2$.

As is apparent from Table 11, in Comparative example, contamination is generated in large amount if there is a bleaching accelerator, but in the processing of the present invention, there is no problem, whereby it has been found that the present invention is very preferable for addition of the bleaching accelerators represented by the formula (I) to (IX).

EXAMPLE 12

In the processing step B in Example 8, by varying the ferric ammonium diethylenetriaminepentaacetate (DTPAFe) in bleach-fixing (BF), the BF time necessary for desilverization and color restoration and the water washing-free stabilization processing time without occurrence of drying contamination after processing for the BF time were measured. Also, at Ag 10 g/liter in the one tank method BF, BF time when desilverization and color restoration are completed and the water washing-free stabilization processing time without occurrence of drying contamination were measured. The results are shown in Table 12.

TABLE 12

| $DTPAFeNH_4$ amount in bleach-fixing solution (mole/liter) | 2 tank method bleach-fixing processing (this invention) silver 10 g:2 g | | 2 tank method bleach-fixing processing (this invention) silver 10 g:2 g | |
|---|---|---|---|---|
| | Bleach-fixing processing time at which desilverization and color restration are completed | Washing-free stabilization time at which no dyring stain is caused | Bleach-fixing processing time at which desilverization and color restration are completed | Washing-free stabilization time at which no dyring stain is caused |
| 0.2 | 4 min × 2 | 40 sec × 3 | 9 min 00 sec | 1 min × 3 |
| 0.25 | 3 min 40 sec × 2 | 40 sec × 3 | 8 min 30 sec | 1 min 10 sec × 3 |
| 0.3 | 3 min 10 sec × 2 | 40 sec × 3 | 7 min 00 sec | 1 min 20 sec × 3 |
| 0.5 | 2 min 30 sec × 2 | 40 sec × 3 | 5 min 30 sec | 1 min 20 sec × 3 |
| 0.8 | 2 min 30 sec × 2 | 40 sec × 3 | 5 min 30 sec | 1 min 20 sec × 3 |
| 1.0 | 2 min 40 sec × 2 | 50 sec × 3 | 6 min 00 sec | 1 min 30 sec × 3 |
| 1.2 | 2 min 50 sec × 2 | 60 sec × 3 | 6 min 30 sec | 1 min 50 sec × 3 |

From Table 12, in the present invention, it can be understood that 0.25 to 1.0 mole/liter is preferable, particularly 0.3 to 0.8 mole/liter.

When experiments were conducted by varying the amounts of ferric ammonium salts of EDTA, PDTA, MeEDTA, CyDTA and GEDTA, similarly 0.25 to 1.0 mole/liter, particularly 0.3 to 0.8 mole/liter was found to be preferable.

EXAMPLE 13

In Example 2, the same treatments were carried out with respect to Samples No. 9 to No. 16 except that a processing with an alkaline solution shown below immediately after a bleach-fixing processing, and then drying were carried out.

Color restration rates thereof were measured.

The results are shown below.

| [Alkaline solution] | |
|---|---|
| Sodium hydrogen salt of iron (III) diethylenetriaminepentaacetate (DTPAFeNaH) | 10 g |
| Diethylenetriaminepentaacetic acid | 2 g |
| Potassium carbonate | 10 g |
| (Made up to one liter with addition of water and adjusted to pH 10.00 with potassium hydrogen carbonate and potassium hydroxide.) | |

TABLE 13

| Sample No. | Cyan coupler | Residual silver amount (mg/100 $cm^2$) | Color restration rate (%) | Remarks |
|---|---|---|---|---|
| 9 | Exemplary compound C-1 | 0.66 | 100 | This invention |
| 10 | Exemplary compound C-2 | 0.66 | 99 | This invention |
| 11 | Exemplary compound C-23 | 0.65 | 99 | This invention |
| 12 | Exemplary compound C-32 | 0.67 | 100 | This invention |
| 13 | Exemplary compound C-36 | 0.65 | 99 | This invention |
| 14 | Exemplary | 0.67 | 100 | This in- |

TABLE 13-continued

| Sample No. | Cyan coupler | Residual silver amount (mg/100 cm²) | Color restration rate (%) | Remarks |
|---|---|---|---|---|
| | compound C-70 | | | vention |
| 15 | Exemplary compound C-79 | 0.67 | 100 | This invention |
| 16 | Exemplary compound C-96 | 0.65 | 99 | This invention |

In the present invention, it can be understood that by processing with an alkanline solution having a pH of 8 or more immediately after the bleach-fixing processing without carrying out a washing processing, color restration rates of the light-sensitive materials become substantially 100%.

We claim:

1. A method for processing a light-sensitive silver halide color photographic material by subjecting a light-sensitive silver halide color photographic material after color developing to bleach-fixing processing, characterized in that said light-sensitive silver halide color photographic material contains at least one cyan coupler represented by the following formula (A), (B) or (C), or contains at least one magenta coupler represented by the following formula (M - 1), said bleach-fixing processing step is a step which is a counter-current system uses two or more tanks of continuous bleach-fixing tanks, and the silver concentration in the bleach-fixing solution in a final tank of said bleach-fixing tanks is maintained at 80% or lower of the silver concentration in a bleach-fixing solution in a first tank, (A)

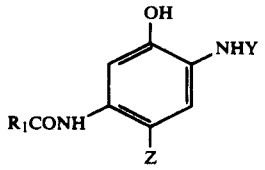

(B)

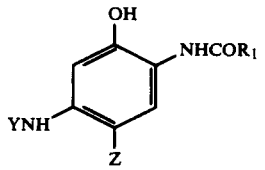

wherein $R_1$ represents an alkyl group, an alkenyl group, a cycloalkyl group, an aryl group or a heterocyclic group, Y represents a group represented by

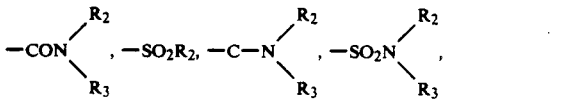

$-CONHCOR_2$ or $-CONHSO_2R_2$ where $R_2$ represents an alkyl group, an alkenyl group, a cycloalkyl group, an aryl group or a heterocyclic group, and $R_3$ represents a hydrogen atom or a group represented by $R_2$, and $R_2$ and $R_3$ may be the same or different and may form a hetero ring of 5 to 6-membered by combining with each other;

Z represents a hydrogen atom or a group eliminatable through the coupling reaction with an oxidized product of an aromatic primary amine series color developing agent, (C)

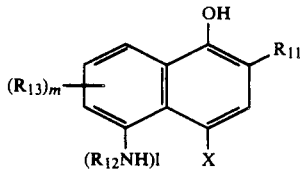

wherein $R_{11}$ represents $-CONR_{14}R_{15}$, $-NHCOR_{14}$, $-NHCOOR_{16}$, $-NHSO2R_{16}$, $-NHCONR_{14}R_{15}$ or $-NHSO2NR_{14}R_{15}$; $R_{12}$ represents a monovalent group; $R_{13}$ represents a substituent group; X represents a hydrogen atom or a group eliminatable through the reaction with an oxidized product of an aromatic primary amine color developing agent; l is 0 or 1; and m is 0 to 3; where $R_{14}$ and $R_{15}$ each represent a hydrogen atom, an aromatic group, an aliphatic group or a heterocylic group; $R_{16}$ represents an aromatic group, an aliphatic group or a heterocylic group; respectively, and when m is 2 or 3, each $R_{13}$ may be the same or different and may form a ring to combine with each other, and also $R_{14}$ and $R_{15}$, $R_{12}$ and $R_{13}$, and $R_{12}$ and X may form a ring to combine with each other, provided that l is 0, m is 0 and $R_{11}$ is $-CONHR_{17}$ where $R_{17}$ represents an aromatic group, (M-1)

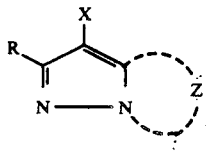

wherein Z represents a metal atom group necessary for forming a nitrogen-containing heterocyclic ring, and a ring formed by said Z may have a substituent or substituents; X represents a hydrogen atom or a group eliminatable through the reaction with an oxidized product of a color developing agent; and R represents a hydrogen atom or a substituent.

2. A method for processing a light-sensitive silver halide color photographic material according to claim 1, wherein a number of the tanks of the bleach-fixing tanks are 2 to 4.

3. A method for processing a light-sensitive silver halide color photographic material according to claim 1, wherein the silver concentration in a bleach-fixing solution in the final tank is 60% or less of the silver concentration in the bleach-fixing solution in the first tank.

4. A method for processing a light-sensitive silver halide color photographic material according to claim 1, wherein the silver concentration in the final tank is 0.07 mole or less per one liter of the bleach-fixing solution.

5. A method for processing a light-sensitive silver halide color photographic material according to claim 1, wherein an absolute concentration of an iodide in the first tank is 0.002 to 0.03 mole/liter.

6. A method for processing a light-sensitive silver halide color photographic material according to claim 1, wherein the counter-current system is a system in which the replenishing bleach-fixing solution is replenished from the final tank and replenished successively to the preceding tank in the counter-current system in a method wherein processing is conducted in a continuous bleach-fixing tank comprising two or more.

7. A method for processing a light-sensitive silver halide color photographic material according to claim 1, wherein a processing with an alkaline solution is carried out immediately after the bleach-fixing processing.

8. A method for processing a light-sensitive silver halide color photographic material by subjecting a light-sensitive silver halide color photographic material after color developing to bleach-fixing processing and then to stabilizing processing substituted for water washing, characterized in that said light-sensitive silver halide color photographic material has at least one light-sensitive emulsion layer containing a silver halide emulsion containing 0.5 mole % or more of silver iodide, said bleach-fixing processing step is a step which is a counter-current system by use of an organic acid metal complex as the oxidizing agent and uses two or more tanks of continuous bleach-fixing tanks, and the silver concentration in a final tank of said bleach-fixing tanks is maintained at 80% or lower of the silver concentration in the bleach-fixing solution in a first tank.

9. A method for processing a light-sensitive silver halide color photographic material according to claim 8, wherein a number of the tanks of the bleach-fixing tanks are 2 to 4.

10. A method for processing a light-sensitive silver halide color photographic material according to claim 8, wherein the silver concentration in a bleach-fixing solution in the final tank is 60% or less of the silver concentration in the bleach-fixing solution in the first tank.

11. A method for processing a light-sensitive silver halide color photographic material according to claim 8, wherein the silver concentration in the final tank is 0.07 mole or less per one liter of the bleach-fixing solution.

12. A method for processing a light-sensitive silver halide color photographic material according to claim 8, wherein an absolute concentration of an iodide in the first tank is 0.002 to 0.03 mole/liter.

13. A method for processing a light-sensitive silver halide color photographic material according to claim 8, wherein the counter-current system is a system in which the replenishing bleach-fixing solution is replenished from the final tank and replenished successively to the preceding tank in the counter-current system in a method wherein processing is conducted in a continuous bleach-fixing tank comprising two or more.

14. A method for processing a light-sensitive silver halide color photographic material according to claim 1, wherein the silver concentration in a bleach-fixing solution in the final tank is 60% or less of the silver concentration in the bleach-fixing solution in the first tank;

the silver concentration in the final tank is 0.07 mole or less per one liter of the bleach-fixing solution; and an absolute concentration of iodide in the first tank is 0.002 to 0.03 mole/liter.

15. A method for processing a light-sensitive silver halide color photographic material according to claim 1, wherein a number of the tanks of the bleach-fixing tanks are 2 to 4.

* * * * *